US006308948B1

(12) United States Patent
Azumi

(10) Patent No.: US 6,308,948 B1
(45) **Date of Patent: *Oct. 30, 2001**

(54) STAPLING APPARATUS

(75) Inventor: Shinichi Azumi, Yamatotakada (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/342,674

(22) Filed: Jun. 29, 1999

(30) Foreign Application Priority Data

Jun. 30, 1998 (JP) ..... 10-185140

(51) Int. Cl.[7] ..... B65H 39/00

(52) U.S. Cl. ..... 271/207; 271/213; 271/214; 271/217; 399/410; 399/408; 399/407; 270/58.08; 270/58.07; 270/58.01

(58) Field of Search ..... 271/207–224

(56) References Cited

U.S. PATENT DOCUMENTS 4,605,211 * 8/1986 Sonobe ..... 270/58.17
4,835,573 * 5/1989 Rohrer et al. ..... 399/23
5,449,167 * 9/1995 Takehara et al. ..... 271/296
5,625,860 4/1997 Maeda et al. ..... 399/403
5,713,566 * 2/1998 Coombs et al. ..... 270/58.12
5,881,337 * 3/1999 Higashikawa et al. ..... 399/82

FOREIGN PATENT DOCUMENTS 8239159 9/1996 (JP) .
09124220 5/1997 (JP) .

* cited by examiner

*Primary Examiner*—Donald P. Walsh
*Assistant Examiner*—Jonathan R. Miller
(74) *Attorney, Agent, or Firm*—Renner, Otto, Boisselle & Sklar, LLP

(57) ABSTRACT

A stapling apparatus for forming a plurality of sheet bundles on a sheet tray comprises a sheet tray, a stapler, moving means, and movement controlling means. The stapler is moved upward by the moving means and the movement controlling means to the position where plural sheets placed on the sheet tray are to be stapled. Consequently, the stapling apparatus can staple the sheets in the position where the sheets are to be bound which changes upward each time the sheet bundle is formed by the stapler and form a plurality of sheet bundles on the sheet tray.

19 Claims, 46 Drawing Sheets

STAPLING APPARATUS

BACKGROUND OF THE INVENTION

1. FIELD OF THE INVENTION

The present invention relates to a stapling apparatus, and more particularly to a stapling apparatus which is provided in printing apparatuses such as copying machines, printers and facsimile apparatuses to staple sheets of paper ejected from the printing apparatuses on two or more sheets basis to form sheet bundles.

2. DESCRIPTION OF THE RELATED ART

Hitherto, as a post-processing apparatus each provided in printing apparatuses such as copying machines, printers and facsimile apparatuses, there are known a number of stapling apparatuses each having a stapler for aligning and stapling sheets of paper ejected from the printing apparatus on two or more sheets basis. A recording sheet post-processing apparatus disclosed in Japanese Unexamined Patent Publication JP-A 9-124220 (1997) is provided between a fixing unit in a sheet transporting path of a printing apparatus and an output tray as a sheet tray provided at a sheet ejecting position, and comprises a clinch roller, a press roller, a stopper, a solenoid, and a stapler. The press roller is in press contact with the clinch roller and releases the press contacting force as necessary. The stopper can close the sheet transporting path, which stopper is provided swingably between a recording sheet stop position where the front ends of a plurality of recording sheets come into contact with the stopper, thereby stopping the recording sheets and an open position where the sheet transporting path is opened for conveying a sheet bundle of plural recording sheets to the output tray. The solenoid swings the stopper between the recording sheet stop position and the open position. The stapler is provided movably in the width direction of the recording sheet and staples a plurality of recording sheets whose tips being aligned by the stopper. The clinch roller is driven with a predetermined torque which does not buckle the recording sheet when the tips of the plurality of recording sheets come into contact with the stopper.

The recording sheet which has passed through the fixing unit of the printing apparatus is conveyed under conditions of being sandwiched between the clinch roller and the press roller. The tip of the recording sheet comes into contact with the stopper disposed in the recording sheet stopping position while preventing the recording sheet from being bent by the clinch roller driven with a predetermined torque. The subsequent recording sheets are similarly conveyed and the tips of the recording sheets come into contact with the stopper. The plurality of recording sheets whose tips are aligned by the stopper are stapled by the stapler at a position according to the sheet size, thereby forming a sheet bundle of recording sheets. When the stopper is driven so as to be disposed in the open position by the solenoid, the recording sheet bundle formed by the driving of the clinch roller is placed on the output tray via the opened sheet transporting path. By repeating the operations, a plurality of sheet bundles of recording sheets can be formed.

Japanese Unexamined Patent Publication JP-A 8-239159 (1996) discloses an image forming apparatus with a sorter having a construction such that a plurality of copy sheets are ejected to each of sorter bins of the sorter and the copy sheets in each bin are stapled with a staple.

In a recording sheet post-processing apparatus disclosed in the publication of Japanese Unexamined Patent Publication JP-A 9-124220 (1997), the tips of recording sheets are brought into contact with the stopper for closing the sheet transporting path to stop the recording sheets, and the plurality of recording sheets stopped are bound up, thereby forming a sheet bundle of the recording sheets. The sheet bundle of recording sheets is discharged onto the output tray by the function of the stopper which opens the sheet transporting path. By repeating such operations, a plurality of sheet bundles of recording sheets are formed. Therefore, only the sheet bundles of recording sheets are placed on the output tray.

Meanwhile, a method of ejecting recording sheets onto an output tray and then forming a sheet bundle of the recording sheets can be considered. In this case, in order to form a plurality of sheet bundles of recording sheets, operations of placing recording sheets on a sheet bundle of recording sheets and binding the recording sheets on the sheet bundle have to be performed. It is therefore necessary to move the stapler in the recording sheet stacking direction. The stapler of the prior art is movable in the width direction of the recording sheet but cannot be moved in the recording sheet stacking direction. Consequently, even if the technique is applied to an apparatus for forming a plurality of sheet bundles of recording sheets on the output tray, a plurality of sheet bundles of recording sheets cannot be formed. Since the recording sheet bundle is formed in the sheet transporting path between the fixing part of the printing apparatus and the output tray, there is a case such that the recording sheet bundle is jammed in the sheet transporting path when it is ejected to the output tray. An inconvenience such that the operation of forming the recording sheet bundle is stopped each time the recording sheet bundle is jammed in the sheet transporting path occurs. It is therefore desired to improve the reliability in the formation of the recording sheet bundle.

Since the image forming apparatus with the sorter disclosed in the publication of Japanese Patent Application JP-A 8-239159 (1996) has a structure that a sort bin is provided for each sheet bundle, clearances between the sort bins are dead spaces. There is consequently a problem that only a determined number of sheet bundles can be placed.

SUMMARY OF THE INVENTION

It is an object of the invention to provide a stapling apparatus capable of binding a plurality of sheets which are stacked on a sheet tray to form a plurality of sheet bundles on the sheet tray, thereby enabling the reliability in the formation of sheet bundles to be improved.

The present invention provides a stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding the plurality of sheets stacked on the sheet tray;

moving means for moving the stapler in a sheet stacking direction; and movement controlling means for controlling the moving means so that the stapler is disposed in a position in the sheet stacking direction where the plurality of sheets stacked on the sheet tray are to be bound.

According to the invention, when a plurality of sheets for a first sheet bundle are stacked on the sheet tray, the stapler is disposed in the position where the sheets are to be bound, by the moving means and the movement controlling means. The stapler disposed in the position for the first sheet bundle binds the sheets to form the first sheet bundle. When a plurality of sheets for a second sheet bundle are stacked on the first sheet bundle, the stapler is disposed in a position for the second sheet bundle, higher than that for the first sheet bundle, by the moving means and the movement controlling means. The stapler disposed in the position for the second sheet bundle binds the sheets to form the second sheet bundle. Such operations for the second sheet bundle are carried out for a third and subsequent sheet bundles.

Since the stapler is moved in the sheet stacking direction and disposed in a position where a plurality of sheets are to be bound, sheet bundles can be formed by binding sheets in a binding position in the sheet stacking direction for each sheet bundle. Since the sheet bundles can be formed on the sheet tray, which is different from the prior art having a construction of ejecting a sheet bundle formed in a printing apparatus, an inconvenience such that the formed sheet bundle is jammed in the printing apparatus before it is ejected onto the sheet tray, does not occur, so that the reliability in formation of sheet bundles can be improved.

Since it is unnecessary to provide a plurality of sheet transporting paths according to the sorter bins as in the sorter of the prior art, the sheet transport is simplified and the sheet ejecting part can be formed compactly, so that the size of the image forming apparatus can be reduced.

In the invention it is preferable that the stapling apparatus further comprises:

pushing means arranged in a peripheral part of the sheet tray, for pushing against a side face of the formed sheet bundle so as to move the sheet bundle away from the stapler.

According to the invention, the side face of the first sheet bundle placed on the sheet tray is pushed by the pushing means and the sheet bundle is pushed away from the stapler. The second sheet bundle is placed on the first sheet bundle which is moved away from the stapler, so as to be deviated toward the stapler side. The stapler binds and forms the second sheet bundle. The side face of the second sheet bundle is pushed by the pushing means so that the sheet bundle is moved away from the stapler. Operations similar to those for the second sheet bundle are performed for the third and subsequent sheet bundles.

Since the pushing means pushes against the side face of the formed sheet bundle to move the sheet bundle away from the stapler, the second and subsequent sheet bundles are placed near to the stapler side so as to be deviated from the stapler. The stapler can therefore move in the sheet stacking direction without interfering with the formed sheet bundle and securely bind a plurality of sheets, thereby enabling a plurality of sheet bundles to be formed.

It is preferable to dispose means for aligning the sheet bundle in a peripheral part of the sheet tray so as to face the pushing means. With the arrangement, the side opposite to the stapler side of the sheet bundle pushed away from the stapler by the pushing means comes into contact with the aligning means, so that movement of the sheet bundle in the sheet tray can be regulated. Especially, in case of forming a plurality of sheet bundles, the plurality of sheet bundles can be stacked, aligned, and placed on the sheet tray in the state where the plurality of sheet bundles are away from the stapler.

The invention provides a stapling apparatus for stapling a plurality of sheets to form sheet bundles, comprising:

a sheet tray on which sheets are sequentially stacked and formed sheet bundles are placed;

a stapler disposed in a peripheral part of the sheet tray, for stapling a plurality of sheets stacked on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in a sheet stacking direction and a direction opposite to the sheet stacking direction;

bending side unit moving means for moving the bending side unit of the stapler both in the sheet stacking direction and in the direction opposite to the sheet stacking direction;

uppermost sheet-surface sensing means for sensing a position of an uppermost sheet-surface of the stack of sheets placed on the sheet tray by using a predetermined position in an upper part of the stapling apparatus as a reference;

stack of sheets thickness calculating means for calculating thickness of the plurality of sheets; and movement controlling means for controlling the driving side unit moving means and the bending side unit moving means so that either the driving side unit or the bending side unit is disposed in a sensed position of the uppermost sheet-surface of the stack of sheets and the other of the driving side and bending side units is disposed in a position obtained by adding the calculated thickness of the stack of sheets to the position of the uppermost sheet-surface of the stack of sheets.

According to the invention, when a plurality of sheets are stacked on the sheet tray, the position of the uppermost sheet-surface of the stack of sheets is sensed by the uppermost sheet-surface sensing means by using the predetermined position in the upper part of the stapling apparatus as a reference and the thickness of the sheets is calculated by the stack of sheets thickness calculating means. One of the driving side and bending side units, for example, the bending side unit is moved downward by the bending side unit moving means and the movement controlling means and disposed in the sensed position of the uppermost sheet-surface of the stack of sheets. The other unit, for example, the driving side unit is then moved upward by the driving side unit moving means and the movement controlling means and disposed in the position obtained by adding the calculated thickness of the sheets to the position of the uppermost sheet-surface of the stack of sheets. The staple is driven through the sheets by the driving side unit and the tips of the driven staple projected from the sheets are bent by the bending side unit. Consequently, the plurality of sheets are stapled by using the staple, thereby forming the sheet bundle.

Since the stapler is moved in the sheet stacking direction on the basis of the position of the uppermost sheet-surface of a stack of sheets sensed by the uppermost sheet-surface sensing means and the thickness of the stack of sheets calculated by the stack of sheets thickness calculating means, the sheets can be sandwiched between the driving side and bending side units so as to be held in parallel to the sheet tray, and a staple can be driven in such a state, thereby enabling the sheets to be bound up. As described above, in case of forming a sheet bundle, the stapler can be disposed in the position optimum to bind the stack of sheets.

When air layers are interposed between a plurality of sheets, the actual thickness of the sheets becomes larger than the calculated thickness of the sheets by an amount corresponding to the thickness of the interposing air layers. Meanwhile, the calculated thickness of the sheets is used to move the units. Consequently, the sheets are sandwiched between the units with a pressure which eliminates the thickness of the air layers. Thus, the air layers interposed between the sheets can be eliminated and the sheets can be firmly bound up.

The invention provides a stapling apparatus for stapling a stack of sheets to form sheet bundles, comprising:

a sheet tray on which sheets are sequentially stacked and formed sheet bundles are placed;

a stapler disposed in a peripheral part of the sheet tray, for stapling a stack of sheets placed on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in the sheet stacking direction and the direction opposite to the sheet stacking direction;

bending side unit moving means for moving the bending side unit of the stapler both in the sheet stacking direction and the direction opposite to the sheet stacking direction;

undermost sheet-surface sensing means for sensing the position of the undermost sheet-surface of the stack of sheets placed on the sheet tray by using a predetermined position in the lower part of the stapling apparatus as a reference;

stack of sheets thickness calculating means for calculating thickness of a stack of sheets; and movement controlling means for controlling the driving side unit moving means and the bending side unit moving means so that either the driving side unit or the bending side unit is disposed in the sensed position of the undermost sheet-surface and the other one of the driving side and bending side units is disposed in a position obtained by adding the calculated thickness of the sheets to the position of the undermost sheet-surface.

According to the invention, when a plurality of sheets are stacked on the sheet tray, the position of the undermost surface of the stack of sheets is sensed by the undermost sheet-surface sensing means by using the predetermined position in the lower part of the stapling apparatus as a reference and the thickness of the sheets is calculated by the stack of sheets thickness calculating means. One of the driving side and bending side units, for example, the driving side unit is moved upward by the driving side unit moving means and the movement controlling means and disposed in the sensed position of the undermost sheet-surface. The other unit, for example, the bending side unit is moved downward by the bending side unit moving means and the movement controlling means and disposed in the position obtained by adding the calculated thickness of the sheets to the position of the undermost sheet-surface. The staple is driven through the sheets by the driving side unit and the tips of the driven staple projected from the sheets are bent by the bending side unit. Consequently, the plurality of sheets are stapled by the stapler, thereby forming a sheet bundle.

Since the stapler is moved in the sheet stacking direction on the basis of the position of the undermost sheet-surface of a plurality of sheets sensed by the undermost sheet-surface sensing means and the thickness of the plurality of sheets calculated by the stack of sheets thickness calculating means, the sheets can be sandwiched between the driving side and bending side units, held in parallel to the sheet tray, and a staple is driven in such a state, thereby enabling the sheets to be bound up. As described above, in case of forming a sheet bundle, the stapler can be disposed in the position optimum to bind the plurality of sheets.

When air layers are interposed between a plurality of sheets, the actual thickness of the stack of sheets becomes larger than the calculated one of the stack of sheets by an amount corresponding to the thickness of the interposing air layers. Meanwhile, since the calculated thickness of a stack of sheets is used to move the units, the sheets are sandwiched by the units with a pressure which eliminates the thickness of the air layers. Thus, the air layers interposed between the sheets can be eliminated and the sheets can be firmly bound.

The invention provides a stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding a plurality of sheets placed on the sheet tray, having a driving side unit for driving a staple through the sheets and a bending side unit which is provided separately from the driving unit and bends tips of the driven staple, projected from the sheets;

driving side unit moving means for moving the driving side unit of the stapler both in the sheet stacking direction and a direction opposite to the sheet stacking direction;

bending side unit moving means for moving the bending side unit of the stapler both in the sheet stacking direction and the direction opposite to the sheet stacking direction;

uppermost sheet-surface sensing means for sensing a position of an uppermost sheet-surface of a stack of sheets placed on the sheet tray by using a predetermined position in the stapling apparatus as a reference;

undermost sheet-surface sensing means for sensing a position of the undermost sheet-surface of the stack of sheets placed on the sheet tray by using a predetermined position in the stapling apparatus as a reference; and movement controlling means for controlling the driving side unit moving means and the bending side unit moving means so that either the driving side unit or the bending side unit is disposed in the sensed position of the uppermost sheet-surface of the stack of sheets and the other one of the driving side and bending side units is disposed in the sensed position of the undermost sheet-surface of the stack of sheets.

According to the invention, when a plurality of sheets are stacked on the sheet tray, the position of the uppermost sheet-surface of the stack of sheets is sensed by using the predetermined position in the stapling apparatus as a reference by the uppermost sheet-surface sensing means and the position of the undermost sheet-surface of the stack of sheets is sensed by using the predetermined position in the stapling apparatus as a reference by the undermost sheet-surface sensing means. One of the driving side and bending side units, for example, the bending side unit is moved downward by the bending side unit moving means and the movement controlling means and disposed in the sensed position of the uppermost sheet-surface of the stack of sheets. The other unit, for example, the driving side unit is moved upward by the driving side unit moving means and the movement controlling means and disposed in the sensed position on the under surface. The staple is driven through the sheets by the driving side unit and the tips of the driven staple projected from the sheets are bent by the bending side unit. Consequently, the plurality of sheets are stapled by the stapler, thereby forming the sheet bundle.

Since the stapler is moved in the sheet stacking direction on the basis of the position of the uppermost sheet-surface of the stack of sheets sensed by the uppermost sheet-surface sensing means and the position of the undermost sheet-surface of the stack of sheets sensed by the undermost sheet-surface sensing means, the driving side and bending side units can sandwich the sheets held in parallel to the sheet tray, and a staple can be driven in such a state, thereby enabling the sheets to be bound up. As described above, in case of forming a sheet bundle, the stapler can be disposed in the position optimum to bind the plurality of sheets irrespective of the thickness of the sheets.

In the invention it is preferable that the sheet-surface sensing means comprises:

upper reference position sensing means for sensing that either the driving side unit or the bending side unit which is on the side opposite to the sheet tray of a plurality of sheets is disposed in the predetermined position in the upper part of the stapling apparatus;

uppermost sheet-surface contact sensing means which is provided on the side facing the sheet tray of the one of the units, for sensing that the one of the units comes into contact with the uppermost sheet-surface of the stack of sheets placed on the sheet tray; and measuring means for measuring a movement amount of the one of the units from the predetermined position to the uppermost sheet-surface position, and the movement controlling means controls the driving side and bending side unit moving means so as to move the one of the units until the uppermost sheet-surface contact sensing means senses that the one of the units comes into contact with the uppermost sheet-surface of the stack of sheets.

According to the invention, when a plurality of sheets are stacked on the sheet tray, one of the units, for example, the bending side unit whose face in contact with the uppermost sheet-surface is disposed in a predetermined position by the upper reference position sensing means is moved downward by the bending side unit moving means and the movement controlling means. When the uppermost sheet-surface contact sensing means senses that the bending side unit comes into contact with the uppermost sheet-surface, the downward movement of the bending side unit is stopped by the bending side unit moving means and the movement controlling means. The measuring means measures the movement amount of the one of the units from the predetermined position to the position of the uppermost sheet-surface. By the operation, the uppermost sheet-surface sensing means senses the uppermost sheet-surface position by using the predetermined position as a reference. After that, the other unit, for example, the driving side unit is disposed so as to come into contact with the undermost sheet-surface of the stack of sheets, the sheets are sandwiched, a staple is driven through the sheets, and the sheets are bound.

The one of the units is moved until the uppermost sheet-surface contact sensing means senses that the unit comes into contact with the uppermost sheet-surface. The measuring means measures the movement of the one of the units from the predetermined position to the uppermost sheet-surface position and senses the uppermost sheet-surface position by using the predetermined position as a reference. The detection of the uppermost sheet-surface position and the movement of the one of the units to the uppermost sheet-surface position can be therefore performed in parallel. As compared with the case where the detection of the uppermost sheet-surface position and the movement of the one of the units to the uppermost sheet-surface position are performed separately, the processing speed of disposing one of the units to the uppermost sheet-surface position can be increased more. No error occurs between the mechanism of sensing the uppermost sheet-surface position and the mechanism of moving one of the units to the uppermost sheet-surface position, so that the one of the units can be accurately disposed in the position of the uppermost sheet-surface.

In the invention it is preferable that the undermost sheet-surface sensing means comprises:

lower reference position sensing means for sensing that one of the driving side and bending side units, which is on the side of the sheet tray of plurality of sheets is disposed in a predetermined position in the lower part of the stapling apparatus;

undermost sheet-surface contact sensing means which is provided on the side facing the sheet tray of the one of the units, for sensing that the one of the units comes into contact with the undermost sheet-surface of the stack of sheets placed on the sheet tray; and measuring means for measuring a movement amount of the one of the units from the predetermined position to the undermost sheet-surface position, and the movement controlling means controls the operations of the driving side and bending side unit moving means so as to move the one of the units until the undermost sheet-surface contact sensing means senses that the one of the units comes into contact with the undermost sheet-surface of the stack of sheets.

According to the invention, when a plurality of sheets are stacked on a sheet tray, one of the units, for example, the driving side unit whose face being in contact with the undermost sheet-surface is disposed in a predetermined position by the lower reference position sensing means is moved upward by the driving side unit moving means and the movement controlling means. When the undermost sheet-surface contact sensing means senses that the driving side unit comes into contact with the undermost sheet-surface, the upward movement of the driving side unit is stopped by the driving side unit moving means and the movement controlling means. The measuring means measures the movement amount of the one of the units from the predetermined position to the position of the undermost sheet-surface. Consequently, the undermost sheet-surface sensing means senses the undermost sheet-surface position by using the predetermined position as a reference. After that, the other unit, for example, the bending side unit is disposed so as to come into contact with the uppermost sheet-surface, the sheets are sandwiched, a staple is driven through the sheets, and the sheets are bound.

The one of the units is moved until the undermost sheet-surface contact sensing means senses that the unit comes into contact with the undermost sheet-surface. The measuring means measures the movement of the one of the units from the predetermined position to the undermost sheet-surface position and senses the undermost sheet-surface position by using the predetermined position as a reference. The detection of the undermost sheet-surface position and the movement of the one of the units to the undermost sheet-surface position can be therefore performed in parallel. As compared with the case where the detection of the undermost sheet-surface position and the movement of the one of the units to the undermost sheet-surface position are performed individually, the processing speed of disposing one of the units to the undermost sheet-surface position can be increased more. No error occurs between the mechanism of sensing the undermost sheet-surface position and the mechanism of moving one of the units to the undermost sheet-surface position, so that one of the units can be accurately disposed in the position of the undermost sheet-surface.

In the invention it is preferable that the stapling apparatus further comprises:

an auxiliary tray which is disposed in a peripheral part of the sheet tray and on which sheets and a sheet bundle protruded from the sheet tray are placed; and auxiliary tray moving means for moving the auxiliary tray in the sheet stacking direction, and the movement controlling means controls the operations of the driving side unit moving means, the bending side unit moving unit, and the auxiliary tray moving means so that the sheet tray and the auxiliary tray are disposed in the same position in the sheet stacking direction, and when a plurality of sheets are placed on the sheet tray, the auxiliary tray is moved to a position in the sheet stacking direction, where the sheets placed on the sheet tray are to be bound, and one of the driving side and bending side units which is on the sheet tray side of the sheets is moved.

According to the invention, when a plurality of sheets are stacked on the sheet tray, the auxiliary tray is moved to the position where the sheets placed on the sheet tray are to be bound by the auxiliary tray moving means and the movement controlling means, and sheets protruded from the sheet tray are placed on the auxiliary tray. One of the units, for example, the driving side unit is moved upward to the position of the sheets by the driving side unit moving means and the movement controlling means. After that, a staple is driven through the sheets sandwiched by the driving side unit and the other unit, for example, the bending side unit, thereby binding the sheets.

The auxiliary tray is moved to the position where the sheets placed on the sheet tray are to be bound by the auxiliary tray moving means and the movement controlling means, so that the auxiliary tray can prevent lowering of the sheets protruded from the sheet tray at the staple driving time and the sheets can be bound while placing the protruded sheets almost in parallel to the sheet tray.

It is preferable that before stacking a plurality of sheets on the sheet tray, the auxiliary tray is moved to a same level as that of the uppermost sheet of the previous stack of sheets placed on the sheet tray. By the operation, the sheets are placed on the sheet tray and the auxiliary tray can prevent the sheets projecting from the sheet tray from being lowered during the staple driving period, so that deviation in the sheets in association with the lowering can be prevented and the sheets can be bound while placing the protruded sheets almost in parallel to the sheet tray.

Further, in case of placing the auxiliary tray on one of the units, it is preferable to form a through hole for binding the sheets in the auxiliary tray. With the arrangement, the protruded sheets can be prevented from being lowered, the protruded part of the sheets through which the staple is driven is placed on the auxiliary tray in parallel to the sheet tray and the staple can be driven vertically through the sheets, so that the sheets can be securely bound.

The invention provides a stapling apparatus for stapling a plurality of sheets to form sheet bundles, comprising:

a sheet tray on which sheets are sequentially stacked and formed sheet bundles are placed;

a stapler disposed in a peripheral part of the sheet tray, for stapling a plurality of sheets stacked on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in the sheet stacking direction and a direction opposite to the sheet stacking direction;

bending side unit moving means for moving the bending side unit of the stapler both in the sheet stacking direction and the direction opposite to the sheet stacking direction; and movement controlling means for controlling the driving side unit moving means and the bending side unit moving means so that one of the driving side and bending side units which is on the sheet tray side is moved to a position in the sheet stacking direction, where the sheets placed on the sheet tray are to be bound, and either the driving side unit or the bending side unit of the stapler, which is on the sheet tray side of the sheets has a supporting face extending almost across the area of the sheets protruded from the sheet tray.

According to the invention, when a plurality of sheets are stacked on the sheet tray, one of the units, for example, the driving side unit is placed in the position where the sheets placed on the sheet tray are to be bound by the driving side unit moving means and the movement controlling means, and the other unit, for example, the bending side unit is moved by the bending side unit moving means and the movement controlling means to sandwich the sheets. At this moment, the almost whole area of the protruded sheets are placed on the supporting face of the driving side unit. After that, a staple is driven through the sheets and the sheets are bound up.

Since the one of the units has the supporting face extending almost across the area of the protruded sheets, the lowering of the protruded sheets can be prevented. The part of the protruded sheets through which the staple is driven is placed on the supporting face in parallel to the sheet tray, so that the staple can be driven perpendicularly to the sheets and the sheets can be securely bound. It is unnecessary to separately provide means for moving a component on which the protruded sheets are placed in the sheet stacking direction, so that the construction can be simplified.

In the invention it is preferable that the stapler has staple changing means for housing staples of different kinds and changing a staple according the thickness of a plurality of sheets.

According to the invention, when a plurality of sheets are stacked on the sheet tray, the stapler changes a staple in accordance with the thickness of sheets by the staple changing means. After that, the stapler is disposed in a position where the sheets are to be bound and the sheets are stapled.

Since the stapler changes the staple in accordance with the thickness of the plurality of sheets by the staple changing means, the sheets can be securely bound by an optimum staple corresponding to the thickness of the sheets, and the plurality of sheets having a thickness of a wide range can be securely bound.

When a plurality of sheet bundles each having the same number of sheets are formed, the thickness of the plurality of sheets of each sheet bundle is the same. Consequently, it is preferable to choose the staple of the same kind as that chosen for the first sheet bundle by the staple changing means for the second and subsequent sheet bundles. By the arrangement, it is unnecessary to operate the staple changing means for each sheet bundle and the processing speed of forming the sheet bundles can be increased.

In the invention it is preferable that the sheet tray comprises:

a sheet bundle contacting member which is disposed in a peripheral part of the sheet tray so as to face the stapler and with which a peripheral part of the sheet bundle can partly come into contact;

inclining means for inclining the sheet tray; and inclination controlling means for controlling an inclining operation of the inclining means so as to incline the sheet tray in the direction such that the sheet bundle approaches the sheet bundle contacting member after formation of the sheet bundle.

According to the invention, the sheet tray is inclined by the inclining means and the inclination controlling means, so that the first sheet bundle placed on the sheet tray is moved in the direction toward the sheet bundle contacting member and away from the stapler. The peripheral part of the first sheet bundle moved away from the stapler partly comes into contact with the sheet bundle contacting member. A plurality of sheets for the second sheet bundle are placed near to the stapler side so as to be deviated from the first sheet bundle moved away from the stapler. The stapler staples the sheets for the second sheet bundle, thereby forming the second sheet bundle. In a manner similar to the first sheet bundle, the sheet tray is inclined by the inclining means and the inclination controlling means so that the second sheet bundle is moved in the direction toward the sheet bundle contacting member and moved away from the stapler. Operations similar to those of the second sheet bundle are performed to the third and subsequent sheet bundles.

Since the sheet tray is inclined in the direction that the sheet bundle approaches the sheet bundle contacting member by the inclining means and the inclination controlling means, the sheet bundle can be moved away from the stapler. Consequently, the sheets of the second and subsequent sheet bundles are placed near to the stapler side so as to be deviated from the sheet bundle moved away from the stapler. The stapler can be therefore moved in the sheet stacking direction without interfering with the formed sheet bundle, so that a plurality of sheet bundles can be formed. Since the sheet tray is constructed by including the sheet bundle contacting member in its peripheral part, when the sheet tray is inclined, the sheet bundle moved away from the stapler comes into contact with the sheet bundle contacting member, thereby enabling the movement of the sheet bundle to be regulated in the sheet tray. Especially, in case of forming a plurality of sheet bundles, the plurality of sheet bundles are stacked, aligned, and placed on the sheet tray by the sheet bundle contacting member in a state where the plurality of sheet bundles are moved away from the stapler.

In the invention it is preferable that the sheet tray including a side plate which is disposed in a peripheral part of the sheet tray so as to face the stapler and with which a side face opposite to the stapler side of the sheet bundle can come into contact, and an end plate which is disposed in a peripheral part adjacent to the side plate of the sheet tray and with which an end face of the sheet bundle can come into contact comprises:

first inclining means for inclining the sheet tray in one direction that the sheet bundle is moved toward the side plate;

second inclining means for inclining the sheet tray in the other direction that the sheet bundle is moved toward the end plate; and inclination controlling means for controlling inclining operations of the first and second inclining means so that the operation of inclining the sheet tray in one direction and the operation of inclining the sheet tray in the other direction are alternately executed.

According to the invention, for example, the sheet tray is inclined in the other direction by the second inclining means and the inclination controlling means, the first sheet bundle placed on the sheet tray is moved in the direction toward the end plate and the end face of the first sheet bundle comes into contact with the end plate. The sheet tray is then inclined in the one direction by the first inclining means and the inclination controlling means, the first sheet bundle is moved in the direction toward the side plate in a state where the end face is in contact with the end plate and moved away from the stapler. The side face opposite to the stapler side of the first sheet bundle moved away from the stapler comes into contact with the side plate in a state where the end face is in contact with the end plate. The second sheet bundle of a plurality of sheets is placed near to the stapler side so as to be deviated from the first sheet bundle moved away from the stapler. The stapler staples the sheets for the second sheet bundle to thereby form the second sheet bundle. In a manner similar to the first sheet bundle, the sheet tray is inclined by the first and second inclining means and the inclination controlling means, and the second sheet bundle is moved away from the stapler. Operations similar to those for the second sheet bundle are performed for the third and subsequent sheet bundles.

Since the sheet tray is inclined alternately in one direction and the other direction by the first and second inclining means and the inclination controlling means, the sheet bundle can be moved away from the stapler. By the operation, the second and subsequent sheet bundles of plural sheets are placed near to the stapler side so as to be deviated from the sheet bundle moved away from the stapler. The stapler can therefore move in the sheet stacking direction without interfering with the formed sheet bundle and form a plurality of sheet bundles. Since the sheet tray is constructed by including the side plate and the end plate, when the sheet tray is inclined, the sheet bundle moved away from the stapler comes into contact with each of the side plate and the end plate, thereby enabling the movement of the sheet bundle to be regulated in the sheet tray. Especially, when a plurality of sheet bundles are formed, the plurality of sheet bundles can be stacked, aligned, and placed on the sheet tray by the side plate and the end plate in a state where the plurality of sheet bundles are away from the stapler.

In the invention it is preferable that the sheet tray including a sheet contacting member which is disposed in a peripheral part of the sheet tray and on the side where the stapler is disposed and with which a peripheral part of a stack of sheets to be bound can partly come into contact, comprises:

an auxiliary tray which is disposed in a peripheral part of the sheet tray and on which sheets and a sheet bundle protruded from the sheet tray are placed; and auxiliary tray moving means for moving the auxiliary tray in the sheet stacking direction, and the sheet tray and the auxiliary tray are arranged in a same position in the sheet stacking direction by the movement controlling means and the inclination controlling means, before stacking a plurality of sheets on the sheet tray, the auxiliary tray is moved to a same level in the sheet stacking direction as that of the uppermost sheet of the previous stack of sheets placed on the sheet tray, and when the sheets are placed on the sheet tray, operations of the auxiliary tray moving means and the inclining means are controlled so as to incline the sheet tray in a direction that the sheets approach the sheet contacting member.

According to the invention, before a plurality of sheets are stacked on the sheet tray, the auxiliary tray is moved to the same level as that of the uppermost sheet of the previous sheets placed on the sheet tray, by the auxiliary tray moving means and the movement controlling means. When the plurality of sheets are stacked on the sheet tray and the auxiliary tray, the sheet tray is inclined by the inclining means and the inclination controlling means, the sheets are moved toward the sheet contacting member, and a peripheral part of the sheets partly comes into contact with the sheet contacting member. After that, the sheets are stapled by a stapler, thereby forming a sheet bundle. The sheet tray is inclined and the sheet bundle is moved away from the stapler.

Before a plurality of sheets are stacked on the sheet tray, the auxiliary tray is moved to a same level as that of the uppermost sheet on the sheet tray by the auxiliary tray moving means and the movement controlling means. When the sheets are placed on the sheet tray, the sheet tray is inclined in the direction that the sheets are moved toward the sheet contacting member by the inclining means and the inclination controlling means. The sheets can be made in contact with the sheet contacting member and aligned in a state where the sheets protruded from the sheet tray are prevented from being lowered. Thus, a sheet bundle which are aligned can be formed.

According to the invention, it is preferable to incline the sheet tray by the inclining means and the inclination controlling means a plurality of times, for each sheet bundle. A peripheral part of the sheet bundle therefore partly comes into contact with the sheet tray more easily and the sheet bundles can be aligned more easily.

In the invention it is preferable that the sheet tray comprises:

a bottom plate on which sheets are sequentially stacked and formed sheet bundles are placed;

a first side plate which is integrally formed with the bottom plate and can comes into contact with a side face of the formed sheet bundle;

a second side plate which faces the first side plate and is provided fixedly with respect to the first side plate; and bottom plate driving means for reciprocating the bottom plate so that the first side plate is moved toward or apart from the second side plate, and when the sheet bundle is formed, the movement controlling means controls an operation of the bottom plate driving means so that the first side plate is moved together with the bottom plate toward the second side plate so as to dispose the first side plate in a position where an interval between the first and second side plates is almost equal to the length in the width direction of the sheet, and the first side plate is moved together with the bottom plate in the direction away from the second side plate so that the first side plate is disposed in the original position.

According to the invention, when the first sheet bundle is placed on the sheet tray, the first side plate is moved together with the bottom plate toward the second side plate by the bottom plate driving means and the movement controlling means so that the first side plate is disposed in a position where the interval between the first and second side plates is almost equal to the length in the width direction of the sheet bundle. The side face opposite to that on the stapler side of the first sheet bundle therefore comes into contact with the first side plate. The first side plate is then moved together with the bottom plate so as to be apart from the second side plate by the bottom plate driving means and the movement controlling means so that the first side plate is disposed in the original position. By the operation, the first sheet bundle is moved away from the stapler. The second sheet bundle of a plurality of sheets is disposed near to the stapler side so as to be deviated from the first sheet bundle moved away from the stapler. The stapler staples the sheets for the second sheet bundle, thereby forming the second sheet bundle.

In a manner similar to the first sheet bundle, by the bottom plate driving means and the movement controlling means, the first side plate is disposed in the position where the interval between the first and second side plates is almost equal to the length in the width direction of the sheet bundle. The first sheet bundle is consequently moved toward the stapler, the side face on the stapler side comes into contact with the second side plate and the side face opposite to that on the stapler side of the second sheet bundle comes into contact with the first side plate. In a manner similar to the first sheet bundle, the first side plate is disposed in the original position by the bottom plate driving means and the movement controlling means. The second sheet bundle is consequently moved away from the stapler in a state where the second sheet bundle is stacked on the first sheet bundle and the side face opposite to the stapler side of the sheet bundle is in contact with the first side plate. Operations similar to those for the second sheet bundle are performed to the third and subsequent sheet bundles.

Since the first side plate is moved together with the bottom plate in the direction toward the second side plate and the direction away from the second side plate by the bottom plate driving means and the movement controlling means, when the first side plate is moved in the direction toward the second side plate, the sheet bundle can be sandwiched from the sides by the first and second side plates and aligned in a state where the plurality of sheet bundles are stacked. When the first side plate is moved in the direction apart from the second side plate, the sheet bundle can be moved away from the stapler. The construction of the operations of aligning and moving the sheet bundles can be accordingly simplified. Since the second and subsequent sheet bundles of a plurality of sheets are placed near to the stapler side so as to be deviated from the sheet bundle moved away from the stapler, the stapler can move in the sheet stacking direction without interfering with the formed sheet bundle, securely bind a plurality of sheets, and form a plurality of sheet bundles.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
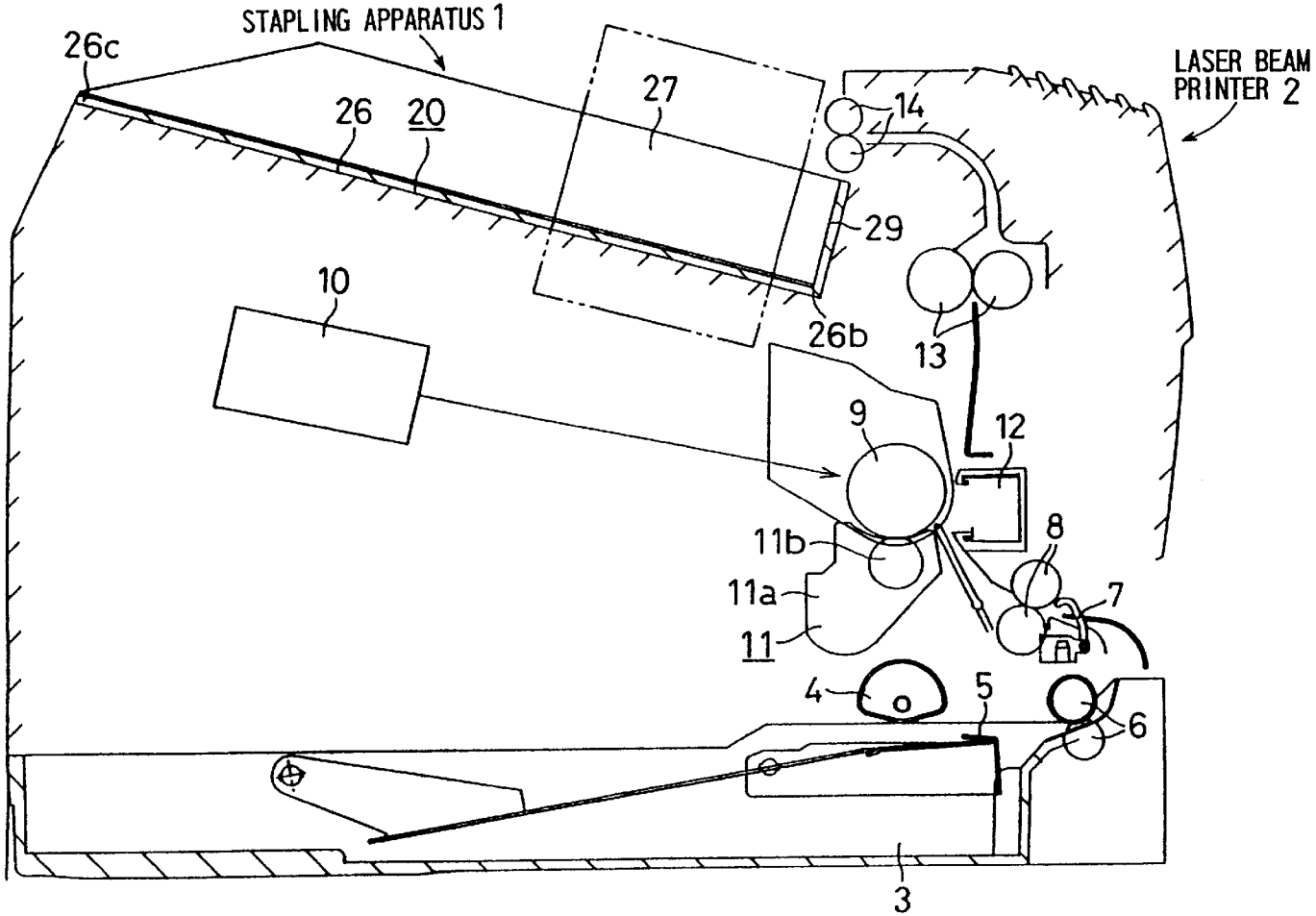
FIG. 1 is a simplified cross section showing the construction of a laser beam printer 2 having a stapling apparatus 1 as an embodiment of the invention.

Now referring to the drawings, preferred embodiments of the invention are described below.

FIG. 1 is a simplified cross section showing the construction of a laser beam printer 2 having a stapling apparatus 1 as an embodiment of the invention. The laser beam printer 2 comprises a sheet cassette 3, a sheet feeding roller 4, first transport rollers 6, a sheet passage sensor 7, second transport rollers 8, a photosensitive drum 9, a laser unit 10, a developing unit 11, a transfer unit 12, fixing rollers 13, and sheet ejecting rollers 14. In a sheet transport path between the sheet cassette 3 and the stapling apparatus 1, the sheet feeding roller 4, first transport rollers 6, sheet passage sensor 7, second transport rollers 8, photosensitive drum 9, transfer unit 12, fixing rollers 13, and sheet ejecting rollers 14 are interposed. A sheet is transported from the sheet cassette 3 to the stapling apparatus 1 via the sheet transport path.

The sheet cassette 3 is provided in the lower part of the laser beam printer 2 and has a nail 5 for separating sheets housed in the sheet cassette 3. The sheet feeding roller 4 is disposed above and near the sheet cassette 3. The first transport rollers 6 are provided downstream of the nail 5 in the sheet transport direction of the sheet transport path. The sheet passage sensor 7 is provided downstream of the first transport rollers 6 in the sheet transport direction of the sheet transport path and above the first transport rollers 6. The second transport rollers 8 are provided near and downstream of the sheet passage sensor 7 in the sheet transport direction of the sheet transport path.

The photosensitive drum 9 is provided downstream of the second transport rollers 8 in the sheet transport direction of the sheet transport path and upper than the second transport rollers 8. The laser unit 10 is provided upper than the sheet cassette 3 so as to face the photosensitive drum 9. The developing unit 11 is provided near and below the photosensitive drum 9 and allows toner stored in a tank 11*a* to be adhered onto the photosensitive drum 9 via a developing roller 11*b*. The transfer unit 12 is provided close to the photosensitive drum 9 on the side opposite to the laser unit 10 over the photosensitive drum 9. The fixing rollers 13 are disposed above and downstream of the photosensitive drum 9 in the sheet transport direction of the sheet transport path. The sheet ejecting rollers 14 are provided above and downstream of the fixing rollers 13 in the sheet transport direction of the sheet transport path. The stapling apparatus 1 is provided on and downstream of the laser beam printer 2 in the sheet transport direction of the sheet transport path.

The sheets stacked and housed in the sheet cassette 3 are transported by the sheet feeding roller 4, separated one by one by the nail 5 of the sheet cassette 3, and led to the first transport rollers 6. The sheet transported by the first transport rollers 6 is timed to the start of printing by the sheet passage sensor 7 and led to the photosensitive drum 9 by the second transport rollers 8.

A toner image is formed by the laser unit 10 and the developing unit 11 on the photosensitive drum 9. The toner image formed on the photosensitive drum 9 is transferred onto the sheet led between the photosensitive drum 9 and the transfer unit 12 by the transfer unit 12. The sheet on which the toner image is transferred is heated and pressurized by the fixing rollers 13 to be fixed on the sheet. The sheet on which the toner image is fixed is ejected to the stapling apparatus 1 by the sheet ejecting rollers 14 with the image formed surface facing downward. In such a manner, the laser beam printer 2 sequentially ejects the printed sheets to the stapling apparatus 1.

Figure 2:
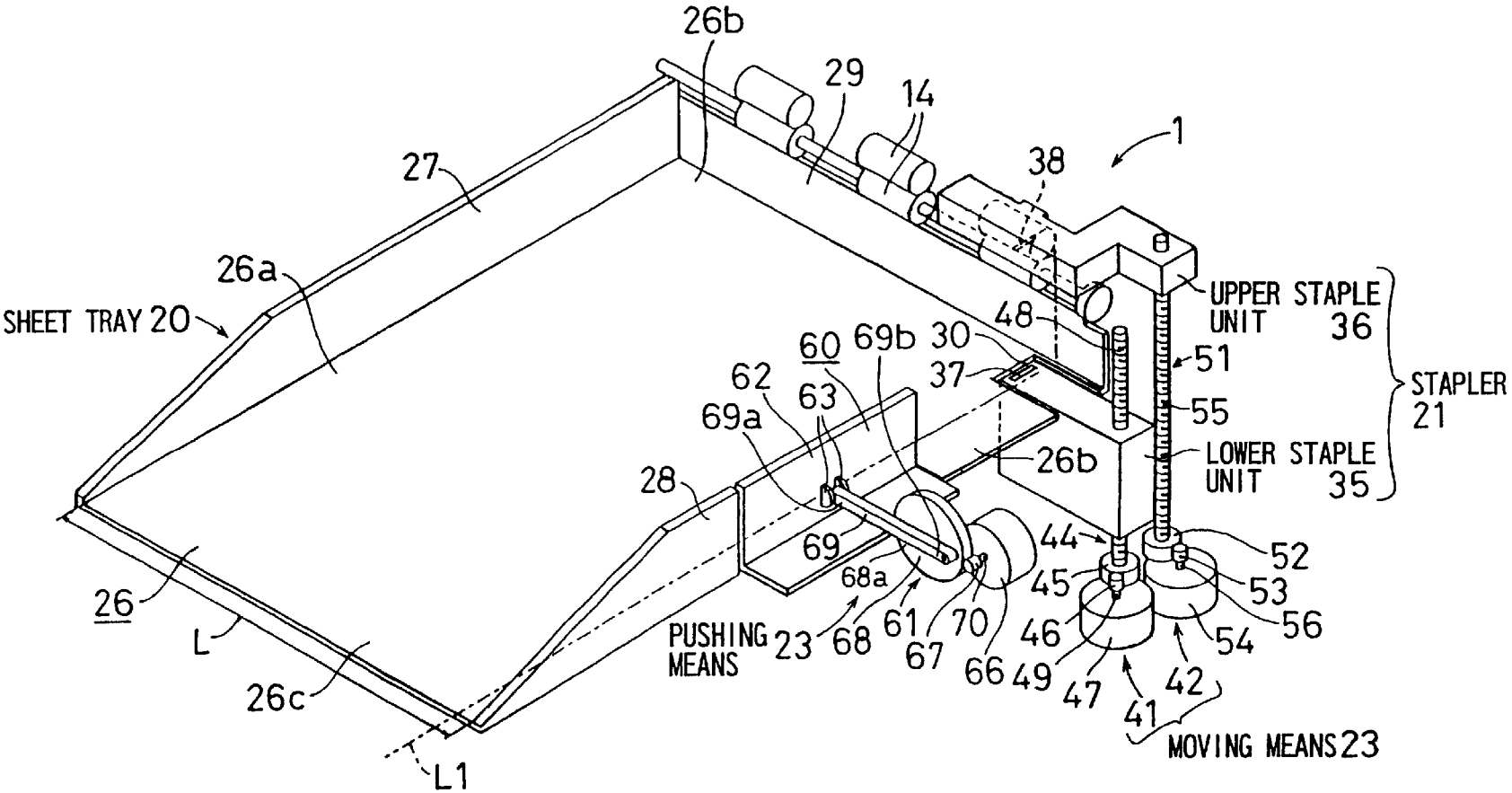
FIG. 2 is a simplified perspective view showing the construction of the stapling apparatus 1 as an embodiment of the invention.

FIG. 2 is a simplified perspective view showing the construction of the stapling apparatus 1 as an embodiment of the invention. The stapling apparatus 1 staples a plurality of sheets to form a sheet bundle and comprises a sheet tray 20, a stapler 21, moving means 22, and pushing means 23. On the sheet tray 20, the sheets ejected from the laser beam printer 2 are sequentially stacked and formed sheet bundles are placed. The stapler 21 is disposed in a peripheral part of the sheet tray 20 and staples a plurality of sheets placed on the sheet tray 20. The moving means 22 moves the stapler 21 upward, namely, in the sheet stacking direction. The pushing means 23 is arranged in the peripheral part of the sheet tray 20 and pushes against a side face of the formed sheet bundle so as to move the sheet bundle away from the stapler 21.

More specifically, the sheet tray 20 comprises a bottom plate 26, a first side plate 27, a second side plate 28, and an end plate 29. The bottom plate 26 is formed in an almost rectangle shape having the long side in the sheet ejecting direction. On the bottom plate 26, sheets are sequentially stacked and placed and the formed sheet bundle is also placed. The first side plate 27 is vertically provided at one end 26*a* in the width direction perpendicular to the longitudinal direction of the bottom plate 26. The first side plate 27 extends from an end 26*b* upstream in the sheet ejecting direction as an end in the longitudinal direction of the bottom plate 26 to an end 26*c* downstream in the sheet ejecting direction as the other end in the longitudinal direction.

The second side plate 28 is vertically provided at the other end 26*d* in the width direction perpendicular to the longitudinal direction of the bottom plate 26. The second side plate 28 extends from the end 26*c* downstream in the sheet ejecting direction of the bottom plate 26 to an intermediate part between the end 26*b* upstream in the sheet ejecting direction of the bottom plate 26 and the end 26*c* on the downstream side. The end plate 29 is vertically provided at the end 26*b* upstream in the sheet ejecting direction of the bottom plate 26 and extends from one end 26*a* in the width direction of the bottom plate 26 to the other end 26*d* in the width direction. In the bottom plate 26, a notch 30 notched toward the one end 26*a* in the width direction is provided at the corner between the other end 26*d* in the width direction and the end 26*b* upstream in the sheet ejecting direction.

The stapler 21 is comprised of a lower staple unit 35 and an upper staple unit 36. The lower staple unit 35 is a driving side unit which is provided on the sheet tray 20 side of the sheets, houses a plurality of staples of the single kind and has a driving part 37 for driving a staple from the undermost sheet-surface side of the sheets. The upper staple unit 36 is a bending side unit which is provided on the side opposite to the sheet tray 20 side of the sheets, separately from the lower staple unit 35, and has a bending part 38 for bending the tips of the driven staple which protrude from the uppermost sheet-surface of the stack of sheets.

The lower staple unit 35 is disposed at the periphery of the sheet tray 20 so as to enter the notch 30 in the bottom plate 26. The upper staple unit 36 is disposed at the periphery of the sheet tray 20 so as to face the lower staple unit 35 from the above. The bending part 38 of the upper staple unit 36 is provided so as to face the driving part 37 of the lower staple unit 35.

The moving means 22 comprises a lower staple unit moving means 41 and an upper staple unit moving means 42. The lower staple unit moving means 41 moves the lower staple unit 35 upward, namely, in the sheet stacking direction and downward, that is, in the opposite direction. The lower staple unit moving means 41 includes, for example, a first ball screw 44, a first toothed wheel 45, a first pinion 46, and a first motor 47. The first ball screw 44 extends in the direction perpendicular to the sheet tray 20 and comprises a first screw shaft 48 in which a male screw is formed, a nut (not shown) in which a female screw is formed and which screws on the first screw shaft 48 and is housed in the lower staple unit 35, and a steel ball which is housed in the nut, interposed between the male and female screws, and circulates in the nut. The first toothed wheel 45 is integrally provided with the lower end of the first screw shaft 48. The first pinion 46 is provided at the tip of a rotary shaft 49 of the first motor 47 such as a stepping motor and meshes with the first toothed wheel 45.

The upper staple unit moving means 42 moves the upper staple unit 36 upward and downward and has, for example, a second ball screw 51, a second toothed wheel 52, a second pinion 53, and a second motor 54. The second ball screw 51 extends in the direction perpendicular to the sheet tray 20 and comprises a second screw shaft 55 in which a male screw is formed, a nut (not shown) in which a female screw is formed and which screws on the second screw shaft 55 and is housed in the upper staple unit 36, and a steel ball which is housed in the nut, interposed between the male and female screws, and circulates in the nut. The second toothed wheel 52 is integrally provided with the lower end of the second screw shaft 55. The second pinion 53 is provided at the tip of a rotary shaft 56 of the second motor 54 such as a stepping motor and meshes with the second toothed wheel 52.

The first motor 47 rotates the first screw shaft 48 via the rotary shaft 49, the first pinion 46, and the first toothed wheel 45. When the first screw shaft 48 is rotated in a state where the angular displacement around the axial line of the first screw shaft 48 in the lower staple unit 35 is restrained, the lower staple unit 35 is vertically moved along the axial line of the first screw shaft 48.

The second motor 54 rotates the second screw shaft 49 via the rotary shaft 56, the second pinion 53, and the second toothed wheel 52. When the second screw shaft 55 is rotated in a state where the angular displacement around the axial line of the second screw shaft 49 in the upper staple unit 36 is restrained, the upper staple unit 36 is vertically moved along the axial line of the second screw shaft 55.

When the first motor 47 is normally rotated, the lower staple unit 35 is moved upward. When the first motor 47 is rotated reversely, the lower staple unit 35 is moved downward.

When the second motor 54 is normally rotated, the upper staple unit 36 is moved downward. When the second motor 54 is rotated reversely, the upper staple unit 36 is moved upward.

The pitch of the male screw of the first screw shaft 48 is set to be equal to that of the male screw of the second screw shaft 55.

The pushing means 23 is disposed at the periphery of the sheet tray 20 and upstream of the second side plate 28 in the sheet ejecting direction and includes a pusher 60 and a pusher driving means 61. The pusher 60 has a risen part 62 facing the first side plate 27. On the other surface of the risen part 62 opposite to the surface facing the first side plate 27, a pair of brackets 63 are provided protrudently.

The pusher driving means 61 reciprocates the pusher 60 in the direction toward the first side plate 27 and the direction away from the first side plate 27. More specifically, the pusher driving means 61 includes a third motor 66, a third pinion 67, a third toothed wheel 68, and a coupling rod 69. The third pinion 67 is provided at the tip of the rotary shaft 70 of the third motor 66. The third toothed wheel 68 meshes with the third pinion 67. An end 69*a* in the longitudinal direction of the coupling rod 69 is connected to the pair of brackets 68 by a pin and the other end 69*b* in the longitudinal direction is connected to the periphery of a side face 68*a* perpendicular to the rotation axis of the third toothed wheel 68 by a pin.

The third motor 66 rotates the third toothed wheel 68 via the rotary shaft 70 and the third pinion 67. When one rotation of the third toothed wheel 68 is made, the pusher 60 is driven to reciprocate with a predetermined stroke via the coupling rod 69.

The lower staple unit 35 is disposed in the reference position so that its top face is flush with the placement face of the bottom plate 26 in the sheet tray 20. The upper staple unit 36 is disposed in a predetermined reference position above the lower staple unit 35 and the sheet ejecting rollers 14. The risen part 62 of the pusher 60 is arranged in the reference position so that its surface facing the first side plate 27 is flush with the surface facing the first side plate 27 of the second side plate 28. A distance L between the first side plate 27 and the second side plate 28 is set to be almost equal to the sum of the length in the width direction of a sheet and the stroke of the pusher 60. In the embodiment, the sheet is ejected from the laser beam printer 2 in such a manner that the side face on the stapler 21 side of the sheets travels along a sheet reference line L1 which extends along the surface facing the first side plate 27 of the second side plate 28. That is, the sheet ejected from the laser beam printer 2 is placed on the sheet tray 20 so that a part of the sheet facing the notch 30 in the bottom plate 26 is protruded from the sheet tray 20.

Figure 3:
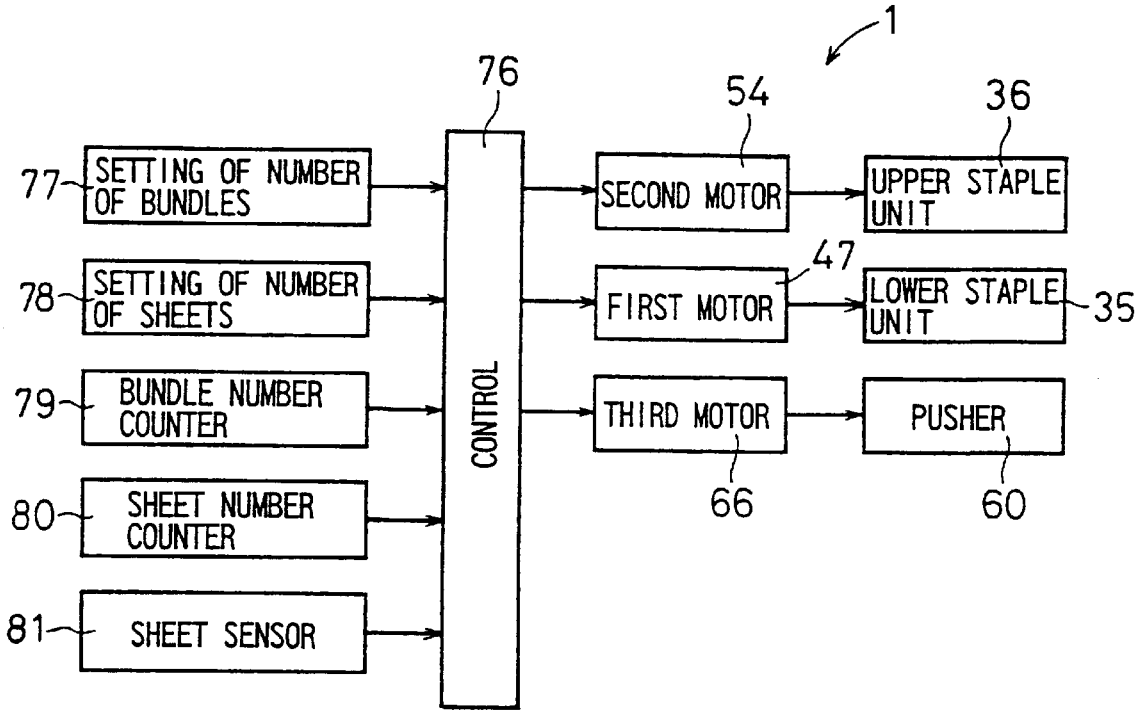
FIG. 3 is a simplified block diagram showing the electric configuration of the stapling apparatus 1.

FIG. 3 is a simplified block diagram showing the electric configuration of the stapling apparatus 1. The operation of the stapling apparatus 1 is controlled by a control circuit 76, a unit 77 for setting the number of sheet bundles (hereinbelow, referred to as a sheet bundle number setting unit), a unit 78 for setting the number of sheets (hereinbelow, referred to as a sheet number setting unit), a counter 79 of the number of sheet bundles (hereinbelow, referred to as a sheet bundle number counter), a counter 80 of the number of sheets (hereinbelow, referred to as a sheet number counter), and a sheet sensor 81. The control circuit 76 is realized by, for example, a central processing unit (CPU). The control circuit 76 the has function of movement controlling means for controlling the operation of the upper and lower staple unit moving means 42 and 41 so as to arrange the upper and lower staple units 36 and 35 in positions where a plurality of sheets placed on the sheet tray 20 are sandwiched and the function of means for controlling the operation of the pusher driving means 61 so as to reciprocate the pusher 60. In the sheet bundle number setting unit 77, the number (m) of sheet bundles to be formed is set. In the sheet number setting unit 78, the number (n) of sheets per sheet bundle is set. The sheet bundle number counter 79 counts the number of sheet bundles formed. The sheet number counter 80 counts the number of sheets ejected from the laser beam printer 2. The sheet sensor 81 senses that the sheet ejected from the laser beam printer 2 is placed on the sheet tray 20.

To the control circuit 76, output signals from the sheet bundle number setting unit 77, sheet number setting unit 78, sheet bundle number counter 79, sheet number counter 80, and sheet sensor 81 are supplied. Control signals outputted from the control circuit 76 control the operation of the first motor 47 of the lower staple unit moving means 41, the second motor 54 of the upper staple unit moving means 42, and the third motor 66 of the pusher driving means 61, instruct the lower staple unit 35 to perform the staple driving operation, and drive the sheet bundle number counter 79 and the sheet number counter 80.

Figure 4:
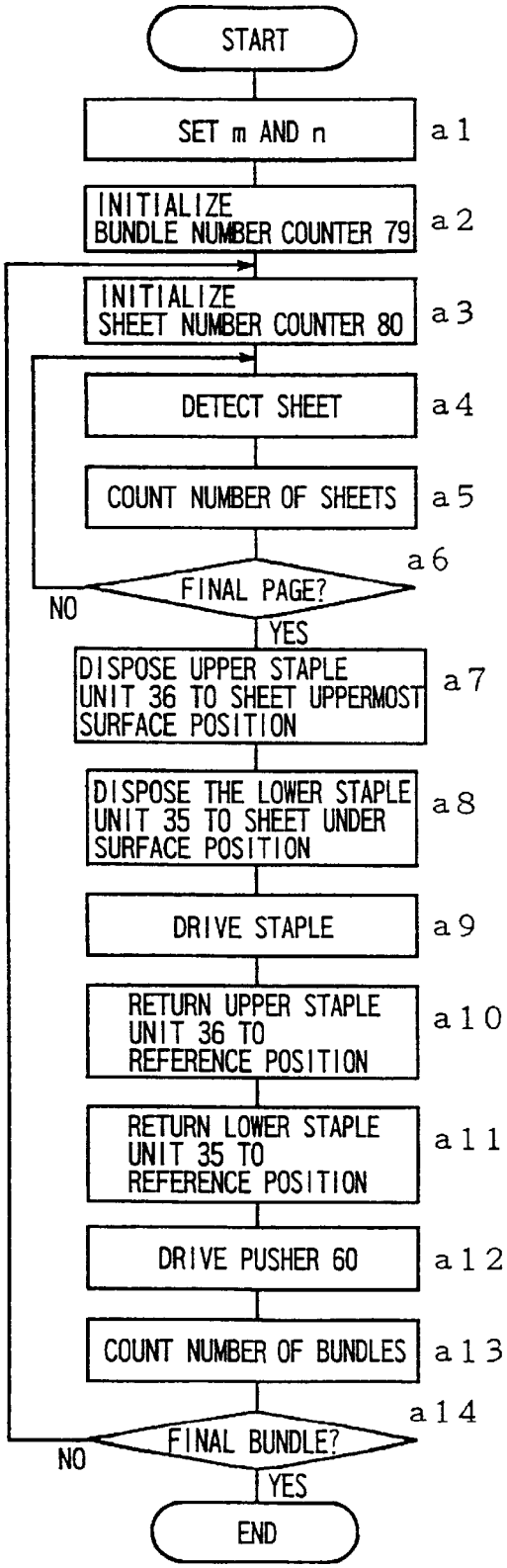
FIG. 4 is a flowchart for explaining the operation of the stapling apparatus 1.
Figure 5:
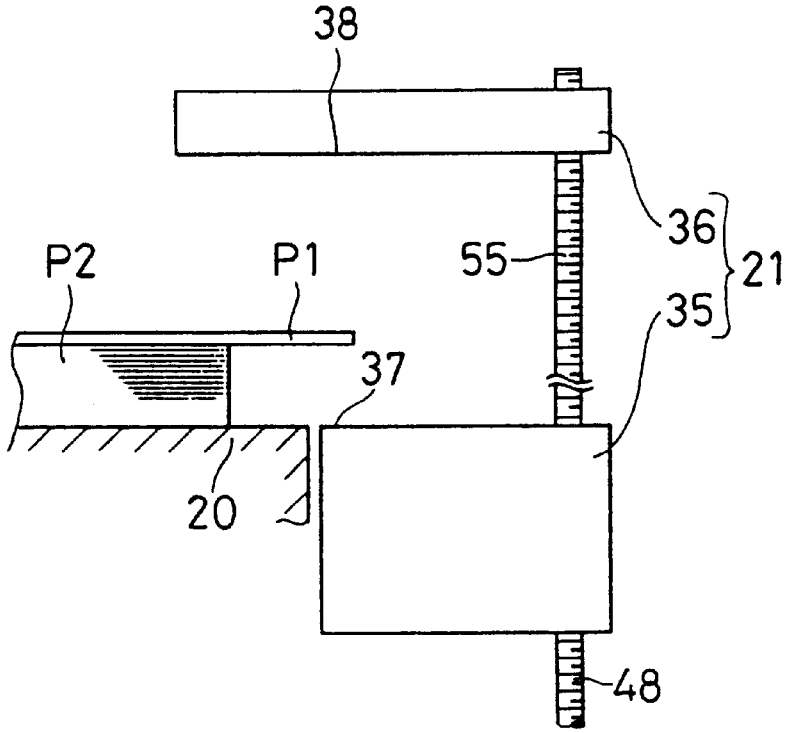
FIG. 5 is a diagram showing a state in which upper and lower staple units 36 and 35 are arranged in their reference positions.
Figure 6:
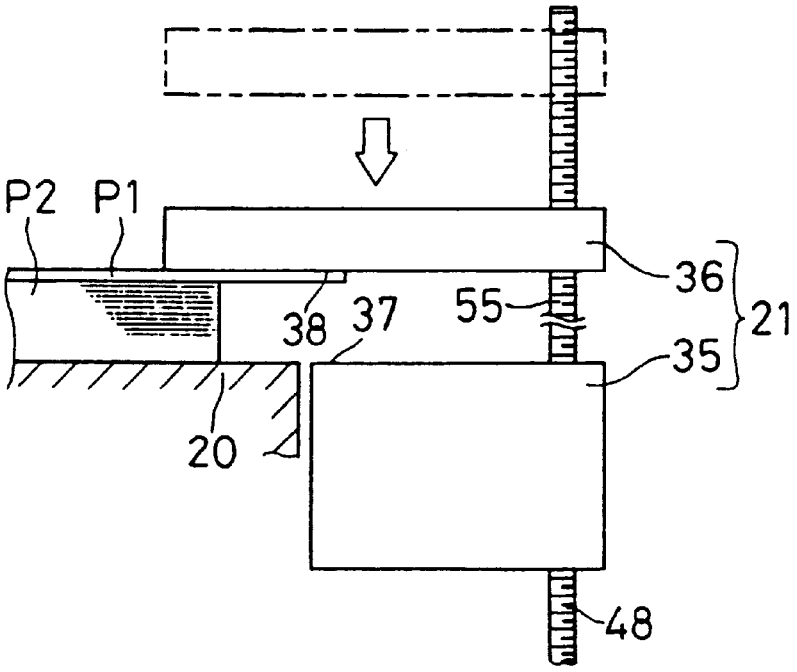
FIG. 6 is a diagram showing a state where the upper staple unit 36 is moved.
Figure 7:
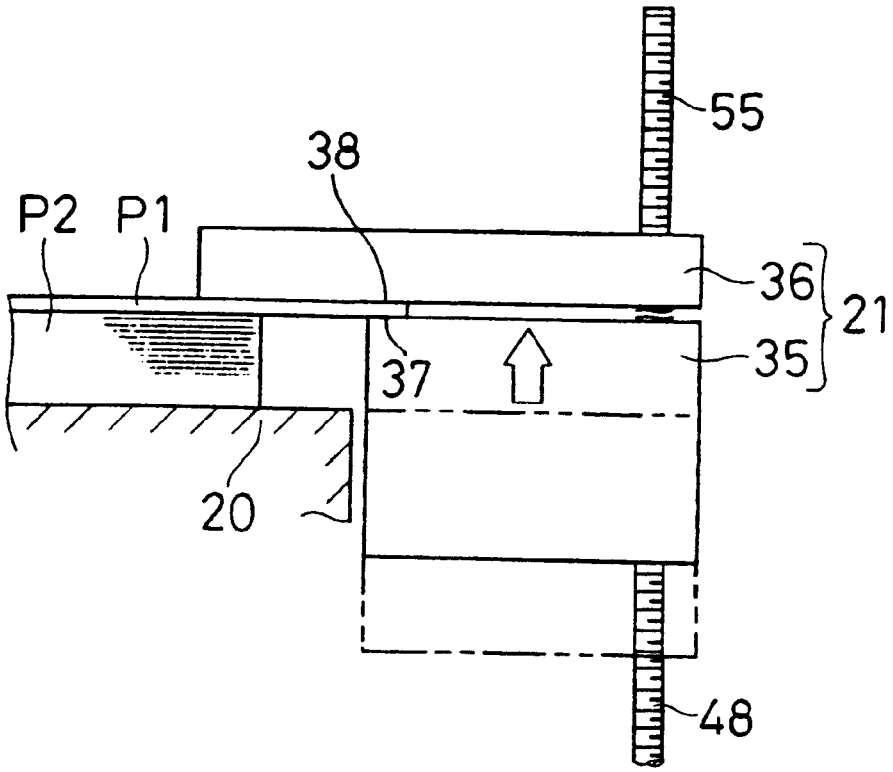
FIG. 7 is a diagram showing a state where the lower staple unit 35 is moved.
Figure 8:
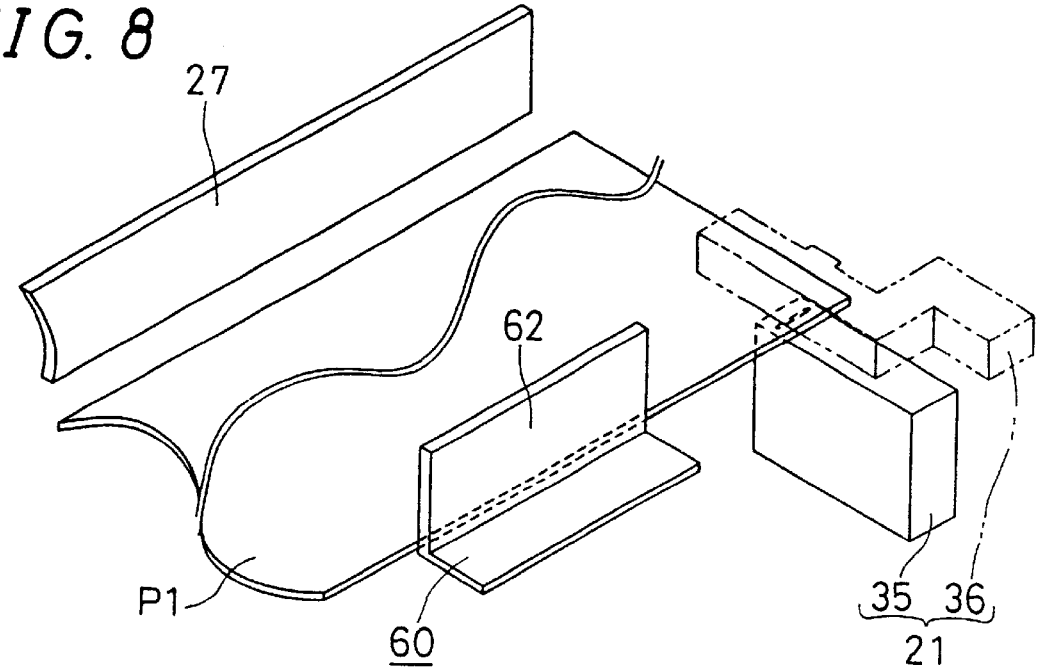
FIG. 8 is a view showing a state of a sheet tray 20 in which (n) sheets p1 for a first sheet bundle ejected from the laser beam printer2 are stacked thereon.
Figure 9:
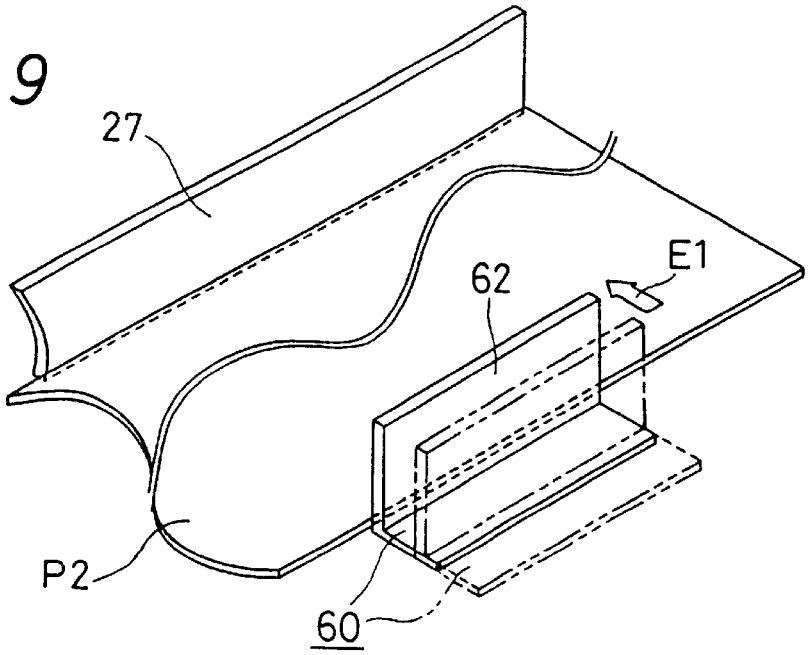
FIG. 9 is a diagram showing a state in which the first sheet bundle P2 is pushed by a pusher 60.
Figure 10:
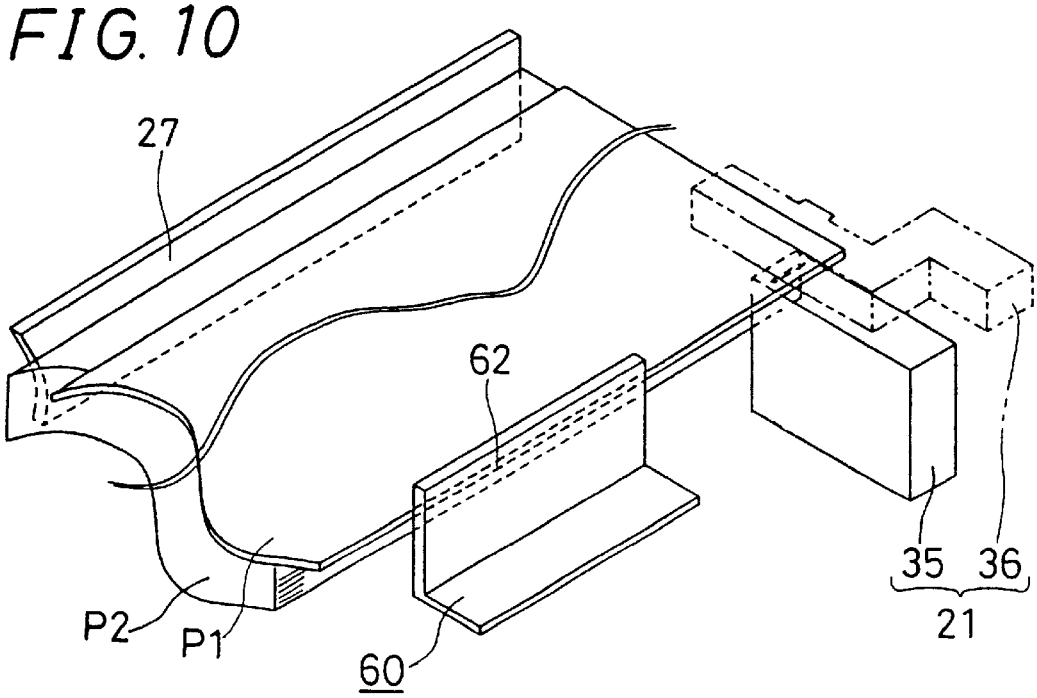
FIG. 10 is a view showing a state of a sheet tray 20 in which (n) sheets pl for a (k)th sheet bundle, ejected from the laser beam printer2 are stacked thereon.
Figure 11:
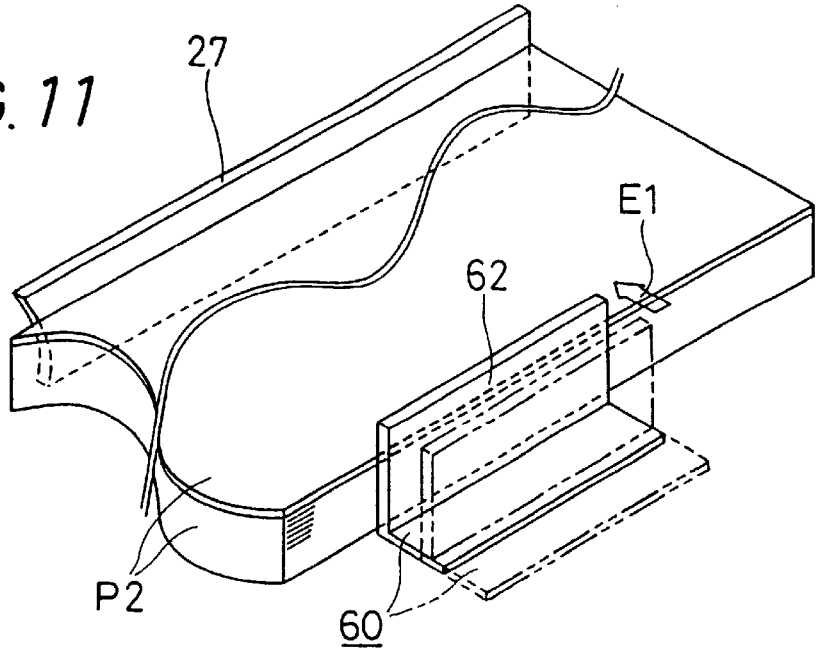
FIG. 11 is a diagram showing a state in which the (k)th sheet bundle P2 is pushed by the pusher 60.

FIG. 4 is a flowchart for explaining the operation of the stapling apparatus 1. FIG. 5 is a diagram showing a state where the upper and lower staple units 36 and 35 are disposed in their reference positions. FIG. 6 is a diagram showing a state where the upper staple unit 36 is moved. FIG. 7 is a diagram showing a state where the lower staple unit 35 is moved. FIG. 8 is a perspective view showing a state in which (n) sheets P1 for a first sheet bundle, ejected from the laser beam printer are stacked. FIG. 9 is a perspective view showing a state in which the first sheet bundle P2 is pushed by the pusher 60. FIG. 10 is a perspective view showing a state in which (n) sheets P1 for a (k) th sheet bundle are stacked. FIG. 11 is a perspective view showing a state in which the (k) th sheet bundle P2 is pushed by the pusher 60.

Referring to FIG. 4, the procedure of forming the first sheet bundle P2 will be described. The upper and lower staple units 36 and 35 are arranged in their reference positions shown in FIG. 5. At step a1, the number (m) of sheet bundles is set in the sheet bundle number setting unit 77 and the number (n) of sheets is set in the sheet number setting unit 78. The routine advances from step a1 to step a2 where the sheet bundle number counter 79 is initialized. The routine advances from step a2 to step a3 where the sheet number counter 80 is initialized. The routine progresses from step a3 to step a4. At step a4, one sheet of paper is ejected from the laser beam printer 2 and the sheet sensor 81 senses that the sheet is placed on the sheet tray 20. The routine advances from step a4 to step a5 where the number of sheets placed on the sheet tray 20 is counted by the sheet number counter 80. By the operation, the count number of the sheet number counter 80 is incremented by "1". In case of the first sheet, the count number becomes "1".

The routine advances from step a5 to step a6. At step a6, whether the number (n) of sheets set in the sheet number setting unit 78 and the count number of the sheet number counter 80 coincide with each other or not is determined by the control circuit 76 and whether the sheet ejected at step a4 is the last one of the (n) sheets P1 or not is determined. That is, the control circuit 76 determines that the sheet ejected at step a4 is the last sheet when the set number (n) of sheets coincides with the count number and determines that the sheet ejected at step a4 is not the last sheet when the set number (n) of sheets does not coincide with the count number. When the sheet ejected at step a4 is not the last one of the (n) sheets, the routine is returned to step a4 and the ejection of sheets is continued. If it is the last sheet, the sheet ejection is stopped and the routine advances to step a7.

At step a7, the upper staple unit 36 is disposed in the position of the uppermost sheet-surface of the stack of (n) sheets P1 for the first sheet bundle P2. Specifically, the control circuit 76 drives the second motor 54 of the upper staple unit moving means 42 so that the upper staple unit 36 is disposed in the position on the uppermost sheet-surface of the stack of sheets P1 for the first sheet bundle P2, thereby moving the upper staple unit 36 downward from its reference position. The routine advances from step a7 to step a8 where the lower staple unit 35 is disposed in the position of the undermost sheet-surface of the stack of sheets P1 for the first sheet bundle P2. In the process for the first sheet bundle, the lower staple unit 35 is disposed in its reference position and the stack of sheets P1 for the first sheet bundle P2 is placed on the sheet tray 20 in a state where the sheet bundle is in contact with the lower staple unit 35. Consequently, the lower staple unit 35 is already disposed in the position of the undermost sheet-surface of the stack of sheets P1 for the first sheet bundle P2, so that the first motor 47 of the lower staple unit moving means 41 is not driven. At steps a7 and a8, the stack of sheets for the first sheet bundle P2 is sandwiched by the upper and lower staple units 36 and 35 and air layers interposing between the sheets are eliminated. The stack of sheets P1 can be therefore firmly bound up.

The routine advances from step a8 to step a9 where the lower staple unit 35 is driven so as to drive a staple through the stack of sheets P1 for the first sheet bundle P2. The staple driven from the driving part 37 of the lower staple unit 35 into the stack of sheets P1 penetrates the sheets P1 in the thickness direction and protrudes from the uppermost sheet-surface of the stack of sheets P1. The protruded ends are bent by the bending part 38 of the upper staple unit 36. In such a manner, the first sheet bundle P2 is formed.

The routine shifts from step a9 to step a10 where the upper staple unit 36 is returned to its reference position. More specifically, the control circuit 76 reversely rotates the second motor 54 of the upper staple unit moving means 42 to move the upper staple unit 36 upward to its reference position so that the upper staple unit 36 is returned to its reference position. The routine advances from step a10 to step a11 where the lower staple unit 35 is returned to its reference position. Since the lower staple unit 35 is already arranged in its reference position at the time of the first sheet bundle, the first motor 47 of the lower staple unit moving means 41 is not driven. As mentioned above, the upper and lower staple units 36 and 35 are returned to their reference positions shown in FIG. 5 at steps a10 and a11.

The routine advances from step a11 to step a12 where the pusher 60 is reciprocated from its reference position as shown in FIG. 9. Specifically, the control circuit 76 drives the third motor 66 so that one rotation of the third toothed wheel 68 of the pusher driving means 61 is made. By such an operation, the side face on the stapler 21 side of the first sheet bundle P2 is pushed with the risen part 62 of the pusher 60 and the first sheet bundle P2 is moved in the direction E1 toward the first side plate 27 and away from the stapler 21. Since the distance L between the first and second side plates 27 and 28 is almost equal to the sum of the length in the width direction of the sheet and the stroke of the pusher 60, the side face opposite to the above-mentioned side face of the first sheet bundle P2 comes into contact with the first side plate 27. The routine shifts from step a12 to step a13 where the number of sheet bundles P2 is counted by the sheet bundle number counter 79. The count value of the sheet bundle number counter 79 is incremented by "1". The count value is "1" for the first sheet bundle.

The routine advances from step a13 to a14. At step a14, whether the number (m) of sheet bundles set in the sheet bundle number setting unit 77 coincides with the count value of the sheet bundle number counter 79 or not is determined and whether the sheet bundle P2 formed by the series of operations is the last sheet bundle or not is decided by the control circuit 76. Specifically, the control circuit 76 determines that the formed sheet bundle P2 is the last one when the set number (m) of sheet bundles coincides with the count value and that the formed sheet bundle P2 is not the last one when the set number (m) of sheet bundles does not coincide with the count value. When the sheet bundle P2 is not the final one, the routine is returned to step a3. When the sheet bundle P2 is the final one, the operation is finished. Since the above-mentioned sheet bundle P2 formed by the series of operations is the first one, the routine is consequently returned to step a3. In such a manner, the first sheet bundle is formed.

The procedure of forming the (k)th sheet bundle P2 ($2 \leqq k \leqq m$) will now be described. The routine is returned from step a14 to a3 where the sheet number counter 80 is initialized. The routine shifts from step a3 to a6 via steps a4 and a5. (n) sheets of paper ejected from the laser beam printer 2 are placed on the (k−1)th sheet bundle P2 which are stacked on the sheet tray 20. As shown in FIG. 10, the (n) sheets are placed on the stapler 21 side so as to be deviated from the (k−1)th sheet bundle P2. The routine shifts from step a6 to step a7 where the upper staple unit 36 is arranged in the position of the uppermost sheet-surface of the stack of sheets P1 for the (k)th sheet bundle P2 as shown in FIG. 6. To be more specific, the control circuit 76 drives the second motor 54 of the upper staple unit moving means 42 to downwardly move the upper staple unit 36 from its reference position so that the upper staple unit 36 is disposed in a position higher than the position of the uppermost sheet-surface of the (k−1)th sheet bundle P2 and in the position of the uppermost sheet-surface of the stack of sheets P1 for the (k)th sheet bundle P2.

The routine shifts from step a7 to step a8 where the lower staple unit 35 is disposed in the position of the undermost sheet-surface of the stack of sheets P1 for the (k)th sheet bundle P2 as shown in FIG. 7. More specifically, the control circuit 76 drives the first motor 47 of the lower staple unit moving means 41 to upwardly move the lower staple unit 35 from its reference position so that the lower staple unit 35 is disposed in a position higher than the position of the under surface of the (k−1)th sheet bundle P2 and in the position of the undermost sheet-surface of the stack of sheets P1 for the (k)th sheet bundle P2. At steps a7 and a8, the stack of sheets for the (k)th sheet bundle P2 is sandwiched by the upper and lower staple units 36 and 35 and air layers interposed between sheets are eliminated. Consequently, the stack of sheets P1 for the (k)th sheet bundle P2 can be firmly bound up.

The routine shifts from step a8 to step a9 where the lower staple unit 35 is driven so that the staple is driven into the stack of sheets P1 for the (k) th sheet bundle P2. In this manner, the (k) th sheet bundle P2 is formed. The routine advances from step a9 to step a10 where the upper staple unit 36 is returned to its reference position. The routine moves from step a10 to step a11 where the lower staple unit 35 is returned to its reference position. Specifically, the control circuit 76 reversely rotates the first motor 47 of the lower staple unit moving means 41 to downwardly move the lower staple unite 35 to its reference position so that the lower staple unit 35 is returned to its reference position. As described above, at steps a10 and a11, the upper and lower staple units 36 and 35 are returned to their reference positions shown in FIG. 5.

The routine advances from step a11 to a12 where the pusher 60 is reciprocated from its reference position as shown in FIG. 11. Consequently, the side face on the stapler 21 side of the (k)th sheet bundle P2 is pushed with the risen part 62 of the pusher 60 and the sheet bundle P2 is moved in the direction E1 toward the first side plate 27 and away from the stapler 21. Since the distance L is almost equal to the sum of the length in the width direction of the sheet and the stroke of the pusher 60, the side face opposite to the above-mentioned side face of the (k) th sheet bundle P2 comes into contact with the first side plate 27. In such a manner, sheets for the first to (k) th sheet bundles P2 are stacked, aligned, and placed on the sheet tray 20. The routine shifts from step a12 to a13 where the number of sheet bundles P2 is counted by the sheet bundle number counter 79. The count value (k−1) of the sheet bundle number counter 79 until then is incremented by "1". The count value becomes "k" for the (k)th sheet bundle.

The routine advances from step a13 to step a14. At step a14, whether the set number (m) of sheet bundles of the sheet bundle number setting unit 77 coincides with the count value of the sheet bundle number counter 79 or not is determined and whether the (k)th sheet bundle P2 formed by the series of operations is the last sheet bundle or not is decided by the control circuit 76. When the (k)th sheet bundle P2 is not the final one, the routine is returned to step a3 and the operations from step a3 to step a14 are repeated until the last sheet bundle. When the sheet bundle P2 is the final one, the operation is finished. In such a manner, the formation of a plurality of sheet bundles P2 can be automatized.

Since the stapler 21 moves upward and is disposed in the position of the (n) sheets P1 as described above, the sheets P1 can be bound up to form the sheet bundle P2 in the position of the sheets P1 of each sheet bundle which moves upward each time the sheet bundle P2 is formed. Since the sheet bundle P2 is formed on the sheet tray 20, unlike the construction of a conventional technique that the sheet bundle P2 formed in the printing apparatus is placed on the sheet tray, an inconvenience such that the formed sheet bundle P2 is jammed in the printing apparatus before it is placed on the sheet tray does not occur. Thus, the reliability of the sheet bundle formation can be improved.

Since the pushing means 23 pushes against the side face of the formed sheet bundle P2 with the risen part 62 of the pusher 60 so as to move the sheet bundle P2 away from the stapler 21, stacks of sheets P1 for the second and subsequent sheet bundles P2 are placed near to the stapler 21 side so as to be deviated from the sheet bundle P2 which is moved away from the stapler 21. The stapler 21 can therefore move upward without interfering with the formed sheet bundle P2, securely staple the sheets P1, and form a plurality of sheet bundles P2.

Further, as shown in FIG. 1, when the sheet tray 20 is installed inclinedly so that the end 26*b* upstream in the sheet ejecting direction of the bottom plate 26 is lower than the end 26*c* downstream in the sheet ejecting direction of the bottom plate 26, the end face on the upstream side in the sheet ejecting direction of the sheets P1 placed on the sheet tray 20 comes into contact with the end plate 29 and the sheets P1 are aligned. Consequently, the aligned sheets P1 are stapled by the stapler 21 and the sheet bundle P2 with the sheets aligned can be formed. Since the sheet bundle P2 is moved away from the stapler 21 by the risen part 62 of the pusher 60 in a state where the end face on the upstream side of the sheet ejecting direction of the sheet bundle P2 is in contact with the end plate 29, the sheet bundle P2 is aligned by both the first side plate 27 and the end plate 29 and can be stacked on the sheet tray 20 in such a state.

Although the stapling apparatus 1 is provided with the sheet bundle number setting unit 77, the sheet number setting unit 78, sheet bundle number counter 79, sheet number counter 80, and the sheet sensor 81 to thereby automatize the formation of the sheet bundle P2 in the embodiment, instead, a start switch for manually starting the operation of forming the sheet bundle P2 may be provided. In this case, the stapling apparatus performs the processes of the flowchart shown in FIG. 4 except for the steps a1 to a5 and steps a13 and a14. At step a6, a sheet is ejected from the laser beam printer 2 onto the sheet tray 20 and whether the start switch is ON or not is determined by the control circuit 76. Specifically, the control circuit 76 allows the ejection of sheets to be continued when the start switch is OFF and allows the ejection of sheets to be stopped when the start switch is ON. After the start switch enters the ON state, the processes from step a7 to step a12 in FIG. 4 are performed, thereby forming the sheet bundle P2. The sheet bundle P2 is pushed away from the stapler 21 by the pusher 60. By repeating the series of operations, a plurality of sheet bundles P2 can be formed.

Although the control circuit 76 makes the lower staple unit 35 return to its reference position each time the staple driving operation is executed in the embodiment, instead, the lower staple unit 35 may remain in the position on the under surface of the formed sheet bundle P2 after the staple driving operation and return to the reference position after the final sheet bundle is formed. By the operations as mentioned above, the processing speed in the formation of a plurality of sheet bundles P2 can be increased more as compared with the case where the staple unit 35 is returned to its reference position every staple driving operation.

Figure 12:
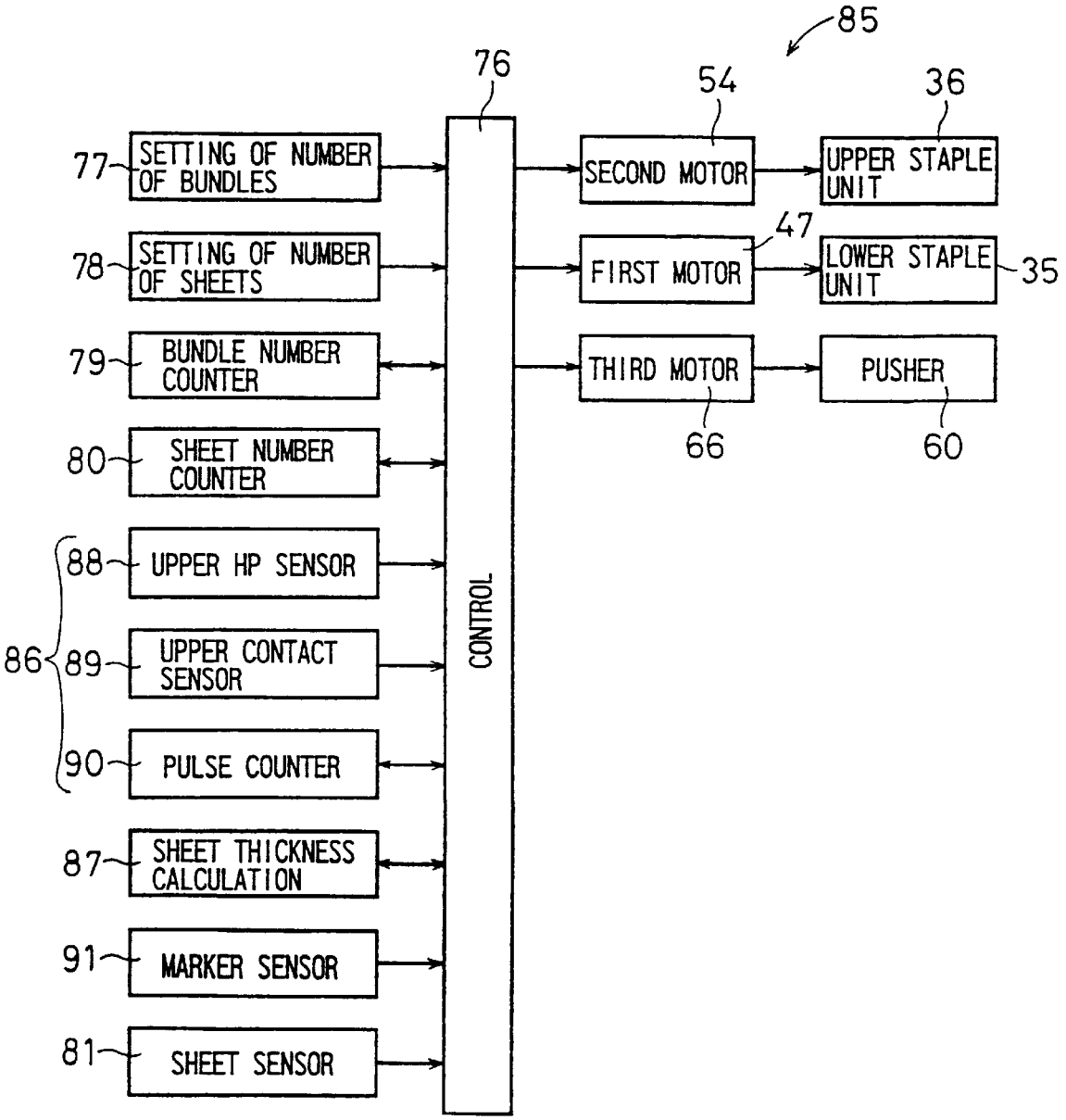
FIG. 12 is a simplified block diagram showing the electric configuration of a stapling apparatus 85 as another embodiment of the invention.

FIG. 12 is a simplified block diagram showing the electric configuration of a stapling apparatus 85 as another embodiment of the invention. In the embodiment, the same reference numerals are designated to components corresponding to those in the foregoing embodiment and their description is omitted here. The electric configuration of the stapling apparatus 85 of the invention is similar to that of the stapling apparatus 1 shown in FIGS. 1 to 11. Attention should be paid to a point that, in addition to the construction of the stapling apparatus 1 shown in FIGS. 1 to 11, the stapling apparatus 85 comprises: an uppermost sheet-surface sensing means 86 for sensing the position of the uppermost sheet-surface of a stack of sheets placed on the sheet tray 20 by using a predetermined position in the upper part of the stapling apparatus 85 as a reference; and a stack of sheets thickness calculating means 87 for calculating the thickness t1 of a plurality of sheets P1, and the operation of the staple units 35 and 36 is controlled by movement controlling means including the means 86 and 87 and the control circuit 76.

The uppermost sheet-surface sensing means 86 comprises an upper HP sensor 88 as upper reference position sensing means, an upper contact sensor 89 as uppermost sheet-surface contact sensing means, and a pulse counter 90 as measuring means. The upper HP sensor 88 is fixed to the laser beam printer 2 in a position higher than the sheet ejecting rollers 14. The upper HP sensor 88 senses that the under surface 36*a* of the upper staple unit 36 as a face contacting the uppermost sheet-surface of the stack of sheets P1 of the upper staple unit 36 is arranged in a predetermined position in the upper part of the stapling apparatus 85. Further, the upper HP sensor 88 is realized by, for example, a microswitch. That is, when the top face 36*b* of the upper staple unit 36 comes into contact with the upper HP sensor 88, the under surface 36*a* of the upper staple unit 36 is arranged in the predetermined position and the upper staple unit 36 is disposed in its reference position.

The upper contact sensor 89 is provided at the tip facing the uppermost sheet-surface of the upper staple unit 36. The upper contact sensor 89 senses that the upper staple unit 36 comes into contact with the uppermost sheet-surface of the stack of sheets P1 placed on the sheet tray 20. Further, the upper contact sensor 89 is realized by, for example, a microswitch.

The pulse counter 90 measures a movement amount A of the upper staple unit 36 from the predetermined position to the uppermost sheet-surface position. To be more specific, the pulse counter 90 counts the number of input pulses of the first motor 47 since the upper HP sensor 88 enters an OFF state until the upper contact sensor 89 enters an ON state. By counting the number of input pulses by the pulse counter 90, the angle of rotation of the first motor 47 is determined. From the pitch of the male screw of the first screw shaft 48 and the angle of rotation, the movement amount A of the upper staple unit 36 can be determined. The stack of sheets thickness calculating means 87 calculates the thickness t1 of the stack of sheets P1 by obtaining the product of the registered thickness of a sheet and the number (n) of sheets set in the sheet number setting unit 78.

A peripheral part of the side face 68*a* of the third toothed wheel 68 of the pusher driving means 61 is provided with a marker. A marker sensor 91 for sensing the marker in a state where the pusher 60 is placed in the reference position is provided near the third toothed wheel 68. The marker sensor 91 is realized by, for example, a reflection type photointerrupter.

To the control circuit 76, output signals from the sheet bundle number setting unit 77, sheet number setting unit 78, sheet bundle number counter 79, sheet counter 80, and sheet sensor 81 are supplied as described above. Further, to the control circuit 76, output signals from the upper HP sensor 88, upper contact sensor 89, pulse counter 90, stack of sheets thickness calculating means 87, and marker sensor 91 are also supplied. Control signals outputted from the control circuit 76 control the driving of the first motor 47 of the lower staple unit moving means 41, the second motor 54 of the upper staple unit moving means 42, and the third motor 66 of the pusher driving means 61, instruct the lower staple unit 35 to perform the staple driving operation, and drive the sheet bundle number counter 79, sheet number counter 80, and pulse counter 90.

Figure 13:
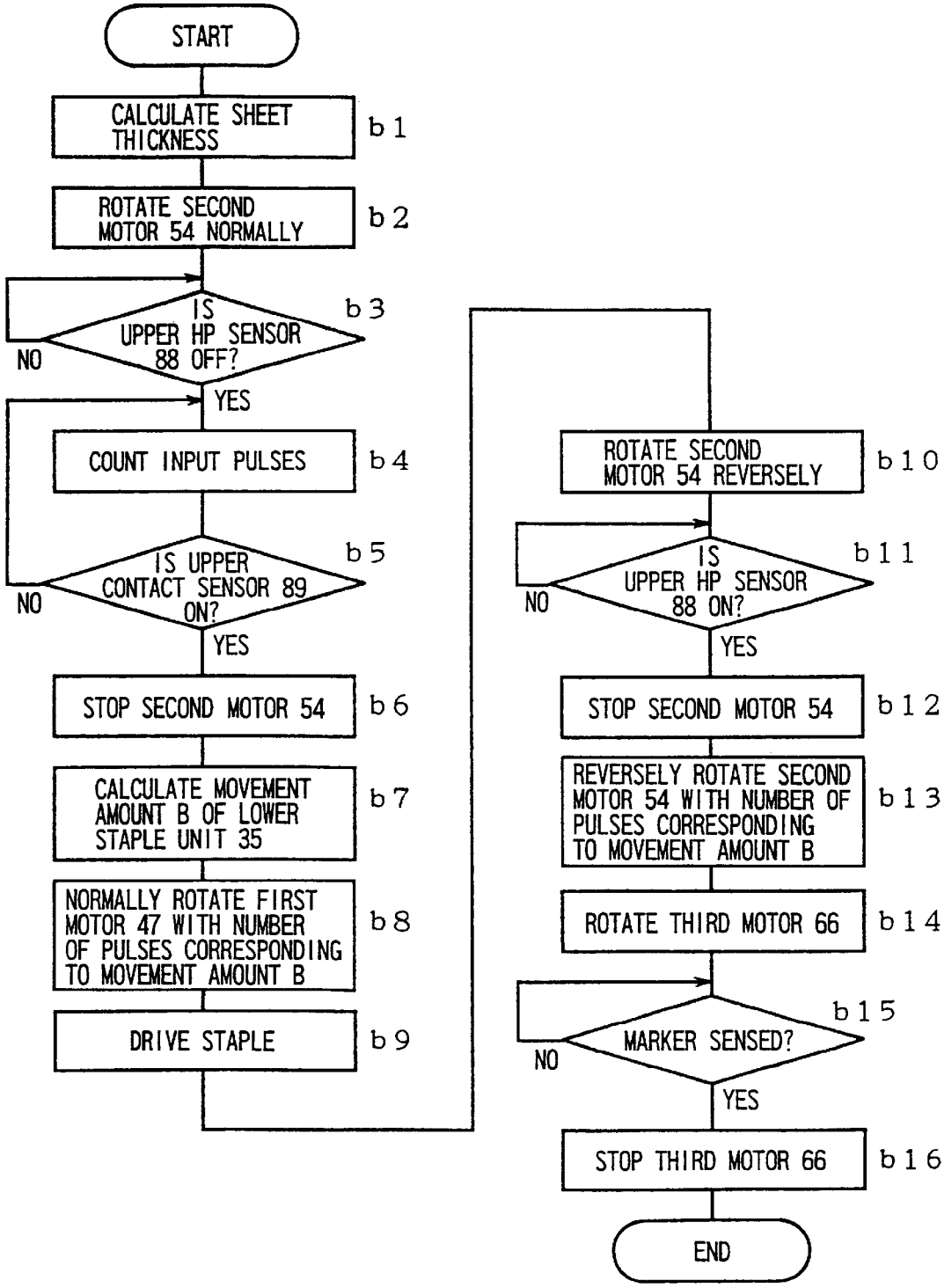
FIG. 13 is a flowchart for explaining the operation of the stapling apparatus 85.
Figure 14:
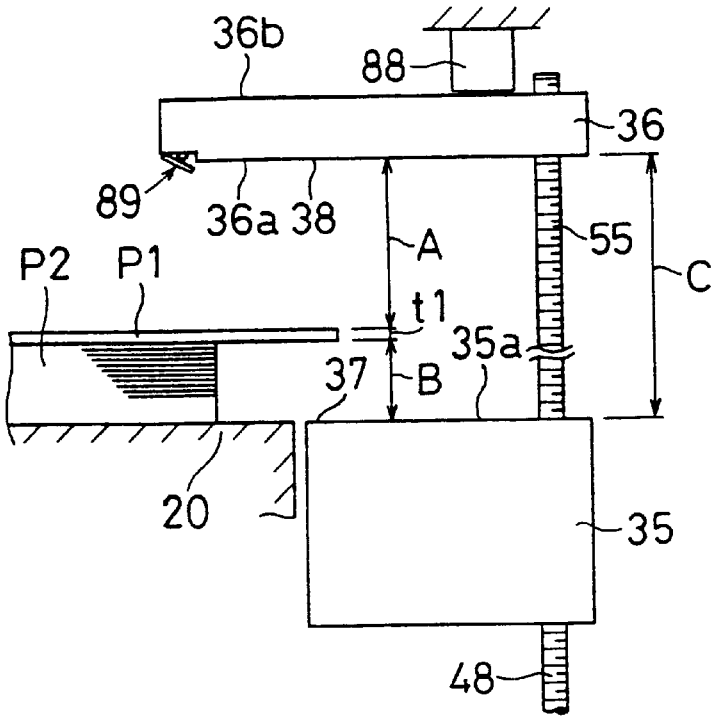
FIG. 14 is a diagram showing a state where the upper and lower staple units 36 and 35 are arranged in their reference positions.
Figure 15:
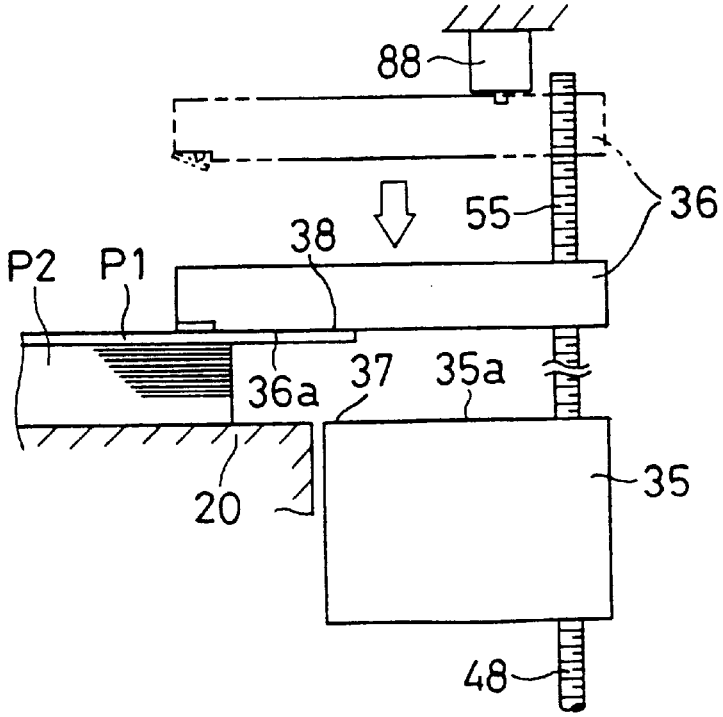
FIG. 15 is a diagram showing a state where the upper staple unit 36 is moved.

FIG. 13 is a flowchart for explaining the operation of the stapling apparatus 85. FIG. 14 is a diagram showing a state where the upper and lower staple units 36 and 35 are arranged in their reference positions. FIG. 15 is a diagram showing a state where the upper staple unit 36 is moved. As shown in FIG. 14, when the stack of sheets P1 is placed on the sheet tray 20 in a state where the upper and lower staple units 36 and 35 are arranged in their reference positions, at step b1, the thickness t1 of the stack of sheets P1 is calculated by the stack of sheets thickness calculating means 87. The routine advances from step b1 to step b2 where the second motor 54 is normally rotated by the control circuit 76 to move the upper staple unit 36 downward. The routine shifts from step b2 to step b3 where whether the upper HP sensor 88 is in the OFF state or not is determined. That is, when the control circuit 76 determines that the upper HP sensor 88 is in the OFF state, the routine advances to step b4 where the number of input pulses which drive the second motor 54 is counted. When the control circuit 76 determines that the upper HP sensor 88 is in the ON state, the routine returns to step b3.

The routine advances from step b4 to step b5 where whether the upper contact sensor 89 is in the ON state or not is determined. When the control circuit 76 determines that the upper contact sensor 89 is in the ON state, the routine advances to step b6 to stop the driving of the second motor 54. When the control circuit 76 determines that the upper contact sensor 89 is in the OFF state, the routine returns to step b4 to continue the counting of the input pulses. At steps b2 to b6, the stapling apparatus 85 performs in parallel the detection of the uppermost sheet-surface position and movement of the upper staple unit 36 to the position of the uppermost sheet-surface of the stack of sheets. By the operations, as shown in FIG. 15, the upper staple unit 36 is disposed in the position of the uppermost sheet-surface of the stack of sheets P1.

The routine advances from step b6 to step b7 where a movement amount B of the lower staple unit 35 is calculated. More specifically, the control circuit 76 calculates the movement amount B of the lower staple unit 35 by the following equation.

$$B=C-(A+t1) \quad (1)$$

where A denotes the movement amount of the upper staple unit 36, C denotes an interval between the under surface 36*a* of the upper staple unit 36 arranged in the reference position and the top face 35*a* of the lower staple unit 35 arranged in its reference position, and t1 indicates the calculated thickness of the stack of sheets P1.

The routine advances from step b7 to step b8 where the first motor 47 is normally rotated with the number of pulses corresponding to the movement amount B of the lower staple unit 35 to moves the lower staple unit 35 upward. The lower staple unit 35 is therefore disposed in a position obtained by adding the calculated thickness t1 of the sheets to the position of the uppermost sheet-surface. In such a manner, the upper and lower staple units 36 and 35 can sandwich the stack of sheets P1 in a state where the stack of sheets P1 are held in parallel to the sheet tray 20. When air layers are interposed between the plurality of sheets P1, the actual thickness of the stack of sheets P1 is larger than the calculated thickness t1 of the stack of sheets P1 only by an amount corresponding to the thickness of the air layers. Since the calculated thickness t1 of the stack of sheets P1 is used for the movement of the lower staple unit 35, the stack of sheets P1 are sandwiched by the units 35 and 36 with a pressure which makes the thickness of the air layers zero. Thus, the air layers interposed between the sheets are eliminated and the stack of sheets P1 can be firmly bound up.

The routine advances from step b8 to step b9 where the staple is driven into the stack of sheets P1 and the stack of sheets P1 are stapled. The routine advances from step b9 to step b10 where the second motor 54 is reversely rotated, thereby moving the upper staple unit 36 upward. The routine advances from step b10 to step b11 where whether the upper HP sensor 88 is in the ON state or not is determined. Specifically, the control circuit 76 reversely drives the first motor 47 until the upper HP sensor 88 enters the ON state, thereby moving the upper staple unit 36 upward. When the upper HP sensor 88 enters the ON state, the routine shifts from step b11 to step b12 where the driving of the first motor 47 is stopped. The routine advances from step b12 to step b13 where the first motor 47 is reversely rotated with the pulse corresponding to the movement amount B. By the operation, the lower staple unit 35 is returned to its reference position.

The routine shifts from step b13 to step b14 where the third motor 66 of the pusher driving means 61 is rotated. The routine advances from step b14 to step b15 where whether the marker sensor 91 has sensed the marker or not is determined. When the marker sensor 91 senses the marker, the routine advances from step b15 to step b16 where the driving of the third motor 66 is stopped. By the operations at steps b14 to b16, one rotation of the third toothed wheel 68 is made, the pusher 60 is reciprocated to move the sheet bundle P2 away from the stapler 21, and the operation is finished.

Formation of a plurality of sheet bundles is realized by repeating the operations from step b1 to step b16 for each sheet bundle.

The stapler 21 is moved in the sheet stacking direction on the basis of the position of the uppermost sheet-surface of the stack of sheets P1 sensed by the uppermost sheet-surface sensing means 86 and the thickness t1 of the stack of sheets P1 calculated by the stack of sheets thickness calculating means 87. Consequently, the upper and lower staple units 36 and 35 sandwich the stack of sheets P1 in a state where the stack of sheets P1 are held in parallel to the sheet tray 20 and the staple is driven in such a state, thereby enabling the stack of sheets P1 to be bound. At the time of formation of the sheet bundles P2, therefore, the stapler 21 can be arranged to the optimum position for binding a plurality of sheets.

The upper staple unit 36 is moved until the upper contact sensor 89 senses that the unit 36 comes into contact with the uppermost sheet-surface. The pulse counter 90 measures the movement amount A of the upper staple unit 36 from the predetermined position to the uppermost sheet-surface position and the uppermost sheet-surface position is sensed by using the predetermined position as a reference. Consequently, the detection of the uppermost sheet-surface position and the movement of the upper staple unit 36 to the uppermost sheet-surface position can be performed in parallel. As compared with the case of individually performing the detection of the uppermost sheet-surface position and the movement of the upper staple unit 36 to the uppermost sheet-surface position, the processing speed of arranging the upper staple unit 36 in the position of the uppermost sheet-surface can be increased. Also, since no error occurs between the mechanism of sensing the uppermost sheet-surface position and the mechanism of moving the upper staple unit 36, the upper staple unit 36 can be accurately disposed in the position of the uppermost sheet-surface.

Figure 16:
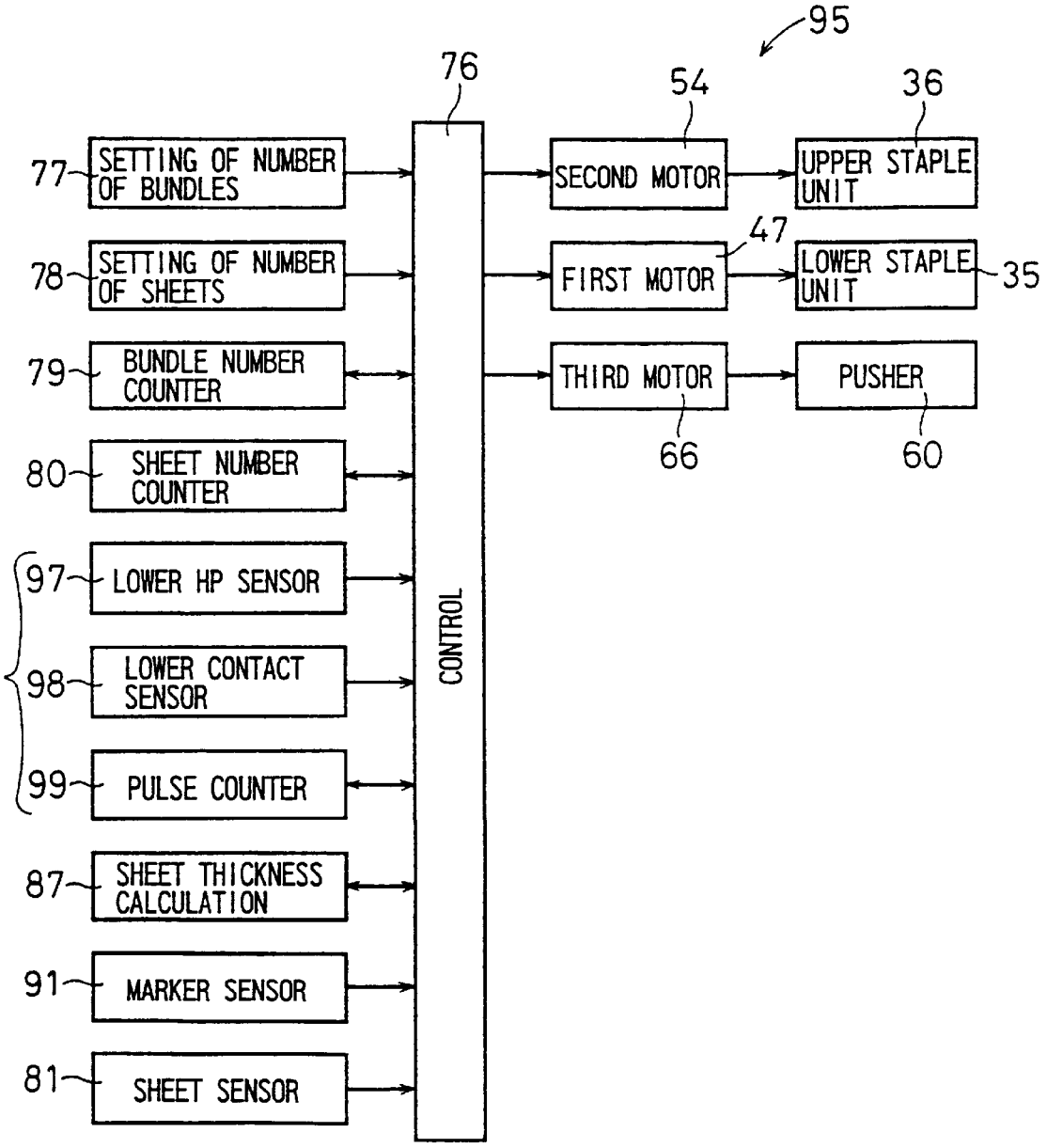
FIG. 16 is a simplified block diagram showing the electric configuration of a stapling apparatus 95 as further another embodiment of the invention.

FIG. 16 is a simplified block diagram showing the electric configuration of a stapling apparatus 95 as further another embodiment of the invention. In the embodiment, the same reference numerals denote components corresponding to those in the foregoing embodiment and their description is omitted here. The electric configuration of the stapling apparatus 95 of the invention is similar to that of the stapling apparatus 85 shown in FIGS. 12 to 15. Attention should be paid to a point that the stapling apparatus 95 comprises undermost sheet-surface sensing means 96 for sensing the position of the undermost sheet-surface of a stack of sheets P1 placed on the sheet tray 20 by using a predetermined position in the lower part of the stapling apparatus 95 as a reference and the stack of sheets thickness calculating means 87 for calculating the thickness t1 of the stack of sheets P1, and the operations of the staple units 35 and 36 are controlled by movement controlling means including the means 96 and 87 and the control circuit 76.

The undermost sheet-surface sensing means 96 comprises a lower HP sensor 97 as lower reference position sensing means, a lower contact sensor 98 as undermost sheet-surface contact sensing means, and a pulse counter 99 as measuring means. The lower HP sensor 97 is fixed in the lower part of the sheet stapling apparatus 95. The lower HP sensor 97 senses that the top face 35*a* of the lower staple unit 35 as a face contacting the undermost sheet-surface of the stack of sheets P1 of the lower staple unit 35 is arranged in a predetermined position in the lower part of the stapling apparatus 95. Further, the lower HP sensor 97 is realized by, for example, a microswitch. That is, when the under surface 35*b* of the lower staple unit 35 comes into contact with the lower HP sensor 97, the top face 35*a* of the lower staple unit 35 is arranged in the predetermined position and the lower staple unit 35 is arranged in its reference position.

The lower contact sensor 98 is provided at the tip facing the undermost sheet-surface of the lower staple unit 35. The lower contact sensor 98 senses that the lower staple unit 35 comes into contact with the undermost sheet-surface of the stack of sheets P1 placed on the sheet tray 20. Further, the lower contact sensor 98 is realized by, for example, a microswitch.

The pulse counter 99 measures the movement amount of the lower staple unit 35 from the predetermined position to the undermost sheet-surface position. To be more specific, the pulse counter 99 counts the number of input pulses of the second motor 54 since the lower HP sensor 97 enters an OFF state until the lower contact sensor 98 enters an ON state. By counting the number of input pulses by the pulse counter 99, the angle of rotation of the rotary shaft of the second motor 54 is determined. From the pitch of the male screw of the second screw shaft 55 and the angle of rotation of the second motor 54, the movement amount B of the lower staple unit 35 can be determined.

To the control circuit 76, output signals from the sheet bundle number setting unit 77, sheet number setting unit 78, sheet bundle number counter 79, sheet number counter 80, and sheet sensor 81 are supplied as described above. Further, to the control circuit 76, output signals from the lower HP sensor 97, lower contact sensor 98, pulse counter 99, stack of sheets thickness calculating means 87, and marker sensor 91 are also supplied. Control signals outputted from the control circuit 76 control the driving of the first motor 47 of the lower staple unit moving means 41, the second motor 54 of the upper staple unit moving means 42, and the third motor 66 of the pusher driving means 61, instruct the lower staple unit 35 to perform the staple driving operation, and drive the sheet bundle number counter 79, the sheet number counter 80, and the pulse counter 99.

Figure 17:
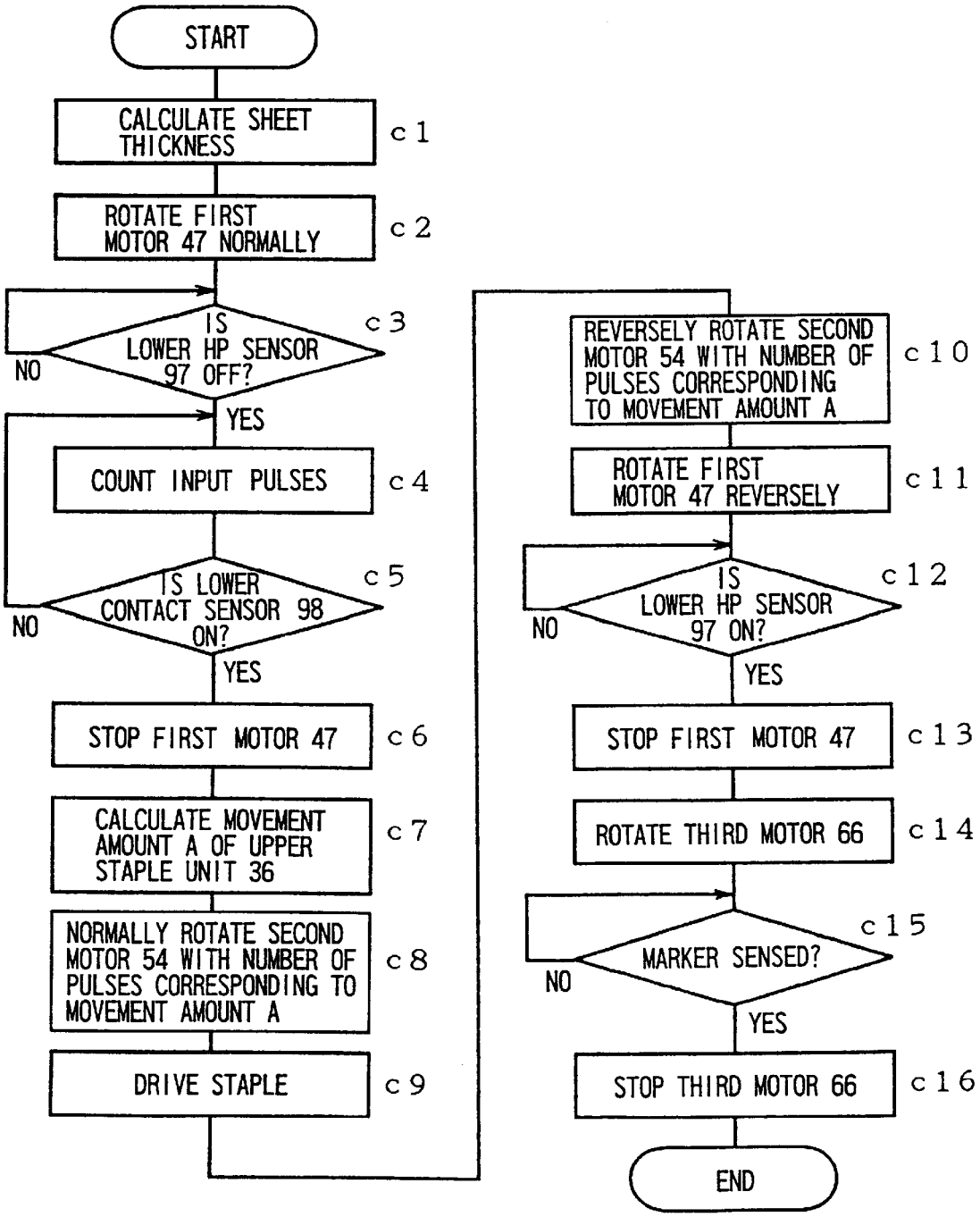
FIG. 17 is a flowchart for explaining the operation of the stapling apparatus 95.
Figure 18:
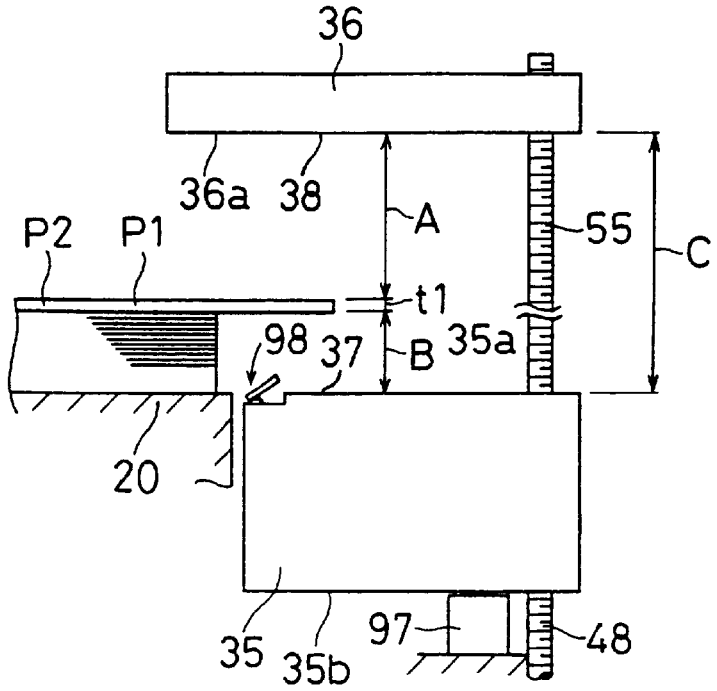
FIG. 18 is a diagram showing a state where the upper and lower staple units 36 and 35 are arranged in their reference positions.
Figure 19:
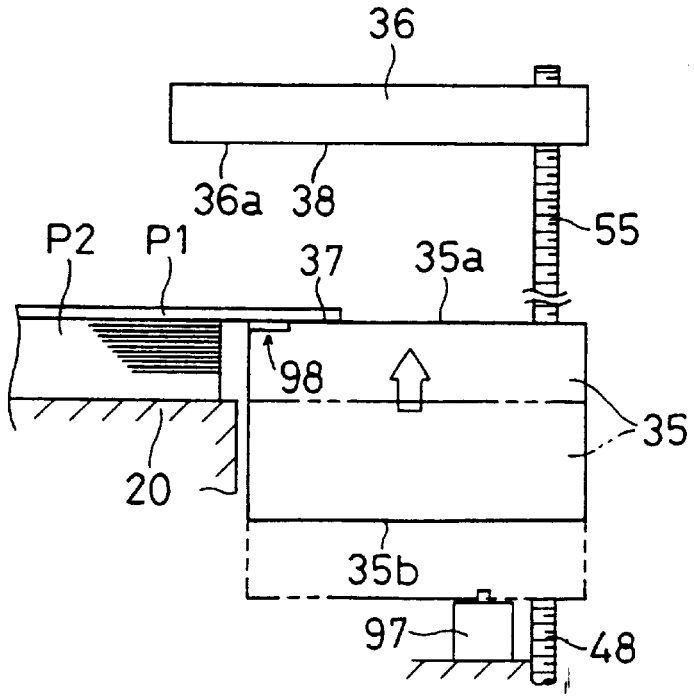
FIG. 19 is a diagram showing a state where the lower staple unit 35 is moved.

FIG. 17 is a flowchart for explaining the operation of the stapling apparatus 95. FIG. 18 is a diagram showing a state where the upper and lower staple units 36 and 35 are arranged in their reference positions. FIG. 19 is a diagram showing a state where the lower staple unit 35 is moved. As shown in FIG. 18, when a stack of sheets P1 is placed on the sheet tray 20 in a state where the upper and lower staple units 36 and 35 are arranged in their reference positions, at step c1, the thickness t1 of the stack of sheets P1 is calculated by the stack of sheets thickness calculating means 87. The routine advances from step c1 to step c2 where the first motor 47 is normally rotated to move the lower staple unit 35 upward. The routine shifts from step c2 to step c3. At step c3, whether the lower HP sensor 97 is in the OFF state or not is determined. That is, when the control circuit 76 determines that the lower HP sensor 97 is in the ON state, the routine returns to step c3. When the control circuit 76 determines that the lower HP sensor 97 is in the OFF state, the routine advances to step b4 where the number of input pulses which drive the first motor 47 is counted by the pulse counter 99.

The routine advances from step c4 to step c5 where whether the lower contact sensor 98 is in the ON state or not is determined. Specifically, when the control circuit 76 determines that the lower contact sensor 98 is in the OFF state, the routine returns to step c4. When the control circuit 76 determines that the lower contact sensor 98 is in the ON state, the routine shifts to step c6 and stops the driving of the first motor 47. At steps c2 to c6, the detection of the undermost sheet-surface position and movement of the lower staple unit 35 to the position of the undermost sheet-surface of the stack of sheets are performed in parallel. Thus, as shown in FIG. 19, the lower staple unit 35 is disposed in the position of the undermost sheet-surface of the stack of sheets P1.

At step c7, the movement amount A of the upper staple unit 36 is calculated. That is, the control circuit 76 calculates the movement amount A of the upper staple unit 36 by the following equation.

$$A=C-(B+t1) \quad (2)$$

where B denotes the movement amount of the lower staple unit 35, C denotes an interval between the top face 35*a* of the lower staple unit 35 arranged in its reference position and the under surface 36*a* of the upper staple unit 36 arranged in its reference position, and t1 indicates the thickness of the stack of sheets P1 calculated by the stack of sheets thickness calculating means 87.

The routine advances from step c7 to step c8 where the second motor 54 is normally rotated with the number of pulses corresponding to the movement amount A to move the upper staple unit 36 downward. By the operation, the upper staple unit 36 is disposed in a position obtained by adding the calculated thickness t1 of the stack of sheets P1 to the position of the undermost sheet-surface position. Consequently, the upper and lower staple units 36 and 35 sandwich the stack of sheets P1 in a state where the stack of sheets P1 are held in parallel to the sheet tray 20 and the staple is driven in such a state to thereby bind the sheets.

When air layers are interposed between the respective sheets of the stack P1, the actual thickness of the sheets P1 is larger than the calculated thickness t1 of the stack of sheets P1 only by an amount corresponding to the thickness of the air layers. Since the calculated thickness t1 of the stack of sheets P1 is used to move the upper staple unit 36, the stack of sheets P1 is sandwiched by the units 35 and 36 with a pressure which makes the thickness of the air layers zero. Thus, the air layers interposed between the sheets are eliminated and the stack sheets P1 can be firmly bound.

The routine advances from step c8 to step c9 where the staple is driven through the stack of sheets P1 and the stack of sheets P1 is bound. The routine advances from step c9 to step c10 where the second motor 54 is reversely rotated with the number of pulses corresponding to the movement amount A, thereby moving the upper staple unit 36 upward. By the operation, the upper staple unit 36 is disposed in its reference position in the upper part of the stapling apparatus 95. The routine advances from step c10 to step c11 where the first motor 47 is reversely rotated to move the lower staple unit 35 downward. The routine advances from step c11 to step c12 where whether the lower HP sensor 97 is in the ON state or not is determined. Specifically, when the control circuit 76 determines that the lower HP sensor 97 is in the OFF state, the routine returns to step c12. When the control circuit 76 determines that the lower HP sensor 97 is in the ON state, the routine shifts to step c13 and stops the driving of the first motor 47. At steps c11 to c13, the lower staple unit 35 is returned to its reference position.

The routine shifts from step c13 to steps c14 to C16. Operations similar to those at steps b13 to b16 shown at step c13 are performed and the pusher 60 is driven to push the sheet bundle P2 away from the stapler 21.

Formation of a plurality of sheet bundles P2 is realized by repeating the operations of steps c1 to c16 for each sheet bundle.

The stapler 21 is moved in the sheet stacking direction on the basis of the position of the undermost sheet-surface of the stack of sheets P1 sensed by the undermost sheet-surface sensing means 96 and the thickness t1 of the stack of sheets P1 calculated by the stack of sheets thickness calculating means 87. Consequently, the upper and lower staple units 36 and 35 sandwich the stack of sheets P1 in a state where the sheets P1 is in parallel to the sheet tray 20 and the staple is driven in such a state, thereby enabling the stack of sheets P1 to be bound. At the time of formation of the sheet bundle P2, therefore, the stapler 21 can be arranged in the optimum position for binding a plurality of sheets.

The lower staple unit 35 is moved until the lower contact sensor 98 senses that the unit 35 comes into contact with the undermost sheet-surface. The pulse counter 99 measures the movement amount B of the lower staple unit 35 from the predetermined position to the undermost sheet-surface position, and the undermost sheet-surface position is sensed by using the predetermined position as a reference. Consequently, the detection of the undermost sheet-surface position and the movement of the lower staple unit 35 to the undermost sheet-surface position can be performed in parallel. As compared with the case of separately performing the detection of the undermost sheet-surface position and the movement of the lower staple unit 35 to the undermost sheet-surface position, the processing speed of arranging the lower staple unit 35 to the position of the undermost sheet-surface can be increased more. Also, since no error occurs between the mechanism of sensing the undermost sheet-surface position and the mechanism of moving the lower staple unit 35, the lower staple unit 35 can be accurately disposed in the position of the undermost sheet-surface.

Figure 20:
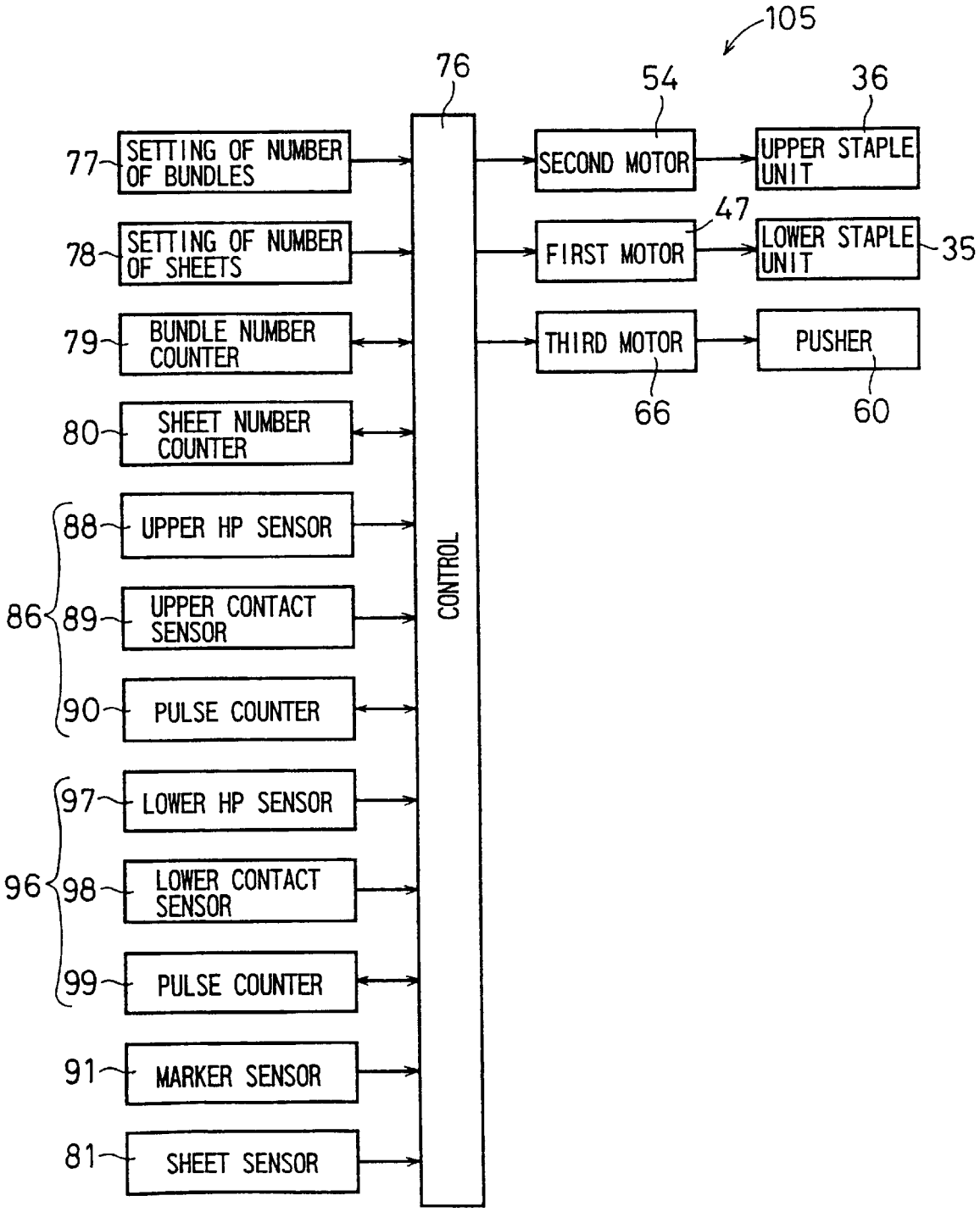
FIG. 20 is a simplified block diagram showing the electric configuration of a stapling apparatus 105 as further another embodiment of the invention.

FIG. 20 is a simplified block diagram showing the electric configuration of a stapling apparatus 105 as further another embodiment of the invention. In the embodiment, the same reference numerals denote components corresponding to those in the foregoing embodiment and their description is omitted here. The electric configuration of the stapling apparatus 105 of the invention is similar to those of the stapling apparatuses 1, 85, and 95 shown in FIGS. 1 to 19. Attention should be paid to a point that the stapling apparatus 105 comprises the uppermost sheet-surface sensing means 86 for sensing the position of the uppermost sheet-surface of the stack of sheets P1 placed on the sheet tray 20 by using a predetermined position in the stapling apparatus 105 as a reference and undermost sheet-surface sensing means for sensing the position of the undermost sheet-surface of the stack of sheets P1 placed on the sheet tray by using a predetermined position in the stapling apparatus 105 as a reference, and the operations of the staple units 35 and 36 are controlled by movement controlling means including those means and the control circuit 76.

To the control circuit 76, output signals from the sheet bundle number setting unit 77, sheet number setting unit 78, sheet bundle number counter 79, sheet number counter 80, and sheet sensor 81 are supplied as described above. Further, to the control circuit 76, output signals from the upper HP sensor 88, the upper contact sensor 89, and the pulse counter 90 are also supplied. Output signals from the lower HP sensor 97, the lower contact sensor 98, and the pulse counter 99 are also supplied to the control circuit 76. Further, an output signal from the marker sensor 91 is supplied to the control circuit 76 as described above.

Control signals outputted from the control circuit 76 control the driving of the first motor 47 of the lower staple unit moving means 41, the second motor 54 of the lower staple unit moving means 35, and the third motor 66 of the pusher driving means 61, instruct the lower staple unit 35 to perform the staple driving operation, and drive the sheet bundle number counter 79, the sheet number counter 80, and the pulse counters 90 and 99.

Figure 21:
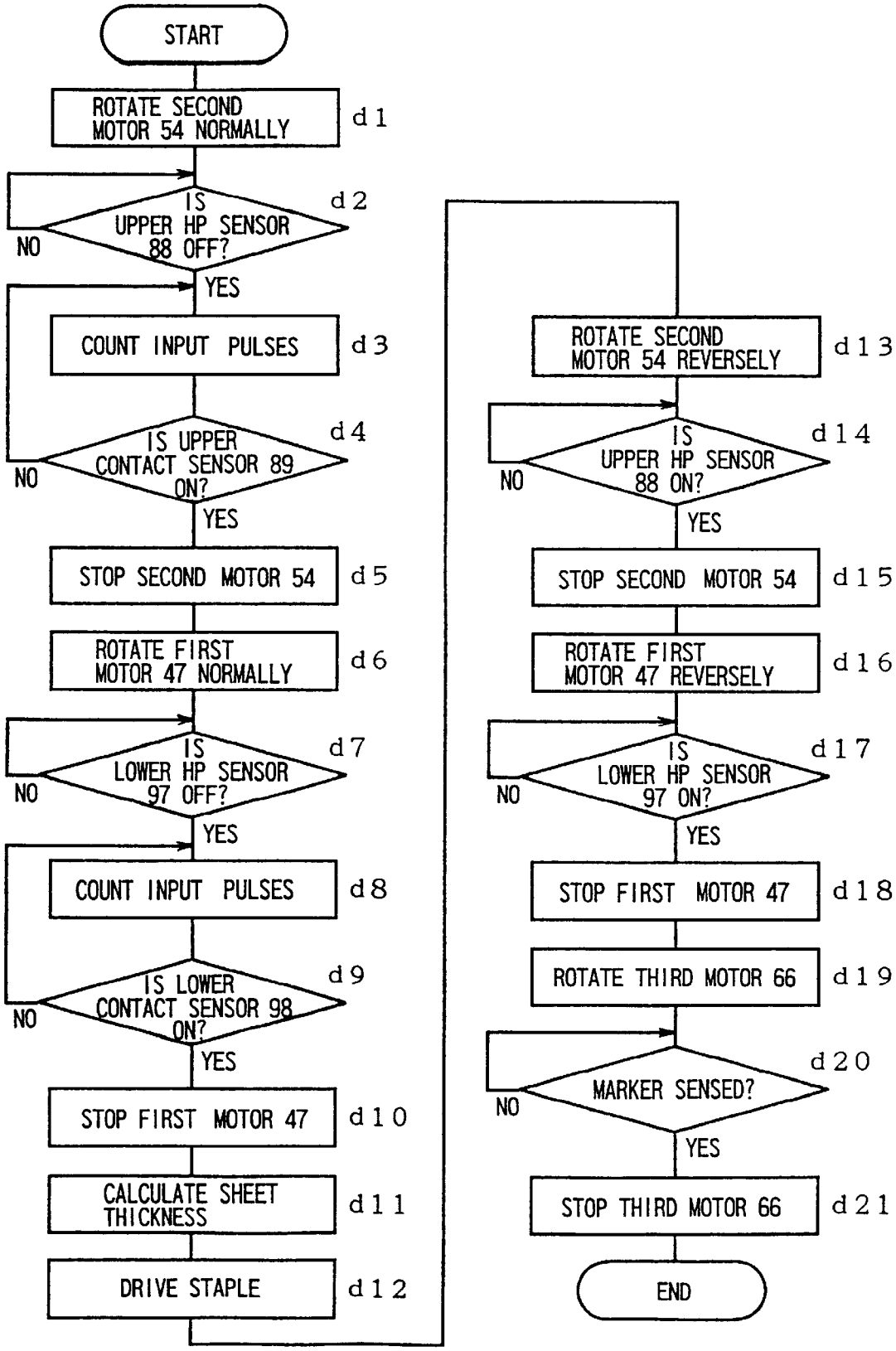
FIG. 21 is a flowchart for explaining the operation of the stapling apparatus 105.
Figure 22:
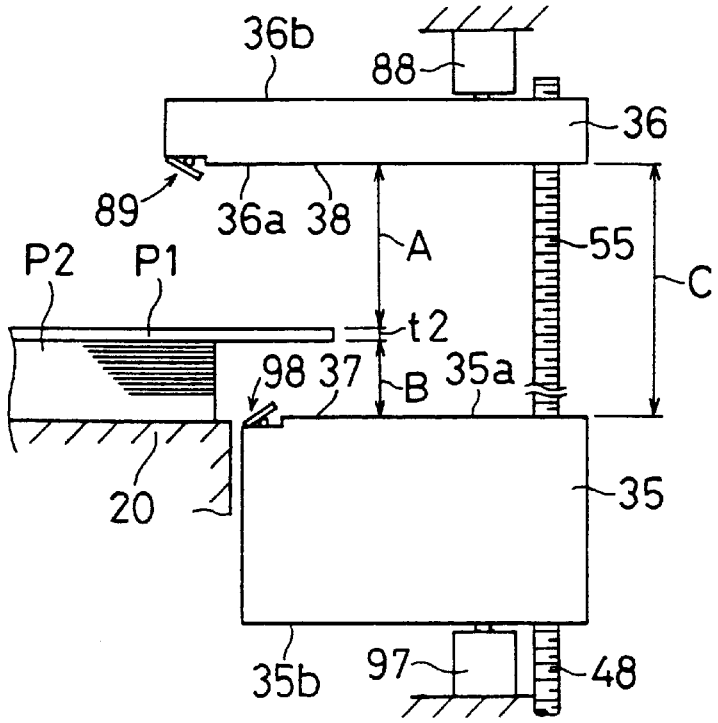
FIG. 22 is a diagram showing a state where the upper and lower staple units 36 and 35 are arranged in their reference positions.
Figure 23:
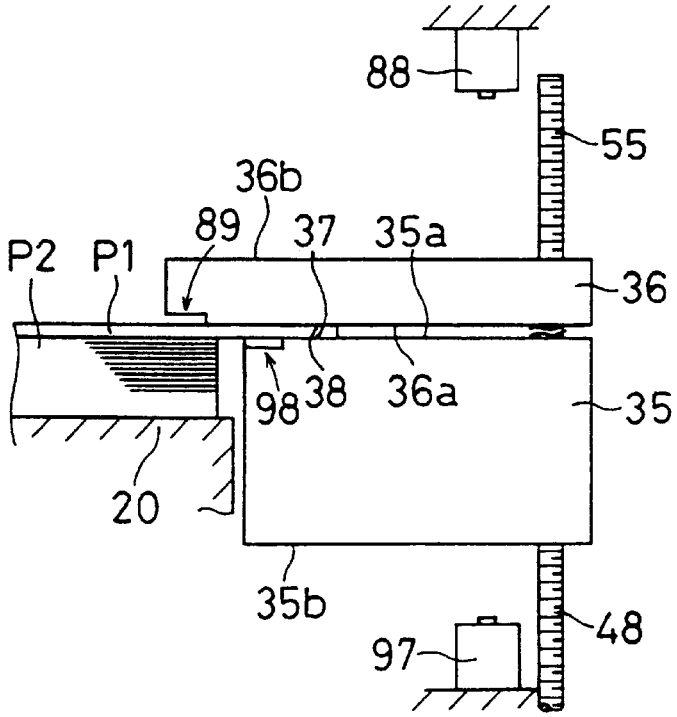
FIG. 23 is a state where the upper and lower staple units 36 and 35 are moved.

FIG. 21 is a flowchart for explaining the operation of the stapling apparatus 105. FIG. 22 is a diagram showing a state where the upper and lower staple units 36 and 35 are arranged in their reference positions. FIG. 23 is a diagram showing a state where the upper and lower staple units 36 and 35 are moved. As shown in FIG. 22, when the plurality of sheets P1 are stacked on the sheet tray 20 in a state where the upper and lower staple units 36 and 35 are arranged in their reference positions, the routine starts operations of steps d1 to d5 in a manner similar steps b2 to b6 in FIG. 13. By the operations, the upper staple unit 36 is disposed in the position of the uppermost sheet-surface of the stack of sheets P1 and the movement amount A of the upper staple unit 36 from the predetermined position to the sheet uppermost position is measured. The routine advances from step d5 to steps d6 to d10 where operations similar to those at steps c2 to c6 in FIG. 17 are carried out. By the operations, the lower staple unit 35 is arranged in the position of the undermost sheet-surface of the stack of sheets P1 and the movement amount B of the lower staple unit 35 from the predetermined position to the undermost sheet-surface position is measured.

The routine advances from step d10 to step d11 where the thickness t2 of the stack of sheets P1 is calculated. That is, the control circuit 76 calculates the thickness t2 of the stack of sheets P1 by the following equation.

$$t2=C-(A+B) \tag{3}$$

where A denotes the movement amount of the upper staple unit 36, B indicates the movement amount of the lower staple unit 35, and C denotes an interval between the top face 35*a* of the lower staple unit 35 arranged in the reference position and the under surface 36*a* of the upper staple unit 36 arranged in its reference position.

The stapler 21 is moved in the sheet stacking direction on the basis of the position of the uppermost sheet-surface of the stack of sheets P1 sensed by the uppermost sheet-surface sensing means 86 and the undermost sheet-surface position of the stack of sheets P1 sensed by the undermost sheet-surface detecting means 96. Consequently, the upper and lower staple units 36 and 35 sandwich the stack of sheets P1 in a state where the stack of sheets P1 are held in parallel to the sheet tray 20 and the staple is driven in such a state, thereby enabling the stack of sheets P1 to be bound. At the time of formation of the sheet bundle P2, therefore, the stapler 21 can be arranged to the optimum position for binding a plurality of sheets irrespective of the thickness of the stack of sheets P1.

When air layers are interposed between the respective sheets of the stack P1, the actual thickness of the stack of sheets P1 becomes larger than the calculated thickness t2 of the stack of sheets P1 only by an amount corresponding to the thickness of the air layers. Since the upper contact sensor 89 comes into contact with the uppermost sheet-surface of the stack of sheets P1 and the lower contact sensor 98 comes into contact with the undermost sheet-surface of the stack of sheets P1, the stack of sheets P1 is sandwiched by the staple units 35 and 36 with a pressure which operates the upper contact sensor 89 and the lower contact sensor 98. Thus, the air layers interposed between the sheets are eliminated and the stack of sheets P1 can be firmly bound.

The routine advances from step d11 to step d12 where the staple is driven from the lower staple unit 35 by the control circuit 76 to staple the stack of sheets P1. The routine moves from step d12 to steps d13 to d15 where operations similar to those at steps b10 to b12 in FIG. 13 are performed. By the operations, the upper staple unit 36 is returned to its reference position in the upper part of the stapling apparatus 105. The routine advances from step d15 to steps d16 to d18 where operations similar to those at steps c11 to c13 in FIG. 17 are performed. Consequently, the lower staple unit 35 is returned to its reference position in the lower part of the stapling apparatus 105. The routine shifts from step d18 to steps d19 to d21 where operations similar to those at steps b14 to b16 shown at step c13 are performed. By the operations, the pusher 60 is reciprocated in the directions toward and away from the first side plate 27 to move the sheet bundle P2 away from the stapler 21.

Formation of a plurality of sheet bundles P2 is realized by repeating the operations of steps d1 to d21 for each sheet bundle.

The upper staple unit 36 is moved until the upper contact sensor 89 senses that the unit 36 comes into contact with the uppermost sheet-surface of the stack of sheets and the pulse counter 90 measures the movement amount A of the upper staple unit 36 from the predetermined position in the upper part of the stapling apparatus 105 to the position of the uppermost sheet-surface, thereby sensing the position of the uppermost sheet-surface by using the predetermined position in the upper part of the stapling apparatus 105 as a reference. The lower staple unit 35 is moved until the lower contact sensor 98 senses that the unit 35 comes into contact with the undermost sheet-surface of the stack of sheets and the pulse counter 99 measures the movement amount B of the lower staple unit 35 from the predetermined position in the lower part of the stapling apparatus 105 to the position of the undermost sheet-surface of the stack of sheets, thereby sensing the undermost sheet-surface position by using the predetermined position in the lower part of the stapling apparatus 105 as a reference. Consequently, the detection of the uppermost sheet-surface position and the movement of the upper staple unit 36 to the uppermost sheet-surface position can be performed in parallel. The detection of the undermost sheet-surface position and the movement of the lower staple unit 35 to the undermost sheet-surface position can be performed in parallel. As compared with the case of individually performing the detection of the uppermost sheet-surface position and the movement of the upper staple unit 36 to the uppermost sheet-surface position and also individually performing the detection of the undermost sheet-surface position and the movement of the lower staple unit 35 to the undermost sheet-surface position, the processing speed of arranging the upper staple unit 36 to the position of the uppermost sheet-surface and arranging the lower staple unit 35 to the position of the undermost sheet-surface can be increased more. No error occurs between the mechanism of sensing the uppermost sheet-surface position and the mechanism of moving the upper staple unit 36, and no error occurs between the mechanism of sensing the position of the undermost sheet-surface and the mechanism of moving the lower staple unit 35, so that the units 35 and 36 can be accurately arranged in the uppermost sheet-surface position and the undermost sheet-surface position, respectively.

In the embodiment, the control circuit 76 moves the lower staple unit 35 after moving the upper staple unit 36, the invention is not limited to the arrangement. The upper staple unit 36 can be also moved after moving the lower staple unit 35. The upper and lower staple units 36 and 35 may be simultaneously moved. When the upper and lower staple units 36 and 35 are simultaneously moved, the processing speed of arranging the upper staple unit 36 to the uppermost sheet-surface position and moving the lower staple unit 35 to the undermost sheet-surface position can be increased most.

Figure 24:
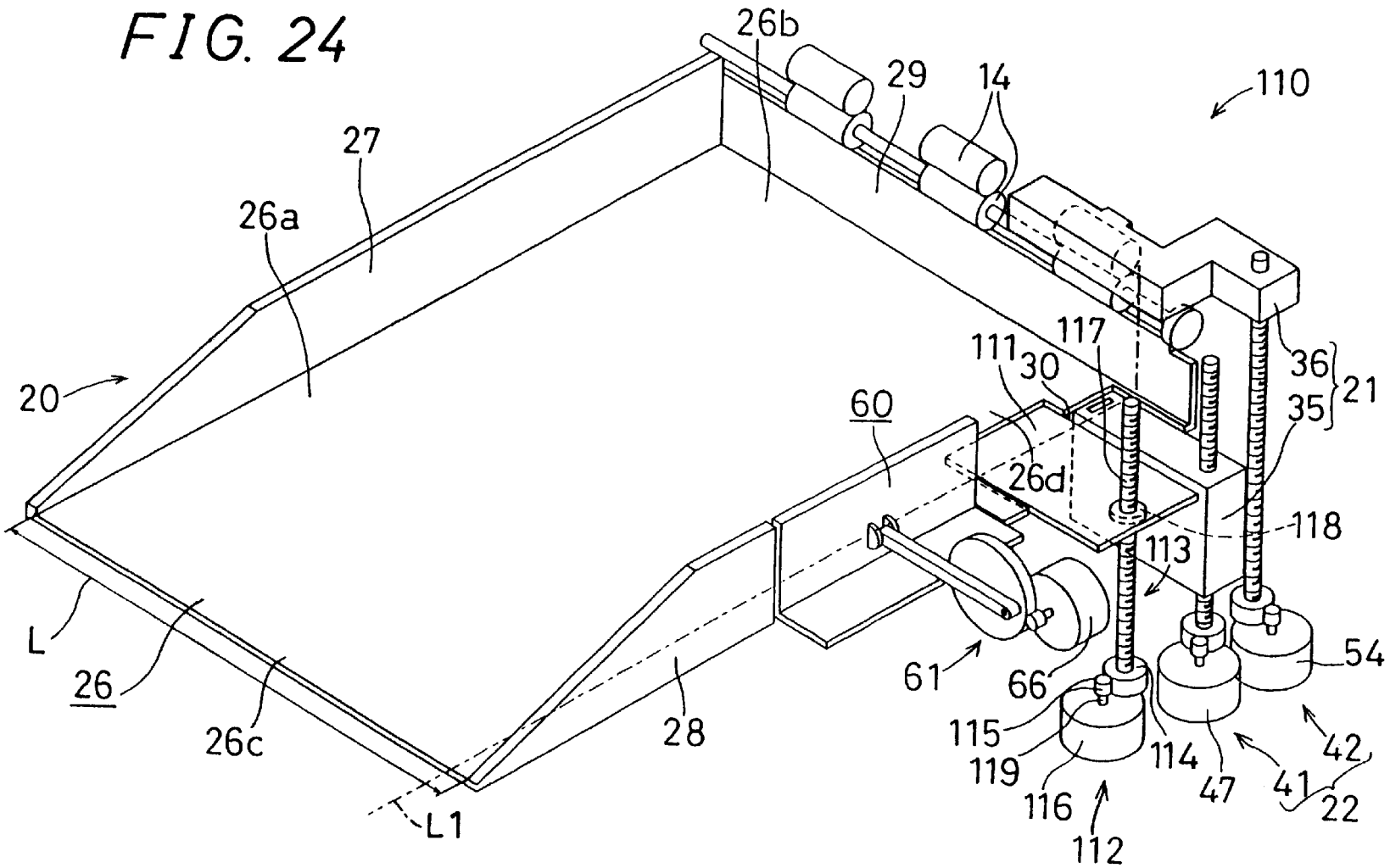
FIG. 24 is a simplified perspective view showing the construction of a stapling apparatus 110 as further another embodiment of the invention.

FIG. 24 is a simplified perspective view showing the construction of a stapling apparatus 110 as further another embodiment of the invention. In the embodiment, the same reference numerals are designated to components corresponding to those in the foregoing embodiments and their description is omitted here. The construction of the stapling apparatus 110 of the invention is similar to those of the stapling apparatuses 1, 85, 95, and 105 shown in FIGS. 1 to 23. Attention should be paid to a point that the apparatus comprises an auxiliary tray 111 and auxiliary tray moving means 112.

The auxiliary tray 111 is formed in an almost rectangular plate shape and disposed in the peripheral part of the sheet tray 20, that is, between the lower staple unit 35 and the pusher 60, and on which sheets P1*a* and a sheet bundle protruded from the sheet tray 20 are placed. The auxiliary tray moving means 112 moves the auxiliary tray 111 upward and downward and comprises, for example, a third ball screw 113, a fourth toothed wheel 114, a fourth pinion 115, and a fourth motor 116. The third ball screw 113 comprises a third screw shaft 117 which extends in the direction perpendicular to the sheet tray 20 and in which a male screw is threaded, a nut 118 in which a female screw is threaded and which screws on the third screw shaft 117, and is connected to the auxiliary tray 111, and a steel ball interposed between the male and female screws and housed and circulates in the nut 118. The fourth toothed wheel 114 is formed integrally with the lower end part of the third screw shaft 117. The fourth pinion 115 is provided at the tip of a rotary shaft 119 of the fourth motor 116 such as a stepping motor and meshes with the fourth toothed wheel 114.

The fourth motor 116 rotates the third screw shaft 117 via the rotary shaft 119, the fourth pinion 115, and the fourth toothed wheel 114. When the third screw shaft 117 is rotated in a state where the angular displacement around the axial line of the third screw shaft 117 in the auxiliary tray 111 is restrained, the auxiliary tray 111 is moved upward and downward along the axial line of the third screw shaft 117. When the fourth motor 116 is normally rotated, the auxiliary tray 111 is moved upward. When the fourth motor 116 is reversely rotated, the auxiliary tray 111 is moved downward. The pitch of the male screw of the third screw shaft 117 is set to be equal to the pitch of the male screw in each of the first and second screw shafts 48 and 55.

The auxiliary tray 111 is disposed in the same position as the sheet tray 20 in the sheet stacking direction, that is, in the reference position where the top face of the auxiliary tray 111 is flush with the placing face of the bottom plate 26 in the sheet tray 20.

Figure 25:
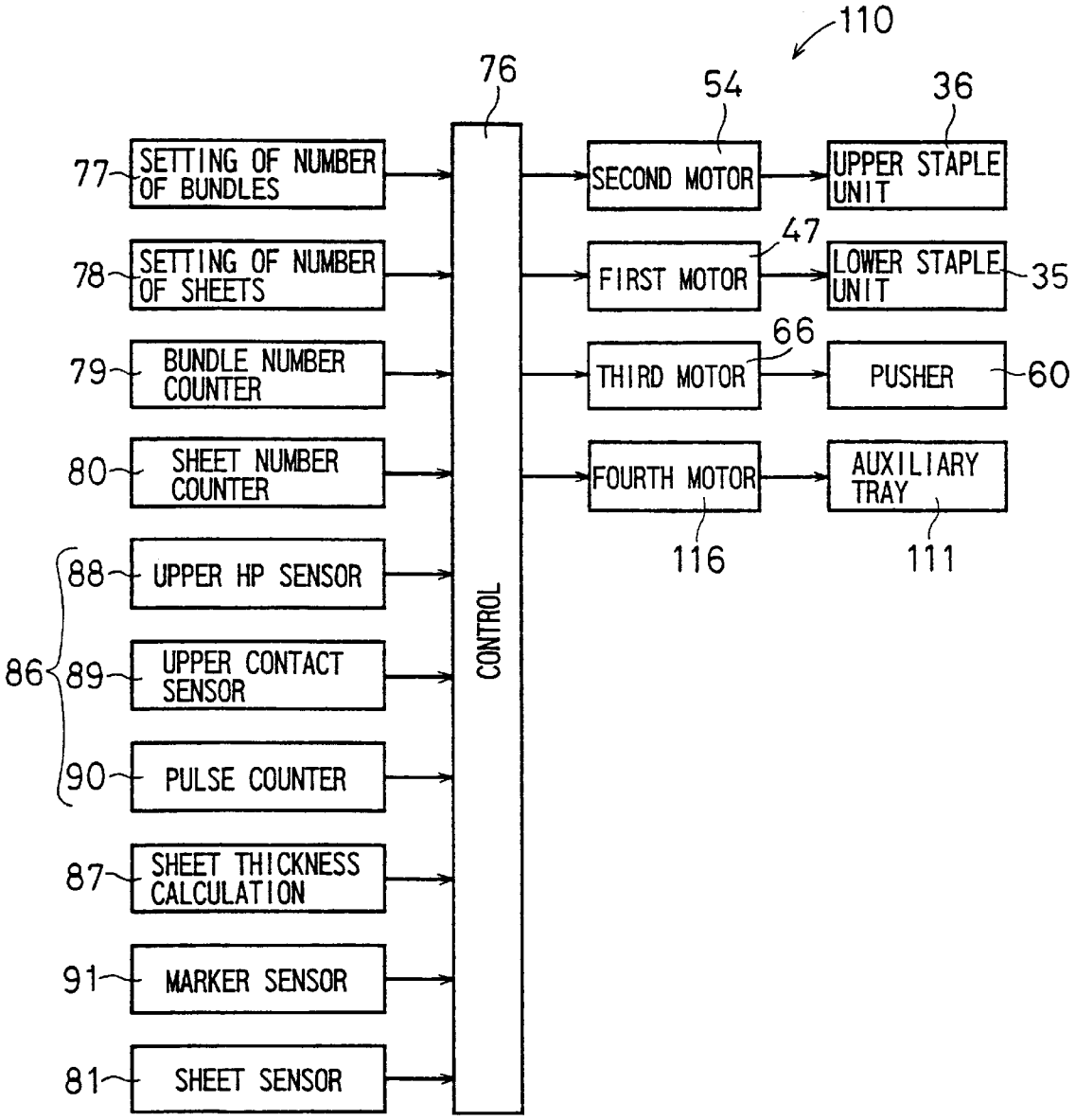
FIG. 25 is a simplified block diagram showing the electric configuration of the stapling apparatus 110.

FIG. 25 is a simplified block diagram showing the electric configuration of the stapling apparatus 110. The electric configuration of the stapling apparatus 110 is similar to that of the stapling apparatus 85 shown in FIG. 12. Attention should be paid to a point that the operation of the auxiliary tray moving means 112 is controlled by movement controlling means including the control circuit 76. Control signals outputted from the control circuit 76 control the driving of the fourth motor 116 of the auxiliary tray moving means 112. The driving of the fourth motor 116 is controlled by the control circuit 76, thereby moving the auxiliary tray 111 upward and downward.

Figure 26:
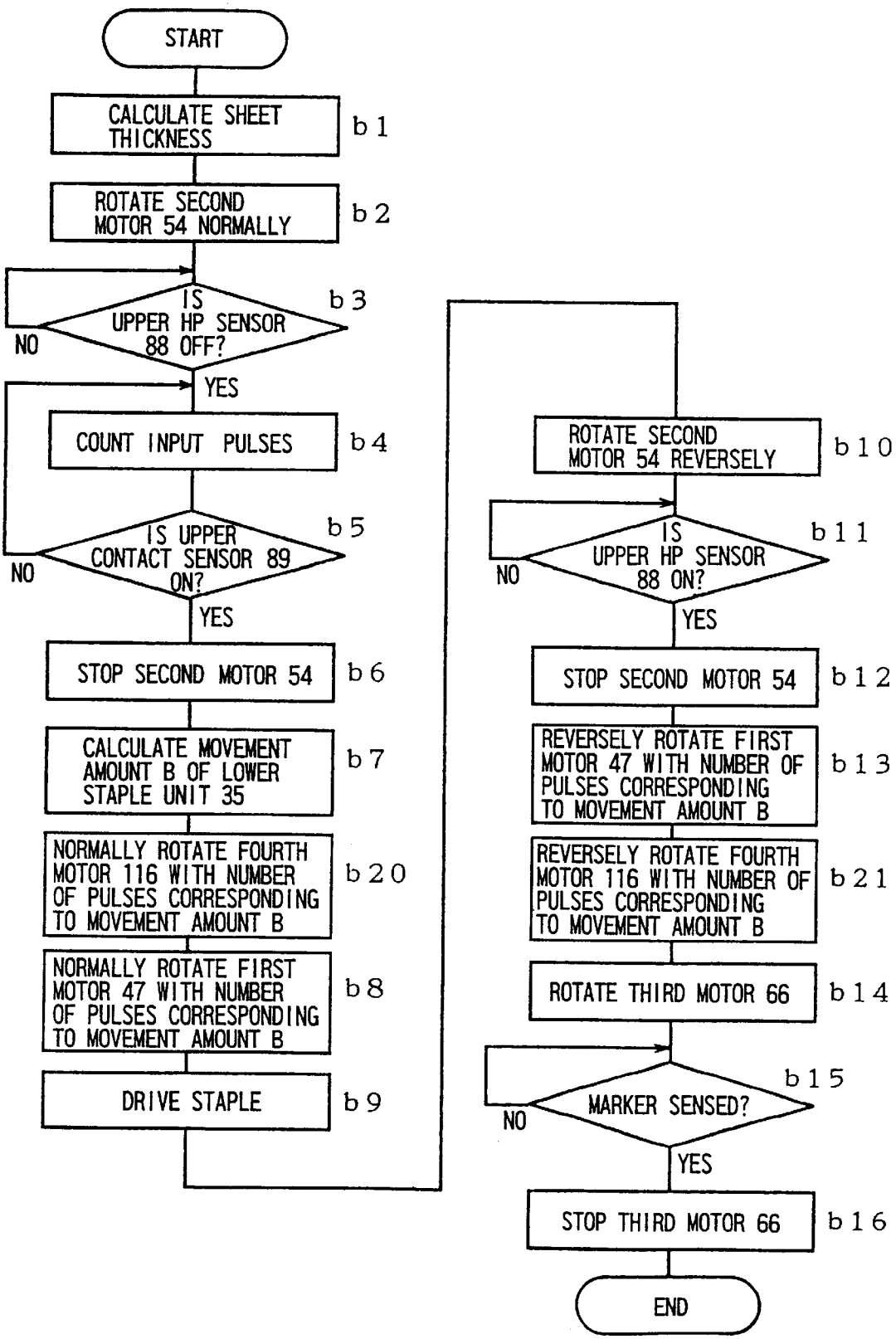
FIG. 26 is a flowchart for explaining the operation of the stapling apparatus 110.
Figure 27:
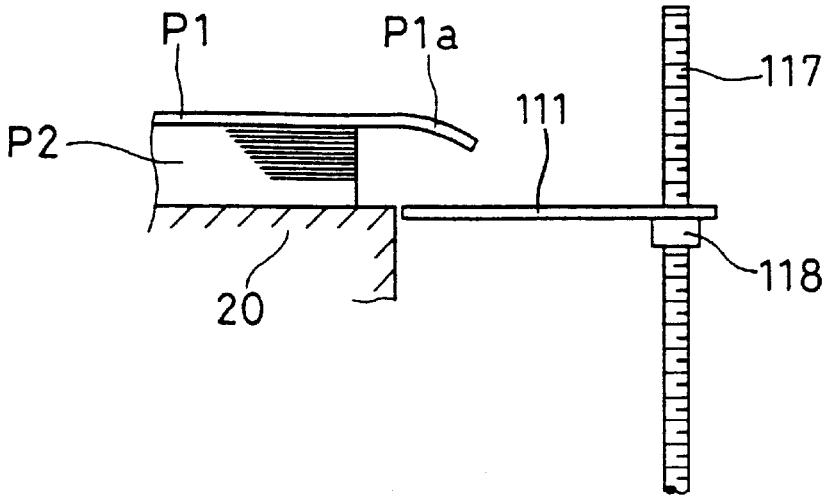
FIG. 27 is a diagram showing a state where an auxiliary tray 111 is disposed in its reference position.
Figure 28:
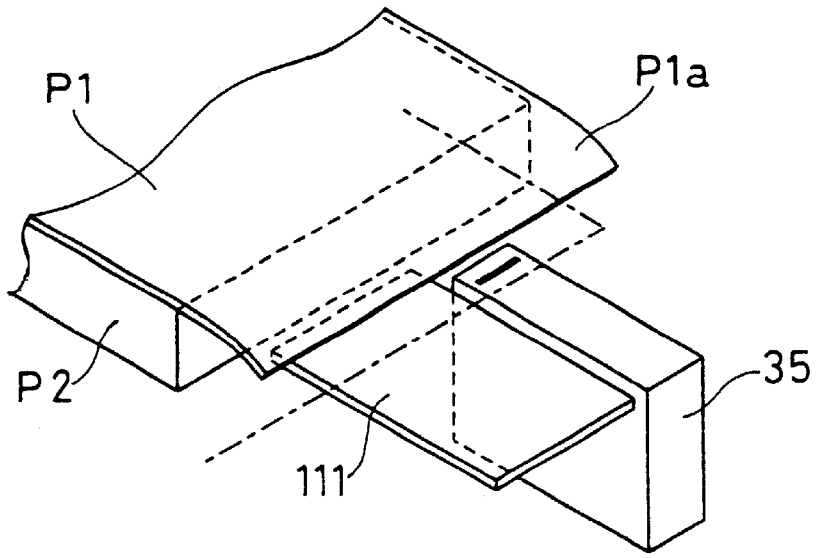
FIG. 28 is a perspective view showing a state where the lower staple unit 35 and the auxiliary tray 111 are arranged in their reference positions.
Figure 29:
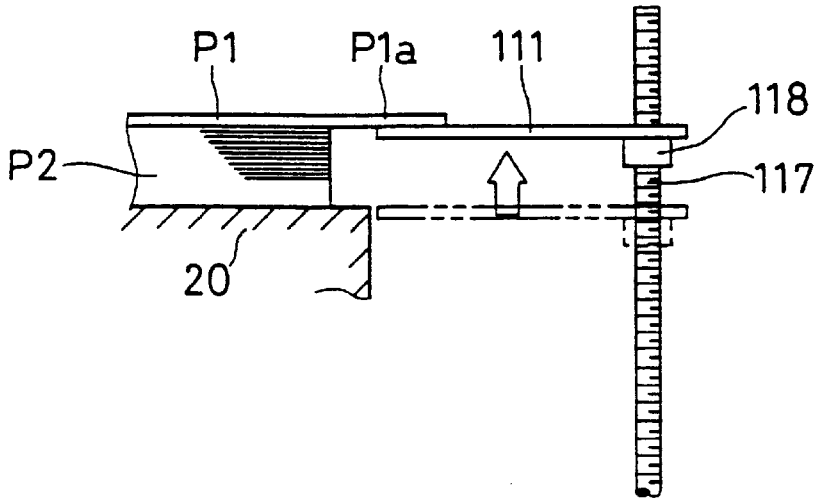
FIG. 29 is a diagram showing a state where the auxiliary tray 111 is moved.
Figure 30:
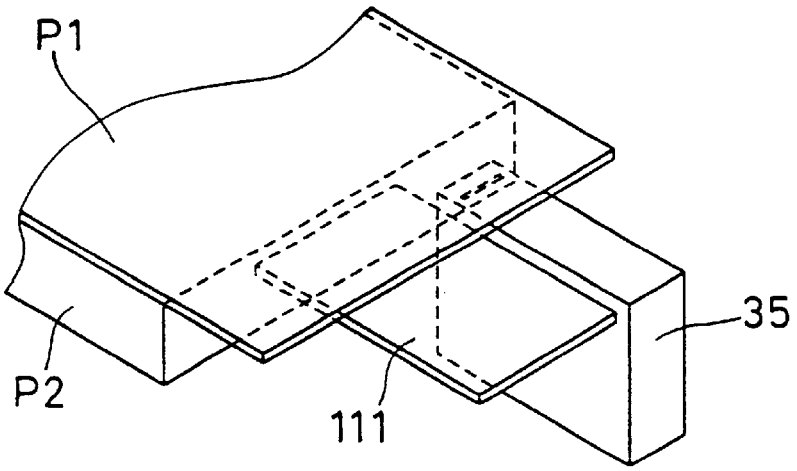
FIG. 30 is a perspective view showing a state where the lower staple unit 35 and the auxiliary tray 111 are moved.

FIG. 26 is a flowchart for explaining the operation of the stapling apparatus 110. FIG. 27 is a diagram showing a state where the auxiliary tray 111 is disposed in its reference position. FIG. 28 is a perspective view showing a state where the auxiliary tray 111 and the lower staple unit 35 are arranged in their reference positions. FIG. 29 is a diagram showing a state where the auxiliary tray 111 is moved. FIG. 30 is a perspective view showing a state where the auxiliary tray 111 and the lower staple unit 35 are moved. The operation of the stapling apparatus 110 is basically similar to that of the stapling apparatus 85. As shown in FIGS. 27 and 28, when a plurality of sheets P1 are stacked on the sheet tray 20 in the state where the auxiliary tray 111 is arranged in its reference position, the operations of steps b1 to b7 are performed to thereby calculate the thickness t1 of the stack of sheets P1, arrange the upper staple unit 36 to the uppermost sheet-surface position, and calculate the movement amount of the lower staple unit 35. At this time, the sheets P1 are placed in a state where a part of the sheets P1 is protruded from the sheet tray and lowered. The routine advances from step b7 to step b20 where the fourth motor 116 is normally rotated with the number of pulses corresponding to the calculated movement amount B. By the operation, as shown in FIGS. 29 and 30, the auxiliary tray 111 is arranged in a position obtained by adding the calculated thickness t1 of the stack of sheets P1 to the uppermost sheet-surface position. The sheets P1*a* protruded from the sheet tray 20 are therefore placed on the auxiliary tray 111 in almost parallel to the sheet tray 20.

The routine shifts from step b20 to steps b8 to b13 where, as shown in FIG. 30, the lower staple unit 35 is moved upward, the stack of sheets P1 are sandwiched by the staple units 35 and 36, the staple is driven to bind the stack of sheets P1, thereby forming the sheet bundle P2, and the staple units 35 and 36 are returned to their reference positions. The routine progresses from step b13 to step b21 where the fourth motor 116 is reversely rotated with the number of pulses corresponding to the movement amount B. By the operation, the auxiliary tray 111 is returned to its reference position as shown in FIGS. 27 and 28. The routine shifts from step b21 to steps b14 to b16 where the pusher 60 is driven to push the sheet bundle P2 away from the stapler 21 and the operation is finished. Formation of a plurality of sheet bundles P2 is realized by repeating the above operations for each sheet bundle.

Since the auxiliary tray 111 is moved to the position of the stack of sheets P1 placed on the sheet tray 20 by the auxiliary tray moving means 112 and the control circuit 76, the auxiliary tray 111 can prevent the sheets P1*a* protruded from the sheet tray 20 from being lowered at the time of driving the staple. The sheets can be bound by placing the protruded sheets P1*a* in almost parallel to the sheet tray 20.

Figure 31:
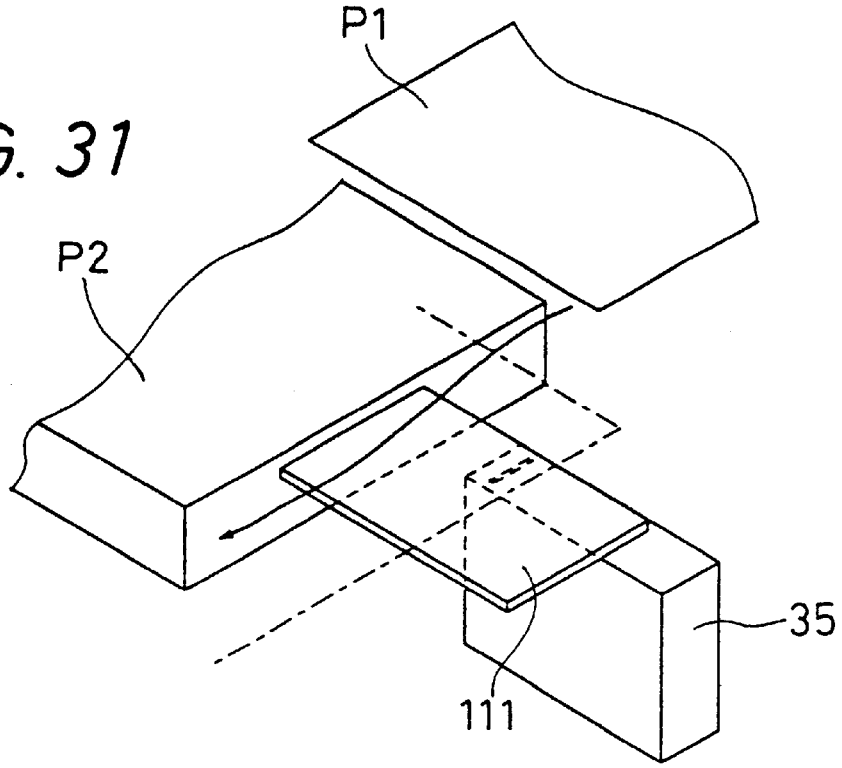
FIG. 31 is a perspective view showing a state where, before a plurality of sheets P1 are stacked on a sheet tray 20, the auxiliary tray 111 provided for a stapling apparatus as still another embodiment of the invention is moved to a same level as that of the uppermost sheet of the previous stack of sheets placed on the sheet tray 20.

FIG. 31 is a perspective view showing a state where, a plurality of sheets P1 are placed on the sheet tray 20, the auxiliary tray 111 provided for the stapling apparatus as still another embodiment of the invention is moved to a position where the plurality of sheets P1 are to be positioned when being placed on the sheet tray 20. By controlling the operation of the auxiliary tray moving means 112 of the movement controlling means, the sheet tray 20 and the auxiliary tray 111 are arranged in the same position in the sheet staking direction. Before the stack of sheets P1 are placed on the sheet tray 20, the auxiliary tray 111 is moved to the position where the sheets P1 are to be placed on the sheet tray 20 in the sheet stacking direction. For the second and subsequent sheet bundles, the operation is realized by moving the auxiliary tray 111 to the position obtained by adding the calculated thickness t1 of the stack of sheets P1 to the movement amount B for the immediately preceding sheet bundle P2 or by remaining the auxiliary tray 111 in the position without returning it to its reference position after formation of the sheet bundle P2 and moving the auxiliary tray 111 to the position obtained by adding the calculated thickness t1 of the stack of sheets P1 to the position.

Since the auxiliary tray 111 is moved to the abovementioned level before the sheets P1 are placed on the sheet tray 20, during the sheets P1 are placed on the sheet tray 20 and the staple is driven, the auxiliary tray 111 can prevent the lowering of the sheets P1*a* protruded from the sheet tray 20. Consequently, deviation of the sheets in association with the lowering can be prevented, so that the sheets can be stapled by the stapler 21 while placing the protruded sheets P1*a* almost in parallel to the sheet tray 20.

Figure 32:
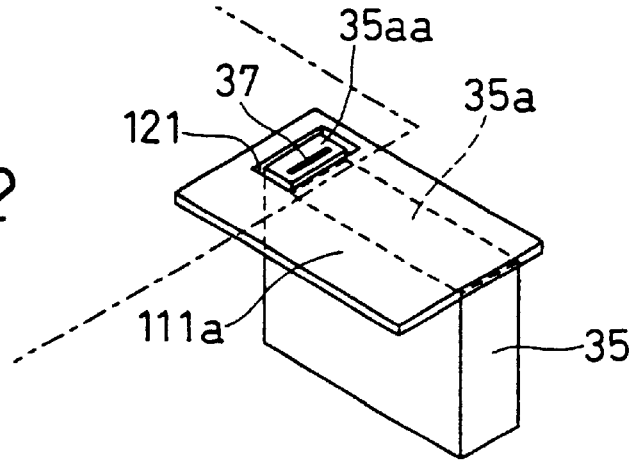
FIG. 32 is a simplified perspective view showing the construction of an auxiliary tray 111*a* provided for a stapling apparatus as further another embodiment of the invention.

FIG. 32 is a simplified perspective view showing the construction of an auxiliary tray 111*a* provided for the stapling apparatus as further another embodiment of the invention. The auxiliary tray 111*a* is disposed on the lower staple unit 35. The auxiliary tray 111*a* is provided with a through hole 121 for binding the stack of sheets P1. More specifically, the through hole 121 is provided in a position near to the sheet tray 20 of the auxiliary tray 111*a* and opens to the driving unit 37 of the lower staple unit 35. The part around the driving part 37 of the lower staple unit 35 is protruded upward only by the thickness of the auxiliary tray 111*a* from the top face 35*a* of the lower staple unit 35 except for the part near the driving part 37. By the arrangement, the part near the driving unit 37 of the lower staple unit 35 is inserted through the through hole 121 in the state where the auxiliary tray 111*a* and the lower staple unit 35 are in contact with each other, and the top face 35*aa* is flush with the top face of the auxiliary tray 111*a*. The lower staple unit 35 therefore comes into contact with the under surface of the sheet P1*a* protruded from the sheet tray 20 via the through hole 121 provided in the auxiliary tray 111*a*. The operation of the auxiliary tray 111*a* is similar to that shown in FIG. 26 and its description is omitted here.

With such a construction, the lowering of the protruded sheets P1*a* can be prevented and the staple can be vertically driven through the stack of sheets P1 while placing the part through which the staple is driven in the protruded sheets P1*a* is placed in parallel to the sheet tray 20 by the auxiliary tray 111*a*, thereby enabling the stack of sheets P1 to be securely bound.

Figure 33:
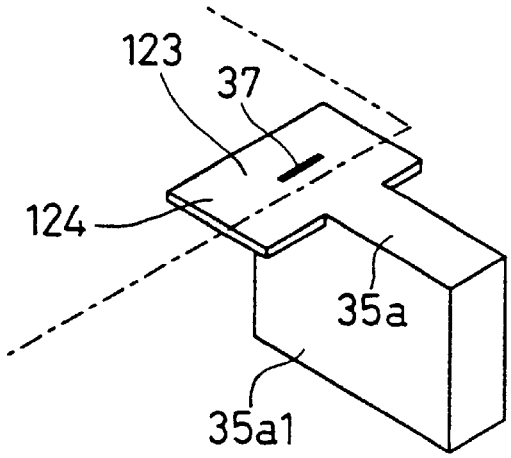
FIG. 33 is a simplified perspective view showing the construction of a lower staple unit 35*a*1 provided for a stapling apparatus as further another embodiment of the invention.
Figure 34:
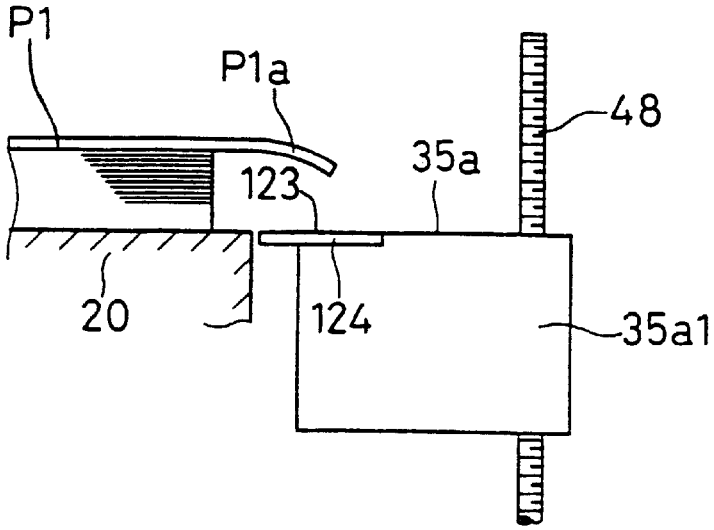
FIG. 34 is a diagram showing a state where the lower staple unit 35*a*1 is disposed in the reference position.
Figure 35:
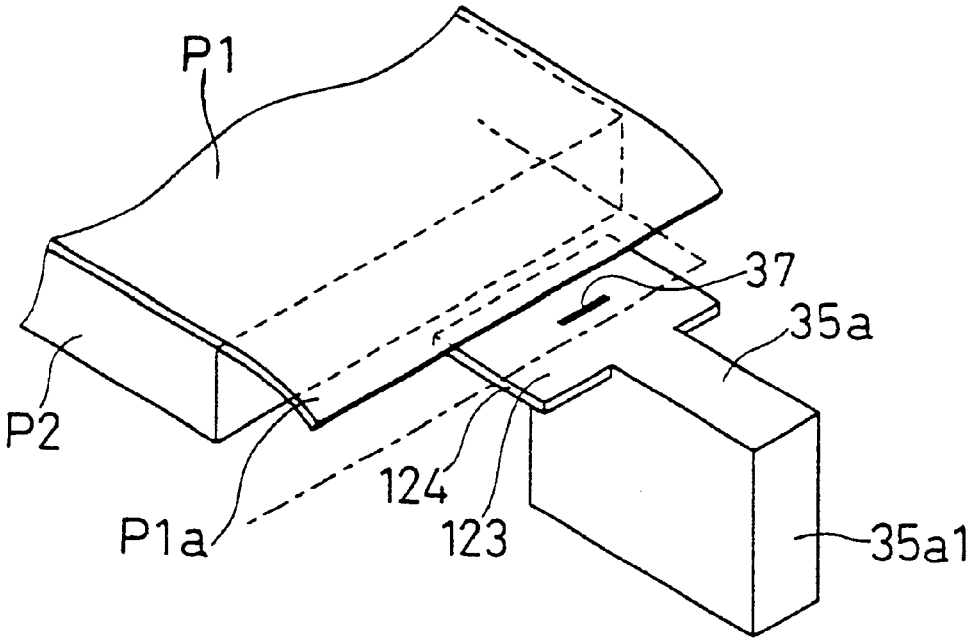
FIG. 35 is a perspective view showing a state where the lower staple unit 35*a*1 is disposed in the reference position.
Figure 36:
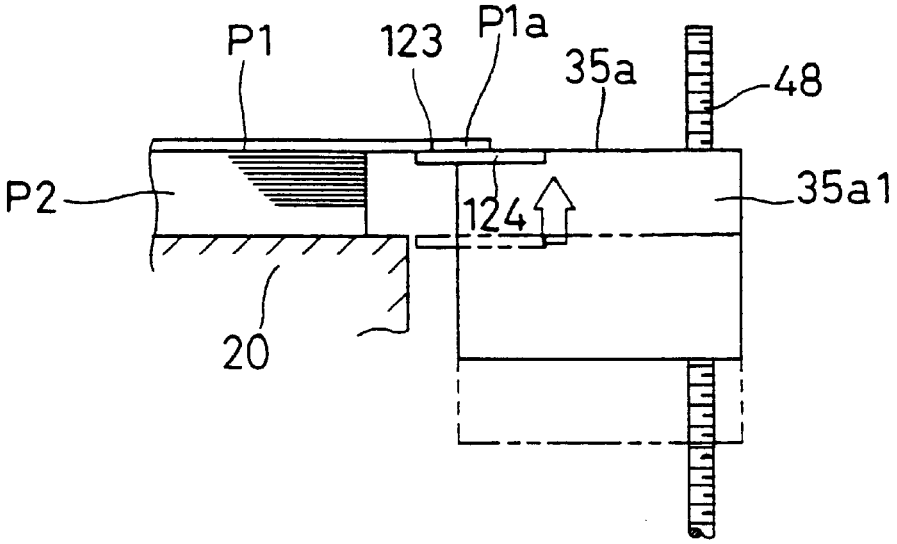
FIG. 36 is a diagram showing a state where the lower staple unit 35*a*1 is moved.
Figure 37:
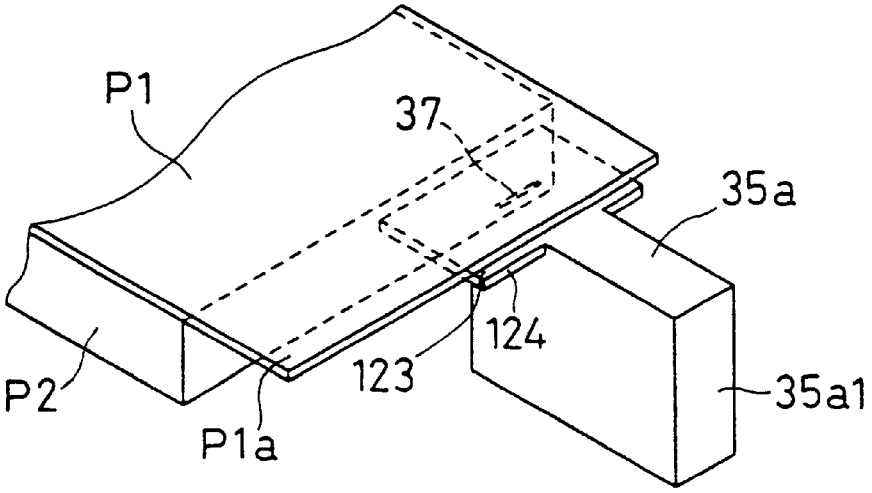
FIG. 37 is a perspective view showing a state where the lower staple unit 35*a*1 is moved.

FIG. 33 is a simplified perspective view showing the construction of a lower staple unit 35*a*1 provided for the stapling apparatus as further another embodiment of the invention. FIG. 34 is a diagram showing a state where the lower staple unit 35*a*1 is disposed in its reference position. FIG. 35 is a perspective view showing a state where the lower staple unit 35*a*1 is disposed in its reference position. FIG. 36 is a diagram showing a state where the lower staple unit 35*a*1 is moved. FIG. 37 is a perspective view showing a state where the lower staple unit 35*a*1 is moved. The construction of the lower staple unit 35*a*1 is similar to that of the lower staple unit 35 shown in FIGS. 1 to 28. Attention should be paid to a point that a supporting member 124 having a supporting face 123 which extends almost across the area of the sheets P1*a* protruded from the sheet tray 20 is provided. The supporting member 124 is formed in a plate shape and provided on the sheet tray 20 side of the lower staple unit 35*a*1 so that the supporting face 123 is flush with the top face 35*a*. In the supporting face 123, the driving part 37 of the lower staple unit 35*a*1 is disposed. The operation of the lower staple unit 35*a*1 is similar to that of the lower staple unit 35 shown in FIG. 13 and its description is omitted here.

When a stack of sheets P1 are stacked on the sheet bundle P2 placed on the sheet tray 20, as shown in FIGS. 34 and 35, the sheets P1*a* protruded from the sheet tray 20 are lowered facing the lower staple unit 35*a*1. When the lower staple unit 35*a*1 is moved upward only by the movement amount B and disposed in the position where the stack of sheets P1 are to be bound, as shown in FIGS. 36 and 37, almost all of the area of the sheets P1*a* protruded from the sheet tray 20 is supported by the supporting member 124 and the sheets P1*a* are placed in parallel to the sheet tray 20. After that, a staple is driven through the stack of sheets P1 sandwiched by the upper and lower staple units 36 and 35, the stack of sheets P1 are bound, and the sheet bundle P2 is formed.

Since the lower staple unit 35*a*1 has the supporting face 123 extending almost across the area of the protruded sheets P1*a*, the lowering of the protruded sheets P1*a* can be prevented, and the part around the position where the staple is driven through the protruded sheets P1*a* is placed in parallel to the sheet tray 20 by the supporting face 123, so that the staple can be vertically driven through the stack of sheets P1 and the stack of sheets P1 can be securely bound. Since it is unnecessary to separately provide means for moving the component for placing the protruded sheets P1*a* in the sheet stacking direction, the construction can be simplified.

Figure 38:
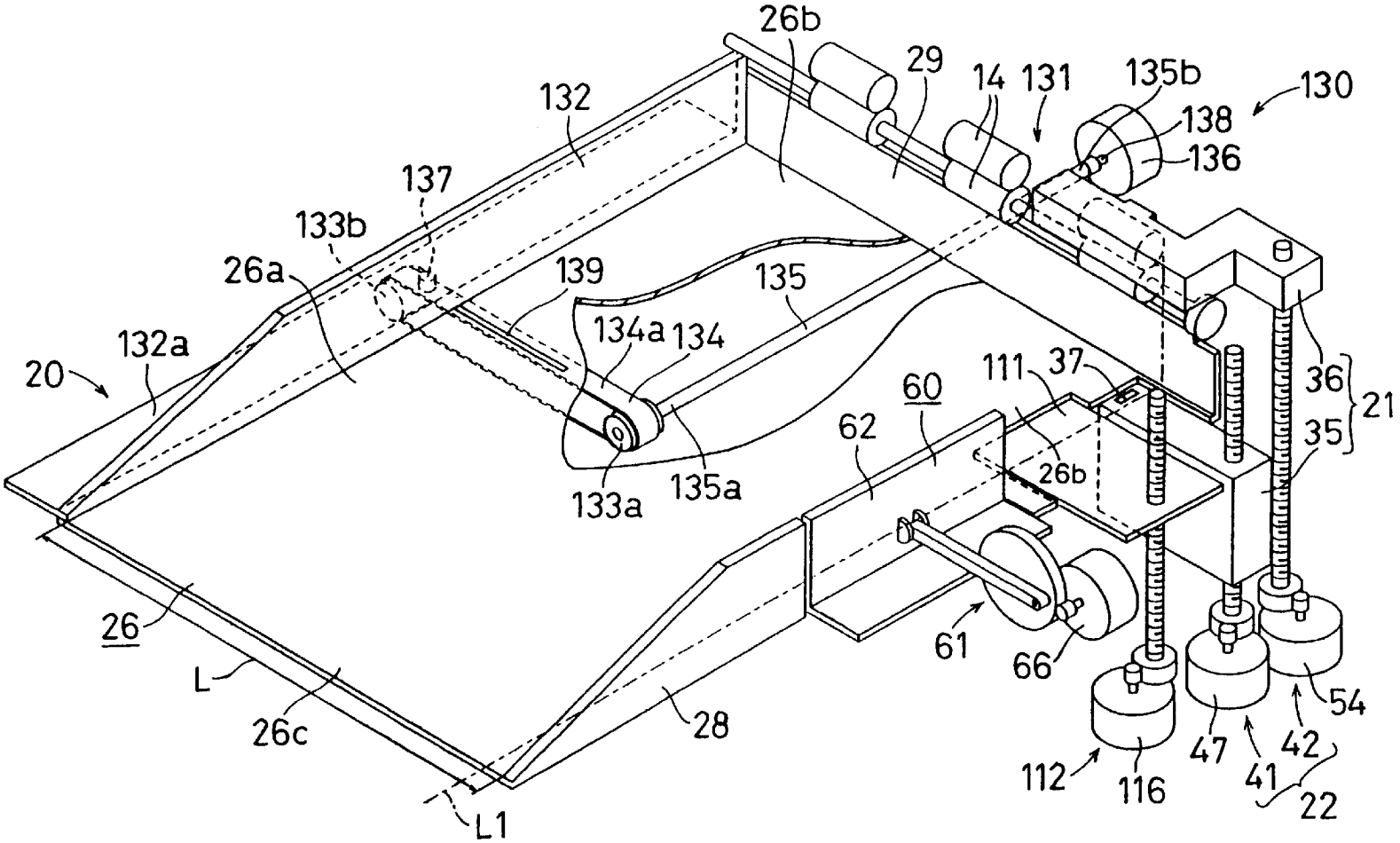
FIG. 38 is a simplified perspective view showing the construction of a stapling apparatus 130 as further another embodiment of the invention.

FIG. 38 is a simplified perspective view showing the construction of a stapling apparatus 130 as further another embodiment of the invention. In the embodiment, the same reference numerals are designated to components corresponding to those in the foregoing embodiments and their description is omitted here. The construction of the stapling apparatus 130 of the invention is similar to that of the stapling apparatus 110 shown in FIG. 24 and attention should be paid to a point that sheet bundle aligning means 131 is provided in place of the first side plate 27 of the sheet tray 20. The sheet bundle aligning means 131 is disposed in a peripheral part of the bottom plate 26 of the sheet tray 20 so as to face the pushing means 23 and aligns the sheet bundles P2 on the sheet tray 20. The sheet bundle aligning means 131 comprises a movable side plate 132, a pair of pulleys 133*a* and 133*b*, an endless belt 134, a drive shaft 135, a fifth motor 136, and a protrusion 137.

The movable side plate 132 is provided so as to face the second side plate 28 and the risen part 62 of the pusher 60 and extends from the end 26*b* upstream of the bottom plate 26 in the sheet ejecting direction to the end 26*c* on the downstream side. The pair of pulleys 133*a* and 133*b* are provided under the bottom plate 26 at an interval on the axial line in the width direction perpendicular to axial lines in parallel to the axial line in the longitudinal direction of the bottom plate 26. The axial line in the longitudinal direction of the bottom plate 26 and the rotation axial lines of the pulleys 133*a* and 133*b* are in parallel. The endless belt 134 is wound around the pulleys 133*a* and 133*b*. One end 135*a* in the longitudinal direction of the drive shaft 135 is connected to the pulley 133*a* so that the rotation axial line of the drive shaft 135 and that of the pulley 133*a* become coaxial with each other. The other end 135*b* in the longitudinal direction of the drive shaft 135 is connected to the rotary shaft 138 of the fifth motor 136 so that the rotation axial line of the drive shaft 135 and that of the fifth motor 136 become coaxial with each other. The projection 137 is formed in an upper stretched part 134*a* of the endless belt 134, the tip of the projection 137 is protruded from a long hole 139 formed in the bottom plate 26 so as to expose the endless belt 134 and is connected to the bottom 132*a* of the movable side plate 132.

When the fifth motor 136 is rotated, the movable side plate 132 is moved in directions toward and apart from the second side plate 28 and the pusher 60 via the rotary shaft 138, drive shaft 135, one of the pulleys 133, endless belt 134, and protrusion 137.

Figure 39:
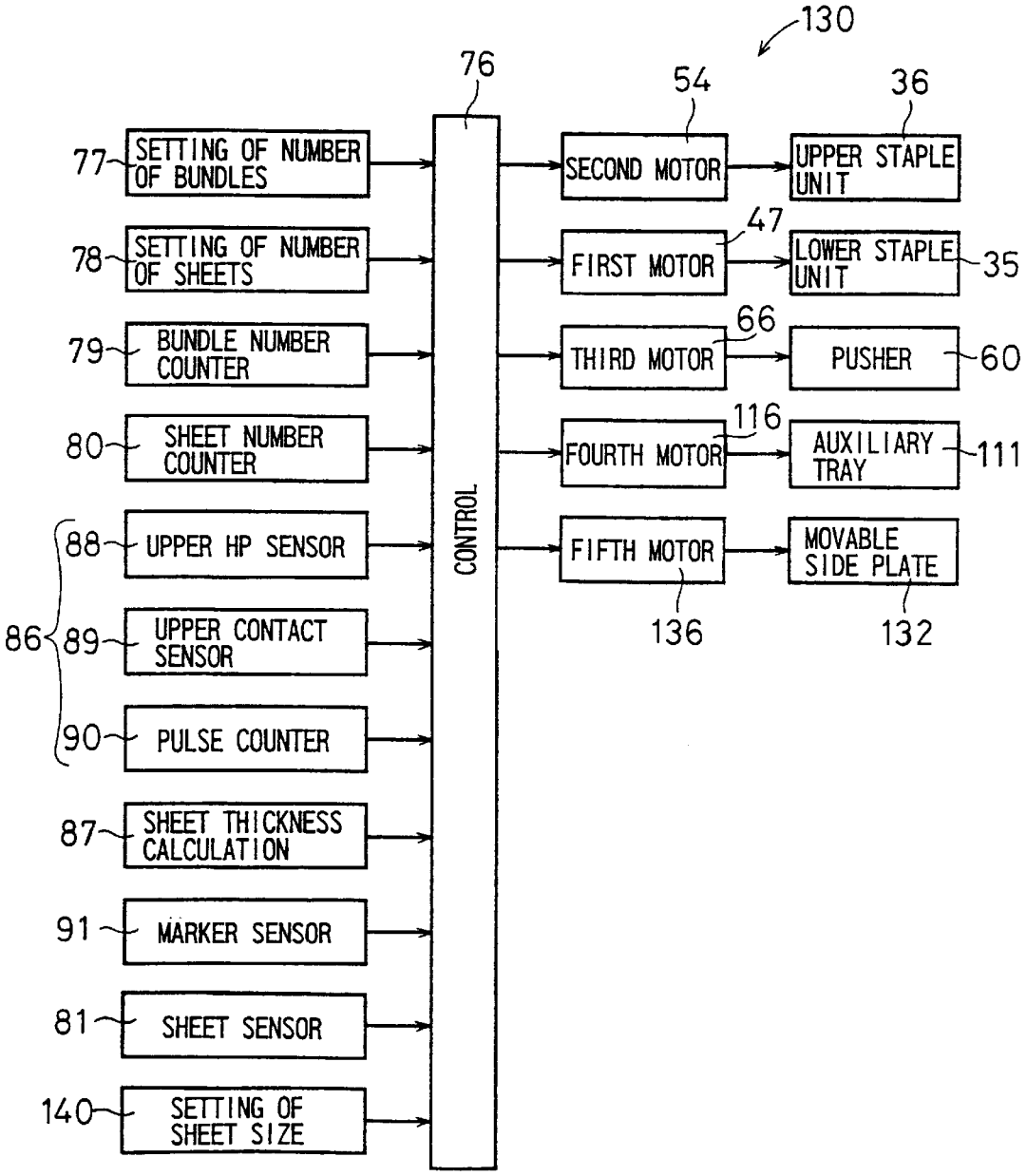
FIG. 39 is a simplified block diagram showing the electric configuration of the stapling apparatus 130.

FIG. 39 is a simplified block diagram showing the electric configuration of the stapling apparatus 130. The electric configuration of the stapling apparatus 130 of the invention is similar to that of the stapling apparatus 110 shown in FIG. 25 and attention should be paid to a point that the apparatus 110 comprises a sheet size setting unit 140. In the sheet size setting unit 140, the sheet size of the stack of sheets P1 is set.

The operation of the sheet bundle aligning means 131 is controlled by the sheet size setting unit 140 and the control circuit 76.

To the control circuit 76, output signals from the electrical components shown in FIG. 25 and also an output signal from the sheet size setting unit 140 are supplied. Control signals outputted from the control circuit 76 control the driving of the motors 47, 54, 66, and 116 shown in FIG. 25 and the driving of the fifth motor 136, instruct the lower staple unit 35 to drive the staple, and drive the sheet bundle number counter 79, the sheet number counter 80, and the pulse counter 90.

Figure 40:
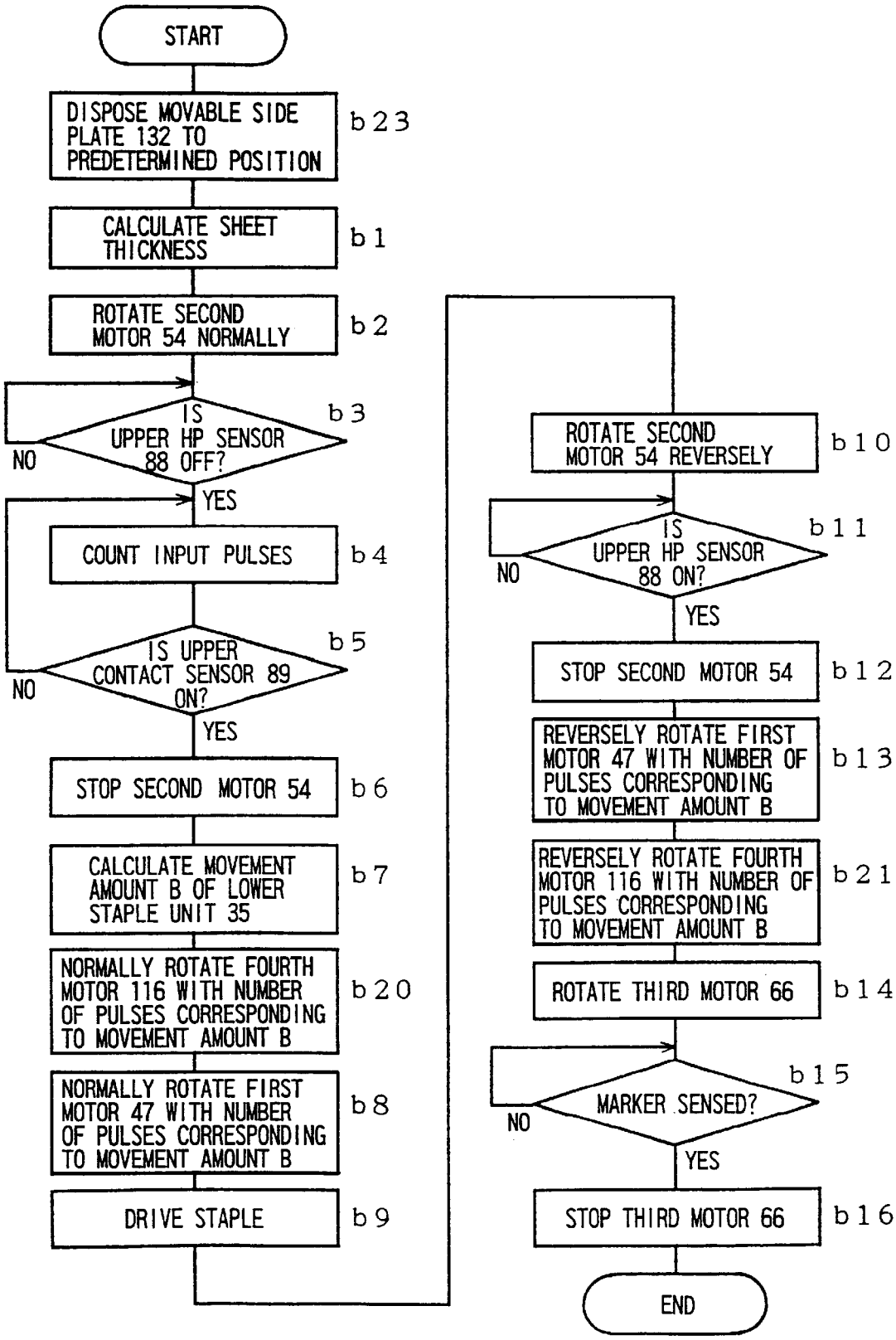
FIG. 40 is a flowchart for explaining the operation of the stapling apparatus 130.

FIG. 40 is a flowchart for explaining the operation of the stapling apparatus 130. At step b23, the movable side plate 132 is disposed in a predetermined position before the plurality of sheets P1 are placed on the sheet tray 20. More specifically, the control circuit 76 drives the fifth motor 136 so as to arrange the movable side plate 132 in the position obtained by adding the stroke of the pusher 60 to the length in the width direction of the sheet set in the sheet size setting unit 140. After that, a sheet is ejected from the laser beam printer 2 and stacked on the sheet tray 20. An operation similar to that of the stapling apparatus 110 shown in FIG. 26 is performed, thereby forming the sheet bundle P2. Formation of a plurality of sheet bundles P2 of the same sheet size can be realized by repeating the operations except for step b23 for each sheet bundle.

Since the sheet bundle aligning means 131 is disposed in the peripheral part of the sheet tray 20 so as to face the pushing means 23, the side face opposite to that on the stapler 21 side of the sheet bundle P2 pushed away from the stapler by the pushing means 23 comes into contact with the movable side plate 132 of the sheet bundle aligning means 131. Thus, the movement of the sheet bundle P2 in the sheet tray 20 can be regulated. Especially, in case of forming a plurality of sheet bundles P2, a plurality of sheet bundles P2 can be stacked, aligned, and placed on the sheet tray in a state where the plurality of sheet bundles P2 are moved away from the stapler 21. Since the movable side plate 132 of the sheet bundle aligning means 131 is arranged in the position obtained by adding the stroke of the pusher 60 to the length in the width direction of the stack of sheets P1 from the second side plate 28, even when the sheet size of the stack of sheets P1 is changed, the sheet bundle P2 is pushed away from the stapler 21 by the pusher 60 and the side face on the side opposite to the stapler 21 side of the sheet bundle P2 can be securely brought into contact with the movable side plate 132.

Figure 41:
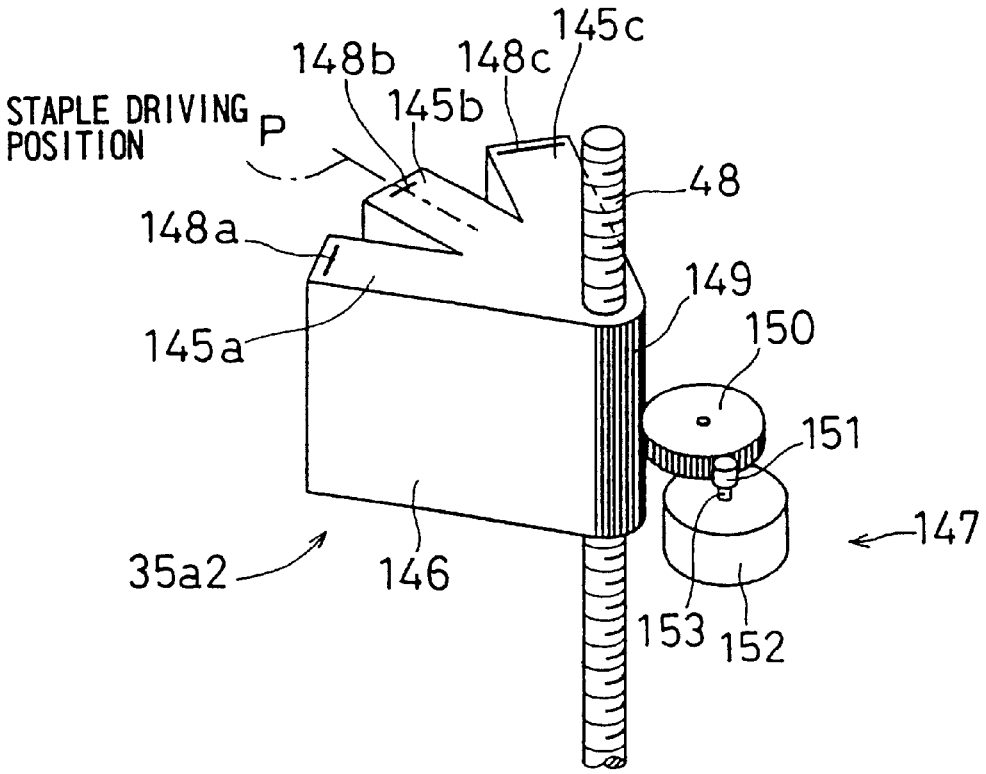
FIG. 41 is a simplified perspective view showing the construction of a lower staple unit 35*a*2 provided for a stapling apparatus as further another embodiment of the invention.

FIG. 41 is a simplified perspective view showing the construction of a lower staple unit 35*a*2 provided for the stapling apparatus as further another embodiment of the invention. In the embodiment, the same reference numerals are designated to those corresponding to the components of the foregoing embodiments and their description is omitted here. The lower staple unit 35*a*2 comprises a staple unit body 146 having a plurality (3 in the embodiment) of staple housing parts 145*a*, 145*b*, and 145*c* for respectively housing a plurality of staples of different kinds and staple changing means 147 for changing the staple in accordance with the thickness t1 of the stack of sheets P1. The staple housing parts 145*a*, 145*b*, and 145*c* are provided at intervals of, for example, 30° in the circumferential direction around the axial line of the first screw shaft 48 passing through the proximal part of the staple unit body 146. At free ends of the staple units 145*a*, 145*b*, and 145*c* of the staple unit body 146, driving parts 148*a*, 148*b*, and 148*c* for driving staples from the staple housing parts 145*a*, 145*b*, and 145*c* are provided, respectively. The staple unit body 146 is provided so that the angle can be displaced around the axial line of the first screw shaft 48 independent of the first screw shaft 48.

The stale changing means 147 comprises a toothed wheel part 149, a fifth toothed wheel 150, a fifth pinion 151, and a sixth motor 152. The toothed wheel part 149 is formed in a part of the outer periphery of the proximal part of the staple unit body 146. The fifth toothed wheel 150 is interposed between the toothed wheel part 149 and the fifth pinion 151 provided at the tip of the rotary shaft 153 of the sixth motor 152 and meshes with the toothed wheel part 149 and the fifth pinion 151.

The sixth motor 152 displaces the angle of the staple unit body 146 via the rotary shaft 153, the fifth pinion 151, the fifth toothed wheel 150, and the toothed wheel part 149. By the arrangement, one of the driving parts 148*a*, 148*b*, and 148*c* corresponding to the selected staple in the staple unit body 146 is disposed in a staple driving position P facing the bending part 38 of the upper staple unit 36.

Figure 42:
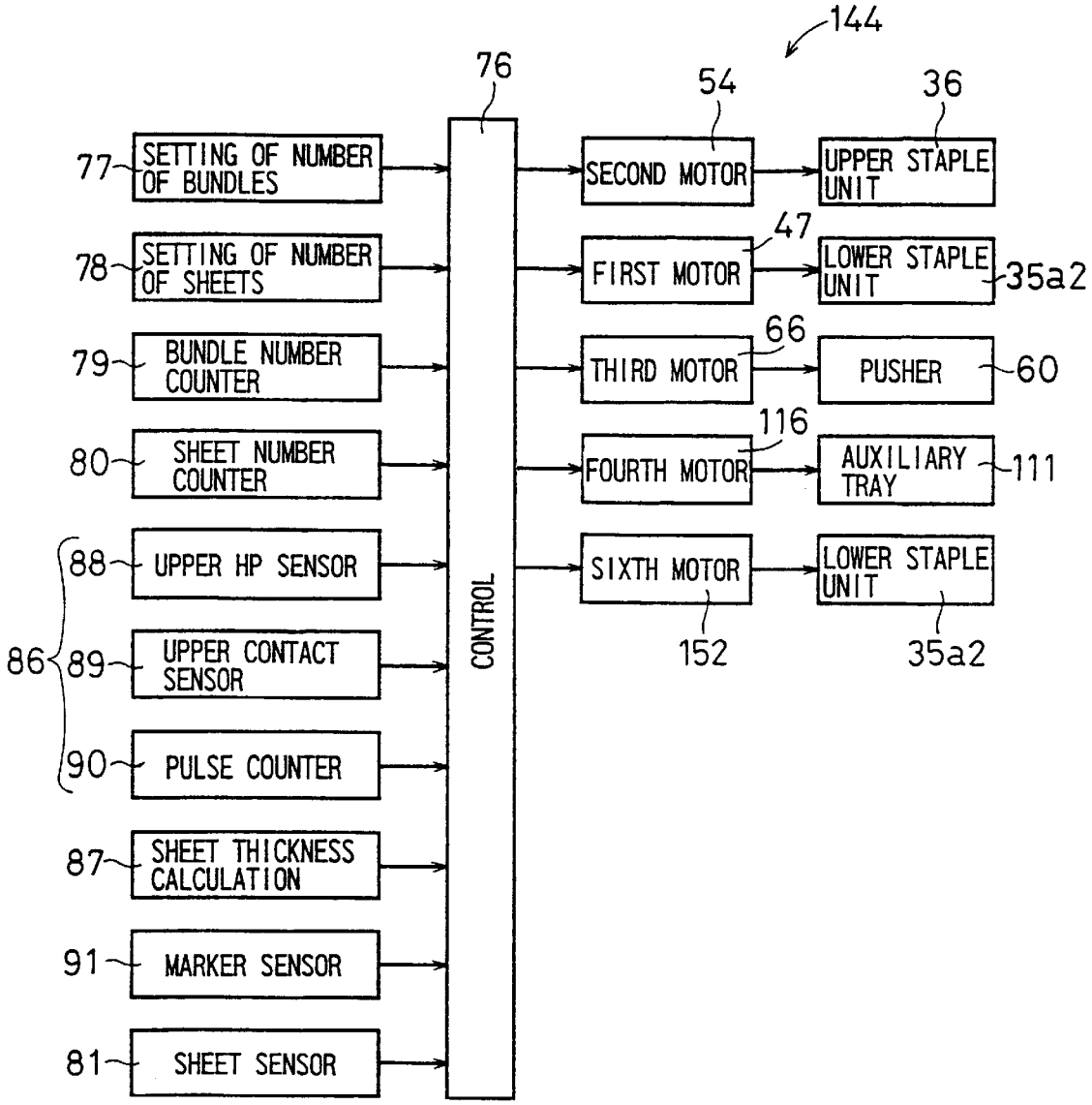
FIG. 42 is a simplified block diagram showing the electric configuration of a stapling apparatus 144 having the lower staple unit 35*a*2.

FIG. 42 is a simplified block diagram showing the electric configuration of a stapling apparatus 144 having the lower staple unit 35*a*2. The electric configuration of the stapling apparatus 144 of the invention is similar to that of the stapling apparatus 110 shown in FIG. 25 and the description of the output signals supplied to the control circuit 76 is omitted here. The operation of the staple changing means 147 is controlled by the stack of sheets thickness calculating means 87 and the control circuit 76. Control signals outputted from the control circuit 76 control the driving of the first, second, third, and fourth motors 47, 54, 66, and 116 shown in FIG. 25 and also control the driving of the sixth motor 152. The control signals also instruct the lower staple unit 35*a*2 to perform the staple driving operation and drive the sheet bundle number counter 79, the sheet number counter 80, and the pulse counter 90.

Figure 43:
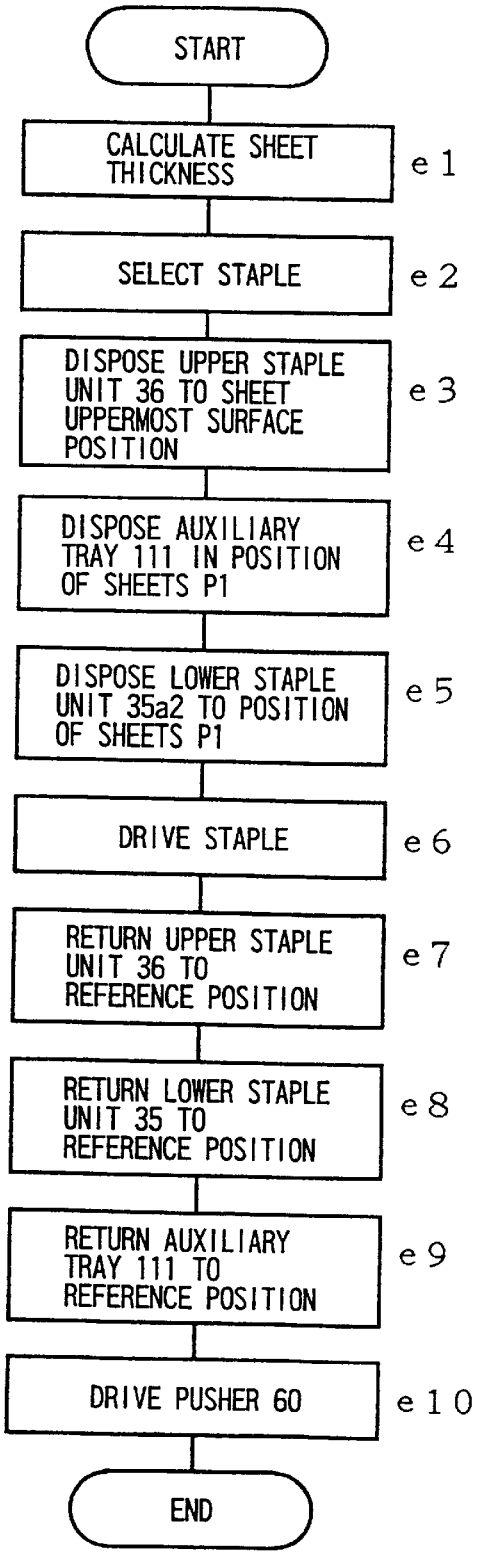
FIG. 43 is a flowchart for explaining the operation of the stapling apparatus 144.

FIG. 43 is a flowchart for explaining the operation of the stapling apparatus 144. When a plurality of sheets P1 are stacked on the sheet tray 20, at step e1, the thickness t1 of the stack of sheets P1 is calculated by the stack of sheets thickness calculating means 87 in a manner similar to the step b1 shown in FIG. 26. The routine advances from step e1 to step e2 where a staple according to the calculated thickness t1 of the stack of sheets P1 is selected. To be more specific, the control circuit 76 controls the driving of the sixth motor 152 to dispose one of the staple housing parts 145*a*, 145*b*, and 145*c* in which the corresponding staples are housed in the staple driving position P. The routine shifts from step e2 to step e3 where the upper staple unit 36 is disposed in the position of the uppermost sheet-surface by executing operations similar to those at steps b2 to b6 shown in FIG. 26. The routine advances from step e3 to step e4 where operations similar to those at steps b7 and b20 in FIG. 26 are performed to thereby dispose the auxiliary tray 111 in the position where the stack of sheets P1 are to be bound, that is, the position obtained by adding the calculated thickness t1 of the stack of sheets P1 to the position on the uppermost sheet-surface.

The routine advances from step e4 to step e5 where an operation similar to that of step b8 in FIG. 26 is performed to thereby dispose the lower staple unit 35*a*2 to the position obtained by adding the calculated thickness t1 of the stack of sheets P1 to the position of the uppermost sheet-surface. The routine progresses from step e5 to step e6 where an operation similar to that of step b9 in FIG. 26 is performed. The staple is driven through the stack of sheets P1 and the stack of sheets P1 are bound, thereby forming the sheet bundle P2. The routine advances from step e6 to step e7 where operations similar to those of steps b10 to b12 in FIG. 26 are executed to thereby return the upper staple unit 36 to its reference position. The routine advances from step e7 to step e8 where an operation similar to that of step b13 in FIG. 26 is performed to thereby return the lower staple unit 35*a*2 to its reference position. The routine advances from step e8 to step e9 where an operation similar to that of step b21 in FIG. 26 is performed to return the auxiliary tray 111 to its reference position. The routine shifts from e9 to step e10 where operations similar to those at steps e14 to e16 in FIG. 26 are performed so that the pusher 60 is driven and the sheet bundle P2 is pushed away from the staple 21, and the operation is finished.

Formation of a plurality of sheet bundles P2 each having the different number of sheets is realized by repeating the operations of steps e1 to e10 for each sheet bundle. Formation of a plurality of sheet bundles P2 of the same number of sheets is realized by repeating the operations of steps e3 to e10 for each sheet bundle. By performing the operations of steps e3 to e10, the staple selected for the first sheet bundle is selected for the second and subsequent sheet bundles.

Since the stapler 21 changes the staple according to the thickness of the stack of sheets P1 by the staple changing means 147, the stack of sheets P1 can be securely bound by the staple optimum to the thickness of the stack of sheets P1. The stack of sheets P1 having a thickness of a wide range can be securely bound.

When a plurality of sheet bundles P2 of the same number of sheets are formed, the thickness t1 of the stack of sheets P1 of each sheet bundle is the same. Consequently, by selecting the staple of the same kind as that selected for the first sheet bundle by the staple changing means 147 for the second and subsequent sheet bundles, it is unnecessary to perform the operation of the staple changing means 147 for each sheet bundle, so that the processing speed of forming the sheet bundles P2 can be increased.

Figure 44:
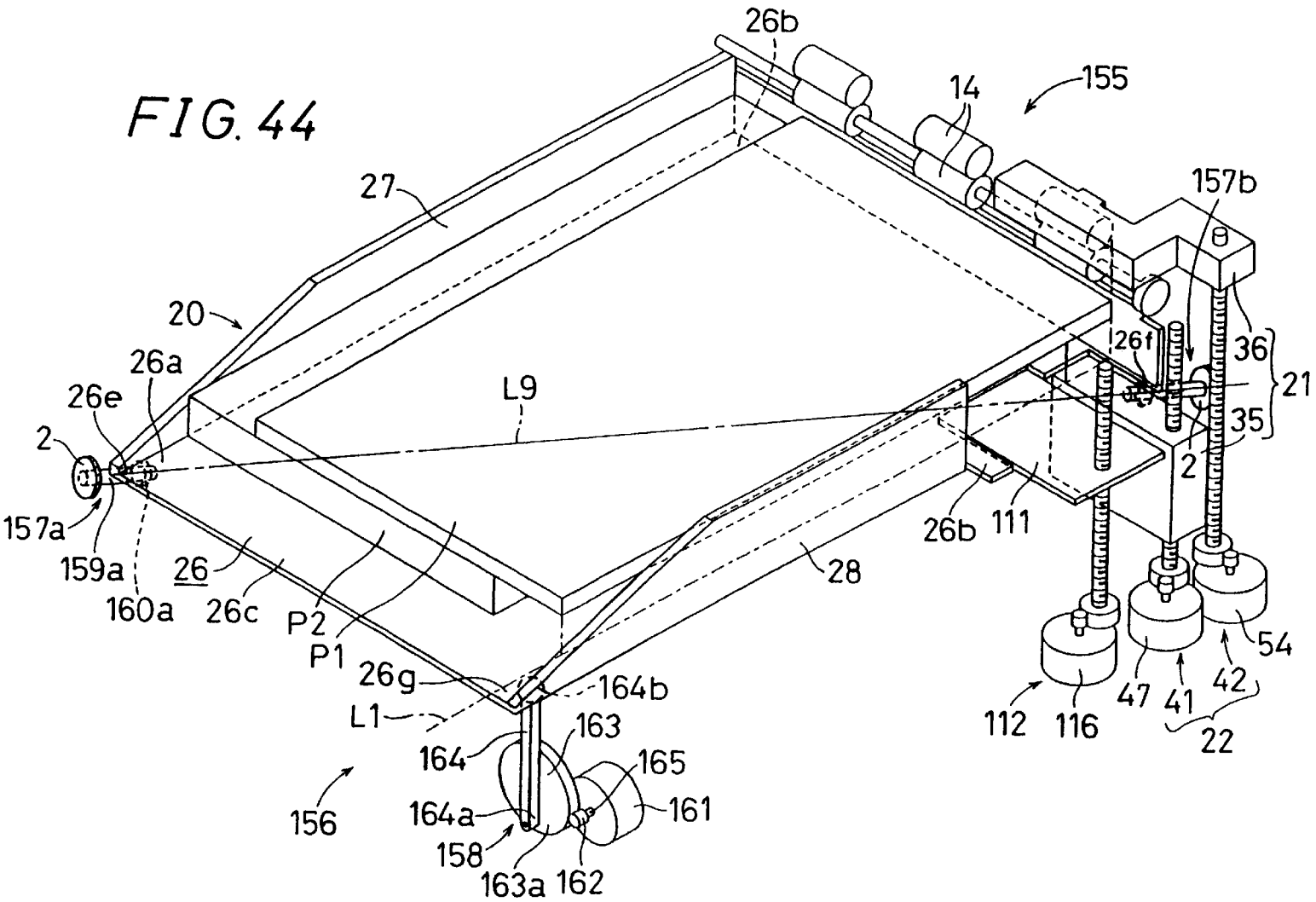
FIG. 44 is a simplified perspective view showing the construction of a stapling apparatus 155 as further another embodiment of the invention.

FIG. 44 is a simplified perspective view showing the construction of a stapling apparatus 155 as further another embodiment of the invention. In the embodiment, the same reference numerals are designated to components corresponding to those in the foregoing embodiments and their description is omitted here. The stapling apparatus 155 comprises the sheet tray 20, stapler 21, moving means 22, auxiliary tray 111, auxiliary tray moving means 112, and an inclining means 156. The stapler 21 is disposed in the peripheral part of the sheet tray 20 and close to the end 26*b* upstream in the sheet ejecting direction of the bottom plate 26 and the other end 26*d* in the width direction. The auxiliary tray 111 is disposed in the peripheral part of the sheet tray 20 between the stapler 21 and the second side plate 28. The lower staple unit 35 of the stapler 21 and the auxiliary tray 111 are provided so as to pass through the notch 30 in the bottom plate 26. The lower staple unit moving means 41, the upper staple unit moving means 42, and the auxiliary tray moving means 112 are fixed to the sheet tray 20.

The inclining means 156 comprises a pair of supporting means 157*a* and 157*b* for supporting the sheet tray 20 inclinably and an inclination driving means 158 for making the sheet tray 20 supported by the pair of supporting means 157*a* and 157*b* inclined. The one supporting means 157*a* comprises: one supporting shaft 159*a* provided under the bottom plate 26 near a first corner 26*e* at the end 26*c* downstream in the sheet ejecting direction of the bottom plate 26 and one end 26*a* in the width direction and fixed to the laser beam printer 2; and one bracket 160*a* which is provided at the first corner 26*e* under the bottom plate 26 and axially supports the support shaft 159*a*. The other supporting means 157*b* includes: the other supporting shaft 159*b* provided under the bottom plate 26 near a second corner 26*f* on the end 26*b* upstream in the sheet ejecting direction of the bottom plate 26 and the other end 26*d* in the width direction and fixed to the laser beam printer 2; and the other bracket 160*b* which is provided at the second corner 26*f* under the bottom plate 26 and axially supports the other supporting shaft 159*b*. The supporting shafts 159*a* and 159*b* are provided so that their axial lines are coaxial with an inclination axial line L9 parallel to the diagonal axial line of the bottom plate 26 connecting the first corner 26*e* and the second corner 26*f*. By the arrangement, the sheet tray 20 is supported by the supporting means 157*a* and 157*b* inclinably around the inclination axial line L9.

The inclination driving means 158 is provided under the bottom plate 26 at a third corner 26*g* on the end 26*c* downstream of the sheet ejecting direction of the bottom plate 26 and the other end 26*b* in the width direction and comprises a seventh motor 161, a sixth pinion 162, a sixth toothed wheel 163, and a coupling rod 164. The sixth pinion 162 is provided at the tip of the rotary shaft 165 of the seventh motor 161. The sixth pinion 162 meshes with the sixth toothed wheel 163. In a peripheral part of the side face 163*a* perpendicular to the rotation axial line of the sixth toothed wheel 163, one end 164*a* in the longitudinal direction of the coupling rod 164 is connected by a pin. The other end 164*b* in the longitudinal direction of the coupling rod 164 is formed in an almost ball shape and slidably coupled to a receiving part (not shown) provided at the third corner 26*g* under the bottom plate 26. A marker (not shown) indicative of the reference position of the coupling part between the sixth toothed wheel 163 and the coupling rod 164 is provided on the side face 163*a* of the sixth toothed wheel 163.

The seventh motor 161 rotates the sixth toothed wheel 163 via the rotary shaft 165 and the sixth pinion 162. When one rotation of the sixth toothed wheel 163 is made, the third corner 26*g* of the sheet tray 20 is lifted by a predetermined stroke via the coupling rod 164.

The reference position of the sheet tray 20 is the position where the bottom late 26 is arranged horizontally. The reference position of the coupling part between the sixth toothed wheel 163 and the coupling rod 164 is the position where the one end 164*a* in the longitudinal direction of the coupling rod 164 is arranged just below the other end 164*b* in the longitudinal direction in a state where the sheet tray 20 is arranged in the reference position. Consequently, when one rotation of the sixth toothed wheel 163 is made, the third corner 26*g* of the sheet tray 20 is lifted by the predetermined stroke from the reference position via the coupling rod 164. The sheet tray 20 is inclined at an angle of, for example, 30° to 60°, preferably 45° to the horizontal face.

When the inclination axial line L9 of the sheet tray 20 and the axial line of the pin connecting the sixth toothed wheel 163 and the end 164*a* in the longitudinal direction of the coupling rod 164 cross each other, a shearing force by torsion moment occurs between the other end 164*b* in the longitudinal direction of the coupling rod 164 and the receiving part in association with the inclining operation of the sheet tray 20. Since the other end 164*b* in the longitudinal direction of the coupling rod 164 is formed in an almost ball shape and is slidably connected to the receiving part, the torsional moment does not act on the coupling rod 164 and the coupling rod 164 is not damaged. Irrespective of the state where the axial line of the pin and the inclination axial line L9 of the sheet tray 20 cross each other or not, the inclination driving means 158 can therefore incline the sheet tray 20.

Figure 45:
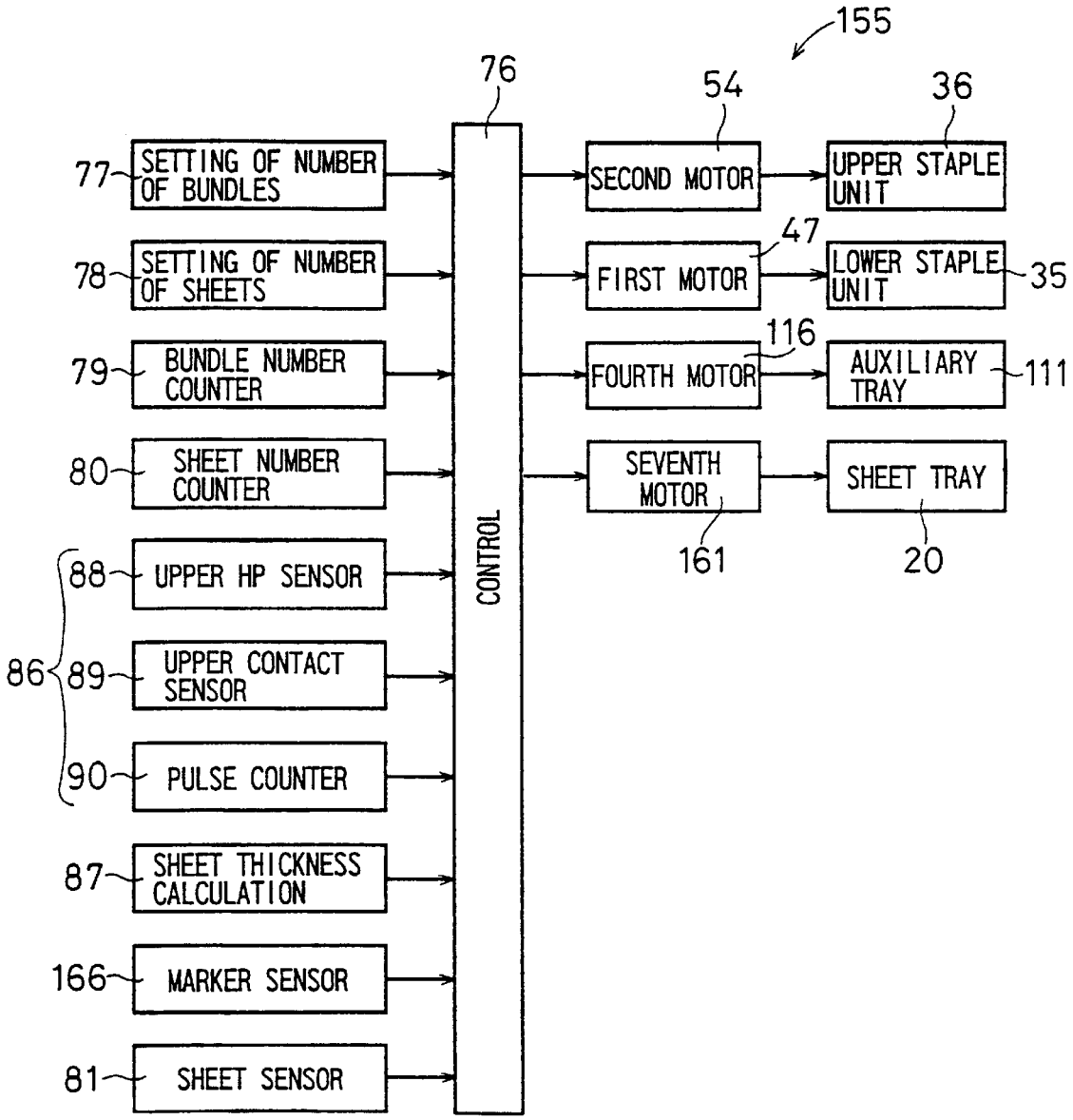
FIG. 45 is a simplified block diagram showing the electric configuration of the stapling apparatus 155.

FIG. 45 is a simplified block diagram showing the electric configuration of the stapling apparatus 155. The electric configuration of the stapling apparatus 155 of the invention is similar to that of the stapling apparatus 110 shown in FIG. 25. Attention should be paid to a point that the operation of the inclination driving means 158 is controlled by inclination controlling means including a marker sensor 166 and the control circuit 76. The marker sensor 166 is provided on the side facing a marker provided for the sixth toothed wheel 163 and is realized by, for example, a reflection type photointerrupter. To the control circuit 76, output signals as shown in FIG. 25 are supplied and an output signal from the marker sensor 166 is supplied. Control signals outputted from the control circuit 76 control the driving of the first, second, and fourth motors 47, 54, and 116 and the driving of the seventh motor 161 of the inclination driving means 158. The control signals instruct the lower staple unit 35 to perform the staple driving operation and drive the sheet bundle number counter 79, the sheet number counter 80, and the pulse counter 90.

Figure 46:
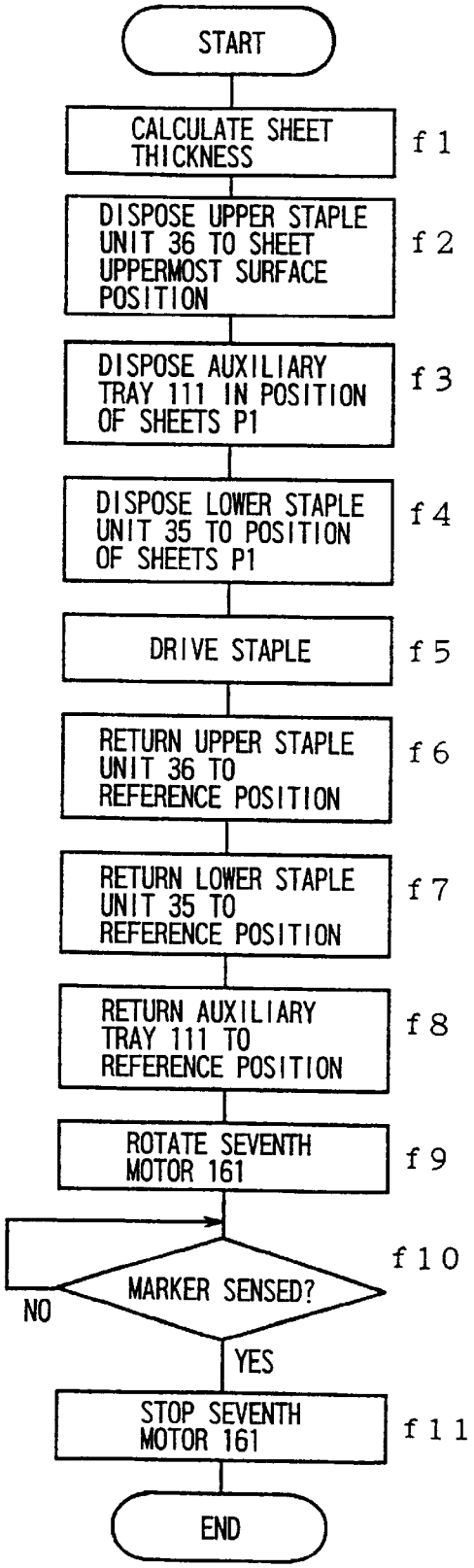
FIG. 46 is a flowchart for explaining the operation of the stapling apparatus 155.

FIG. 46 is a flowchart showing the operation of the stapling apparatus 155. The operation of the stapling apparatus 155 is similar to that of the stapling apparatus 110 shown in FIG. 26. When the plurality of sheets P1 are stacked on the sheet tray 20, at step f1, an operation similar to that of step b1 in FIG. 26 is performed to thereby calculate the thickness t1 of the stack of sheets P1 by the stack of sheets thickness calculating means 87. The routine advances from step f1 to step f2 where the upper staple unit 36 is arranged in the position of the uppermost sheet-surface by executing operations similar to those at steps b2 to b6 in FIG. 26. The routine advances from step f2 to step f3 where the auxiliary tray 111 is arranged in the position of the stack of sheets P1, that is, the position obtained by adding the calculated thickness t1 of the stack of sheets P1 to the position of the uppermost sheet-surface by performing operations similar to those at steps b7 and b20 in FIG. 26. The routine advances from step f3 to step f4 where an operation similar to that of step b8 in FIG. 26 is performed to thereby dispose the lower staple unit 35 to the position where the stack of sheets P1 are to be bound, that is, the position obtained by adding the calculated thickness t1 of the stack of sheets P1 to the position of the uppermost sheet-surface.

The routine advances from step f4 to step f5 where the staple is driven through the stack of sheets P1, the stack of sheets P1 are bound, and the sheet bundle P2 is formed by executing an operation similar to that of step b9 in FIG. 26. The routine advances from step f5 to f6 where the upper staple unit 36 is returned to its reference position by performing operations similar to those at steps b10 to b12 in FIG. 26. The routine shifts from step f6 to step f7 where the lower staple unit 35 is returned to its reference position by executing an operation similar to that of step b13 in FIG. 26. The routine advances from step f7 to step f8 where the auxiliary tray 111 is returned to its reference position by performing an operation similar to that of step b21 in FIG. 26.

The routine advances from step f8 to step f9 where the seventh motor 161 is rotated. The routine shifts from step f9 to step f10 where whether the marker sensor 166 has sensed the marker or not is determined. More specifically, when the marker sensor 166 has not sensed the marker, the routine is returned to step f10. When the marker sensor 166 has sensed the marker, the routine advances to step f11 where the driving of the seventh motor 161 is stopped. Specifically, the sixth toothed wheel 163 is rotated, the coupled part of the sixth toothed wheel 163 and the coupling rod 164 is moved from the reference position in the circumferential direction, and the third corner 26*g* of the sheet tray 20 is moved upward from the reference position of the sheet tray 20. Consequently, the sheet tray 20 is inclined around the inclination axial line by the angular displacement, the formed sheet bundle P2 placed on the sheet tray 20 is moved in the direction toward the first side plate 27 and the end plate 29 as sheet bundle contacting members, and the side face opposite to that on the stapler 21 side of the sheet bundle P2 and the end face facing the end plate 29 come into contact with the first side plate 27 and the end plate 29, respectively. When the coupled part reaches the uppermost position higher than the reference position, the sheet tray 20 is inclined at an angle of, for example, 45° to the horizontal face. After the inclined part passes the uppermost position, the third corner 26*g* of the sheet tray 20 is moved downward. In such a manner, the sheet tray 20 is returned to its reference position and the operation is finished.

Formation of a plurality of sheet bundles P2 is realized by repeating the operations of steps f1 to f11 for each sheet bundle. The stack of sheets P1 of the second and subsequent sheet bundles are placed near to the stapler 21 side so as to be deviated from the sheet bundle P2 moved away from the stapler 21.

Since the sheet tray 20 is inclined by the inclining means 156 and the inclination controlling means in the direction toward the first side plate 27 and the end plate 29, the sheet bundle P2 can be moved away from the stapler 21. Consequently, the stack of sheets P1 of the second and subsequent sheet bundles are placed near to the staple 21 side so as to be deviated from the sheet bundles P2 moved away from the stapler 21. The stapler 21 can therefore move in the sheet stacking direction without interfering with the formed sheet bundle P2 and a plurality of sheet bundles P2 can be formed. The sheet tray 20 includes the first side plate 27 and the end plate 29 in its peripheral part. When the sheet tray 20 is inclined, the sheet bundle P2 moved away from the stapler 21 comes into contact with the first side plate 27 and the end plate 29, thereby enabling the movement of the sheet bundle P2 on the sheet tray 20 to be regulated. Especially, in case of forming a plurality of sheet bundles P2, the plurality of sheet bundles P2 can be stacked, aligned, and placed on the sheet tray 20 by the first side plate 27 and the end plate 29 in the state where the plurality of sheet bundles P2 are moved away from the stapler 21. Since the sheet tray 20 is inclined around the inclination axial line L9 which crosses the axial line in the longitudinal direction of the bottom plate 26, the movement of the sheet bundle P2 and the alignment of the sheet bundles P2 can be simultaneously performed by a single inclining operation, so that the construction can be simplified.

Figure 47:
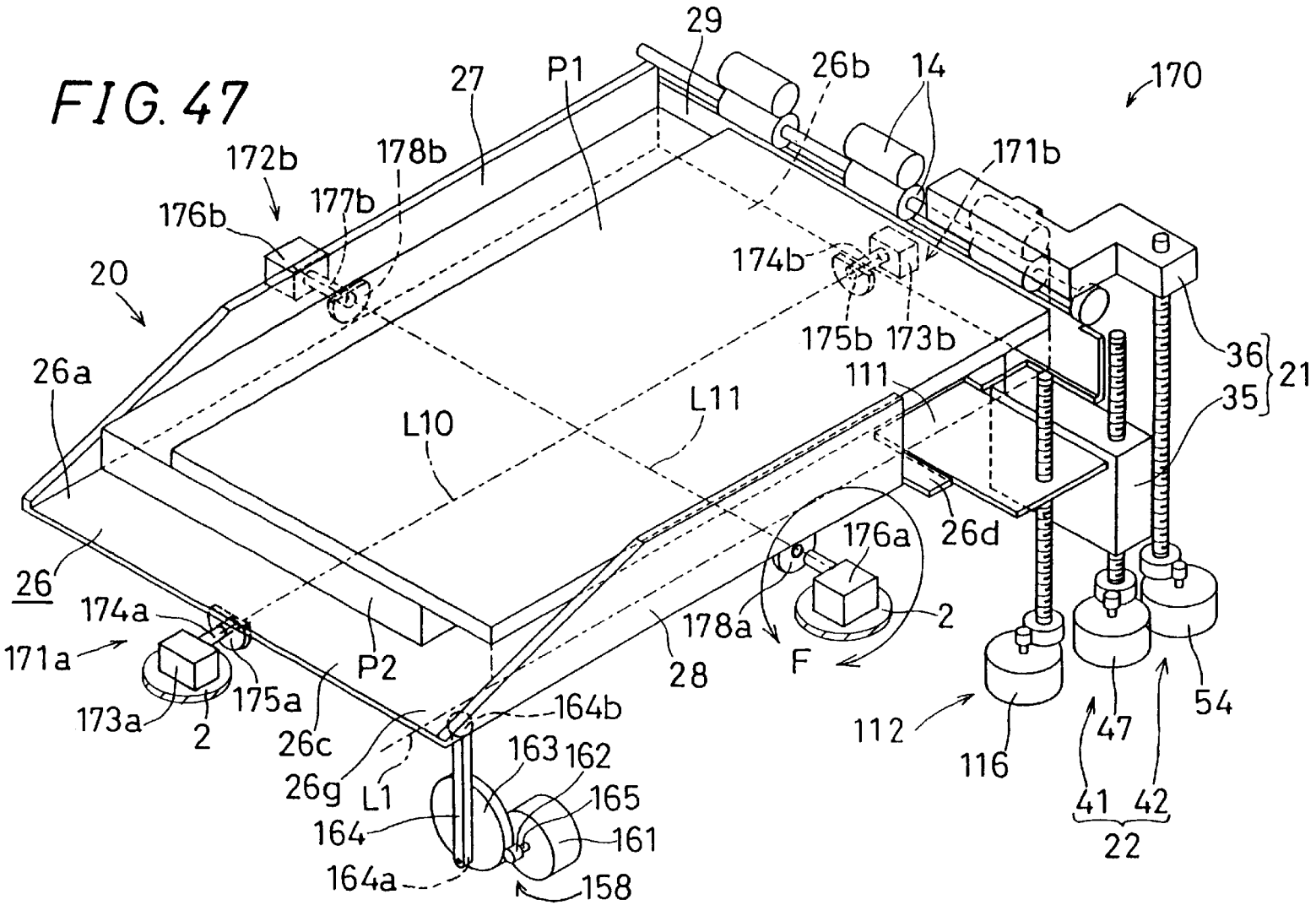
FIG. 47 is a simplified perspective view showing the construction of a stapling apparatus 170 as further another embodiment of the invention.
Figure 48:
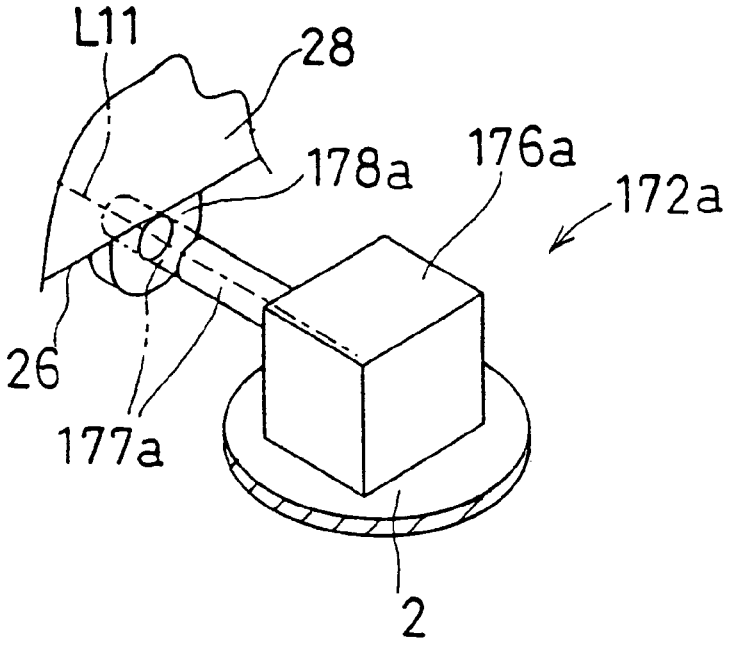
FIG. 48 is a perspective view enlargedly showing a section F in FIG. 47.

FIG. 47 is a simplified perspective view showing the construction of a stapling apparatus 170 as further another embodiment of the invention. FIG. 48 is a perspective view enlargedly showing a section F in FIG. 47. In the embodiment, the same reference numerals are designated to components corresponding to those in the foregoing embodiments and their description is omitted here. The construction of the stapling apparatus 170 of the invention is similar to that of the stapling apparatus 155 shown in FIGS. 44 to 46 and attention has to be paid to a point that the sheet tray 20 is inclined in two directions around the axial line in the longitudinal direction of the bottom plate 26 and the axial line in the width direction perpendicular to the axial line in the longitudinal direction. The sheet tray 20 is supported by a pair of first supporting means 171*a* and 171*b* and a pair of second supporting means 172*a* and 172*b*. The pair of first supporting means 171*a* and 171*b* are provided under the bottom plate 26 and support the sheet tray 20 inclinably around a first inclination axial line L10 parallel to the center axial line extending in the longitudinal direction of the bottom plate 26. The pair of second supporting means 172*a* and 172*b* are provided under the bottom plate 26 and support the sheet tray 20 inclinably around a second inclination axial line L11 which is parallel to the center axial line extending in the width direction of the bottom plate 26.

The first supporting means 171*a* comprises: a first electromagnetic solenoid 173*a* provided at the end 26*c* downstream in the sheet ejecting direction of the bottom plate 26 and on the first inclination axial line L10 and fixed to the laser beam printer 2; and a first bracket 175*a* which is provided projectingly on the first inclination axial line L10 under the end 26*c* downstream in the sheet ejecting direction of the bottom plate 26 and detachably, axially supports a first plunger 174*a* of the first electromagnetic solenoid 173*a*. The other first supporting means 171*b* comprises: a second electromagnetic solenoid 173*b* provided at the end 26*b* upstream in the sheet ejecting direction of the bottom plate 26 and on the first inclination axial line L10 and fixed to the laser beam printer 2; and a second bracket 175*b* which is projectingly provided on the first inclination axial line L10 under the side of the end 26*b* upstream in the sheet ejecting direction of the bottom plate 26 and detachably, axially supports a second plunger 174*b* of the second electromagnetic solenoid 173*b*.

The second supporting means 172*a* comprises: a third electromagnetic solenoid 176*a* provided at the other end 26*d* in the width direction of the bottom plate 26 and on the second inclination axial line L11 and fixed to the laser beam printer 2; and a third bracket 178*a* which is projectingly provided on the second inclination axial line L11 under the other end 26*d* in the width direction of the bottom plate 26 and detachably, axially supports a third plunger 177*a* of the third electromagnetic solenoid 176*a*. The other second supporting means 172*b* comprises: a fourth electromagnetic solenoid 176*b* provided at the end 26*a* in the width direction of the bottom plate 26 and on the second inclination axial line L11 and fixed to the laser beam printer 2; and a fourth bracket 178*b* which is provided projectingly on the second inclination axial line L11 under the end 26*a* in the width direction of the bottom plate 26 and detachably, axially supports a fourth plunger 177*b* of the fourth electromagnetic solenoid 176*b*.

The first and second electromagnetic solenoids 173*a* and 173*b* are arranged so that the center axial lines of the first and second plungers 174*a* and 174*b* are coaxial with the first inclination axial line L10. The third and fourth electromagnetic solenoids 176*a* and 176*b* are arranged so that the center axial lines of the third and fourth plungers 177*a* and 177*b* are coaxial with the second inclination axial line L11. The above-mentioned inclination driving means 158 is provided under the third corner 26*g* of the bottom plate 26.

When the plurality of sheets P1 are placed on the sheet tray 20, the plungers 174*a*, 174*b*, 177*a*, and 177*b* are axially supported by the brackets 175*a*, 175*b*, 178*a*, and 178*b*, respectively.

The first supporting means 171*a* and 171*b* and the inclination driving means 158*e* construct first inclining means.

The second supporting means 172*a* and 172*b* and the inclination driving means 158 construct second inclining means.

When the electromagnetic solenoids 173*a*, 173*b*, 176*a*, and 176*b* are driven, the plungers 174*a*, 174*b*, 177*a*, and 177*b* come off from the brackets 175*a*, 175*b*, 178*a*, and 178*b*, respectively. When the driving of the electromagnetic solenoids 173*a*, 173*b*, 176*a*, and 176*b* is stopped, the plungers 174*a*, 174*b*, 177*a*, and 177*b* are axially supported by the brackets 175*a*, 175*b*, 178*a*, and 178*b*, respectively.

Figure 49:
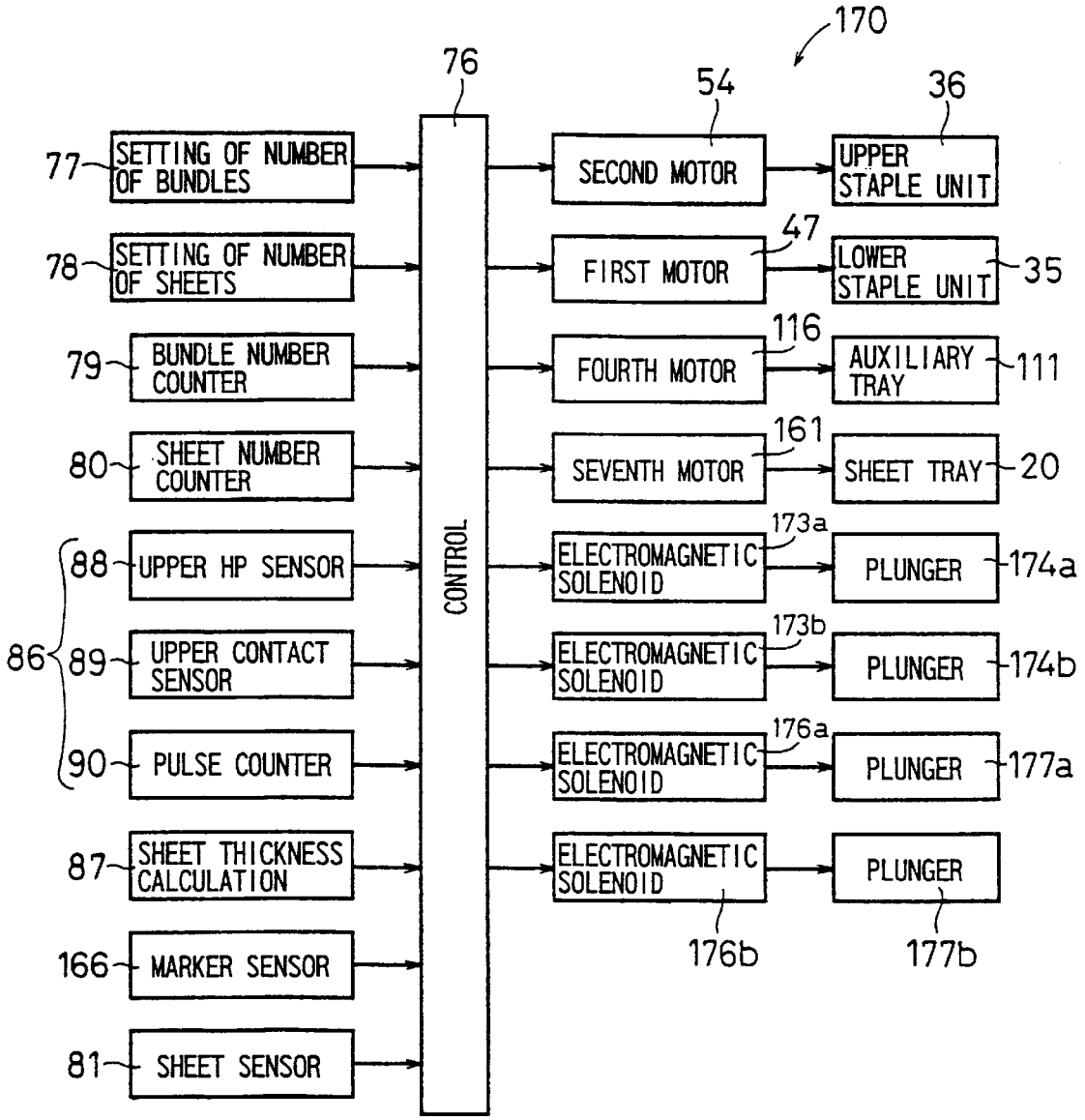
FIG. 49 is a simplified block diagram showing the electric configuration of the stapling apparatus 170.

FIG. 49 is a simplified block diagram showing the electric configuration of the stapling apparatus 170. The electric configuration of the stapling apparatus 170 of the invention is similar to that of the stapling apparatus 155 shown in FIG. 45 and attention should be paid to a point that the operation of the first and second inclining means is controlled by inclination controlling means including the marker sensor 166 and the control circuit 76. To the control circuit 76, output signals similar to those in FIG. 45 are supplied. Control signals outputted from the control circuit 76 control operations similar to those in FIG. 45 and the driving of the first to fourth electromagnetic solenoids 173*a*, 173*b*, 176*a*, and 176*b*.

Figure 50:
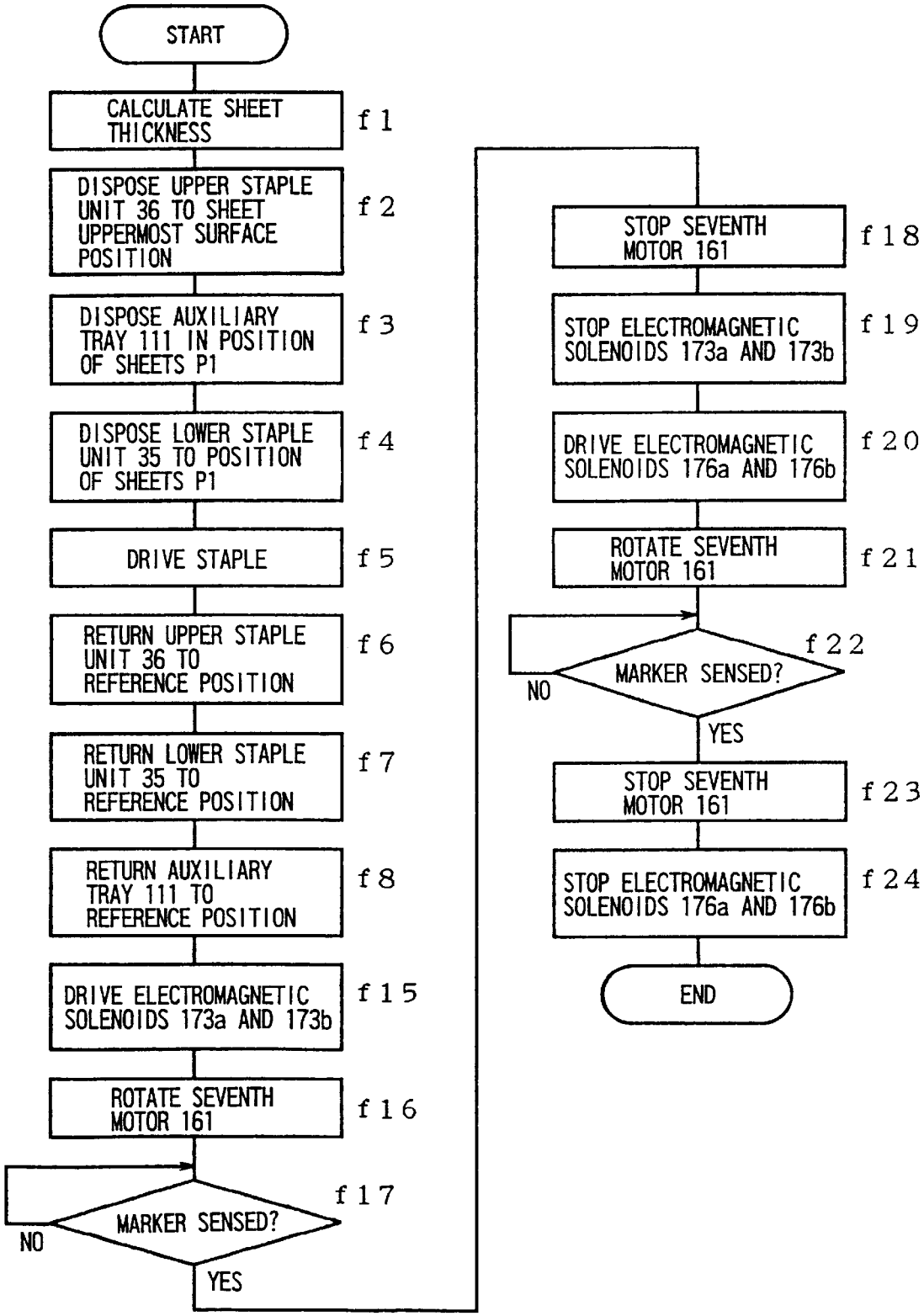
FIG. 50 is a flowchart for explaining the operation of the stapling apparatus 170.

FIG. 50 is a flowchart for explaining the operation of the stapling apparatus 170. When a plurality of sheets P1 are stacked on the sheet tray 20, by performing operations similar to those at steps f1 to f8 in FIG. 45, the stack of sheets P1 are sandwiched by the staple units 35 and 36, the sheet bundle P2 is formed, and the staple units 35 and 36 and the auxiliary tray 111 are returned to their reference positions. The routine advances from step f8 to step f15 where the first and second electromagnetic solenoids 173*a* and 173*b* are driven. By the operation, the first and second plungers 174*a* and 174*b* come off from the first and second brackets 175*a* and 175*b*, respectively. Consequently, the sheet tray 20 is supported inclinably around the second inclination axial line L11 by the second supporting means 172*a* and 172*b*.

The routine advances from step f15 to steps f16 to f18 where one rotation of the sixth toothed wheel 163 is made by the seventh motor 161 by performing operations similar to those at steps f9 to f11 in FIG. 46. The sheet tray 20 is inclined around the second inclination axial line L11 so that the end 26*c* downstream in the sheet ejecting direction of the bottom plate 26 is disposed higher than the reference position and returned. The sheet bundle P2 is accordingly moved in the other direction toward the end plate 29 and the end face facing the end plate 29 comes into contact with the end plate 29.

The routine advances from step f18 to step f19 where the driving of the first and second electromagnetic solenoids 173*a* and 173*b* is stopped. The routine shifts from step f19 to step f20 where the third and fourth electromagnetic solenoids 176*a* and 176*b* are driven. By the operations, the third and fourth plungers 177*a* and 177*b* come off from the third and fourth brackets 178*a* and 178*b*, respectively. The sheet tray 20 is therefore supported by the first supporting means 171*a* and 171*b* inclinably around the first inclination axial line L10.

The routine advances from step f20 to steps f21 to f23 where the seventh motor 161 is rotated to make one rotation of the sixth toothed wheel 163 by performing operations similar to those at steps f9 to f11 in FIG. 46. By the operations, the sheet tray 20 is inclined around the first inclination axial line L10 so that the other end 26*d* in the width direction of the bottom plate 26 is disposed higher than the reference position and returned. The sheet bundle P2 is therefore moved in one direction toward the first side plate 27 in a state where an end face of the sheet bundle P2 is in contact with the end plate 29 and the side face opposite to that on the stapler 21 side comes into contact with the first side plate 27. In such a manner, the sheet bundle P2 is moved away from the stapler 21.

The routine advances from step f23 to step f24 where the driving of the third and fourth electromagnetic solenoids 176*a* and 176*b* is stopped. By the operation, the sheet tray 20 is supported by the first supporting means 171*a* and 171*b* and the second supporting means 172*a* and 172*b*. The operation of the stapling apparatus 170 is then finished.

Formation of a plurality of sheet bundles P2 is realized by repeating the operations of steps f1 to f24. The sheets P1 for the second and subsequent sheet bundles are placed near to the stapler 21 side so as to be deviated from the sheet bundle P2 moved away from the stapler 21.

Since the sheet tray 20 is alternately inclined in the one direction and the other direction by the first and second inclining means and the inclination controlling means, the sheet bundle P2 can be moved away from the stapler 21. The sheets P1 for the second and subsequent sheet bundles are placed near to the stapler 21 side so as to be deviated from the sheet bundle P2 moved away from the stapler 21. The stapler 21 can therefore move in the sheet stacking direction without interfering with the formed sheet bundle P2 and form a plurality of sheet bundles P2. Since the sheet tray 20 is constructed by including the first side plate 27 and the end plate 29, when the sheet tray 20 is inclined, the sheet bundle P2 moved away from the stapler 21 comes into contact with the first side plate 27 and the end plate 29, thereby enabling the movement of the sheet bundle P2 in the sheet tray 20 to be regulated. Especially, in case of forming a plurality of sheet bundles P2, the plurality of sheet bundles P2 can be stacked, aligned, and placed on the sheet tray 20 by the first side plate 27 and the end plate 29 in a state where the plurality of sheet bundles P2 are moved away from the stapler 21.

In the embodiment, first, the first and second electromagnetic solenoids 173*a* and 173*b* are driven and the sheet tray 20 is inclined around the second inclination axial line L11. Then, the third and fourth electromagnetic solenoids 176*a* and 176*b* are driven and the sheet tray 20 is inclined around the first inclination axial line L10. In place of the arrangement, the third and fourth electromagnetic solenoids 176*a* and 176*b* may be first driven to incline the sheet tray 20 around the first inclination axial line L10 and then the first and second electromagnetic solenoids 173*a* and 173*b* may be driven to incline the sheet tray 20 around the second inclination axial line L11. In this manner as well, effects similar to those of the embodiment of the invention shown in FIGS. 47 to 50 can be obtained.

Figure 51:
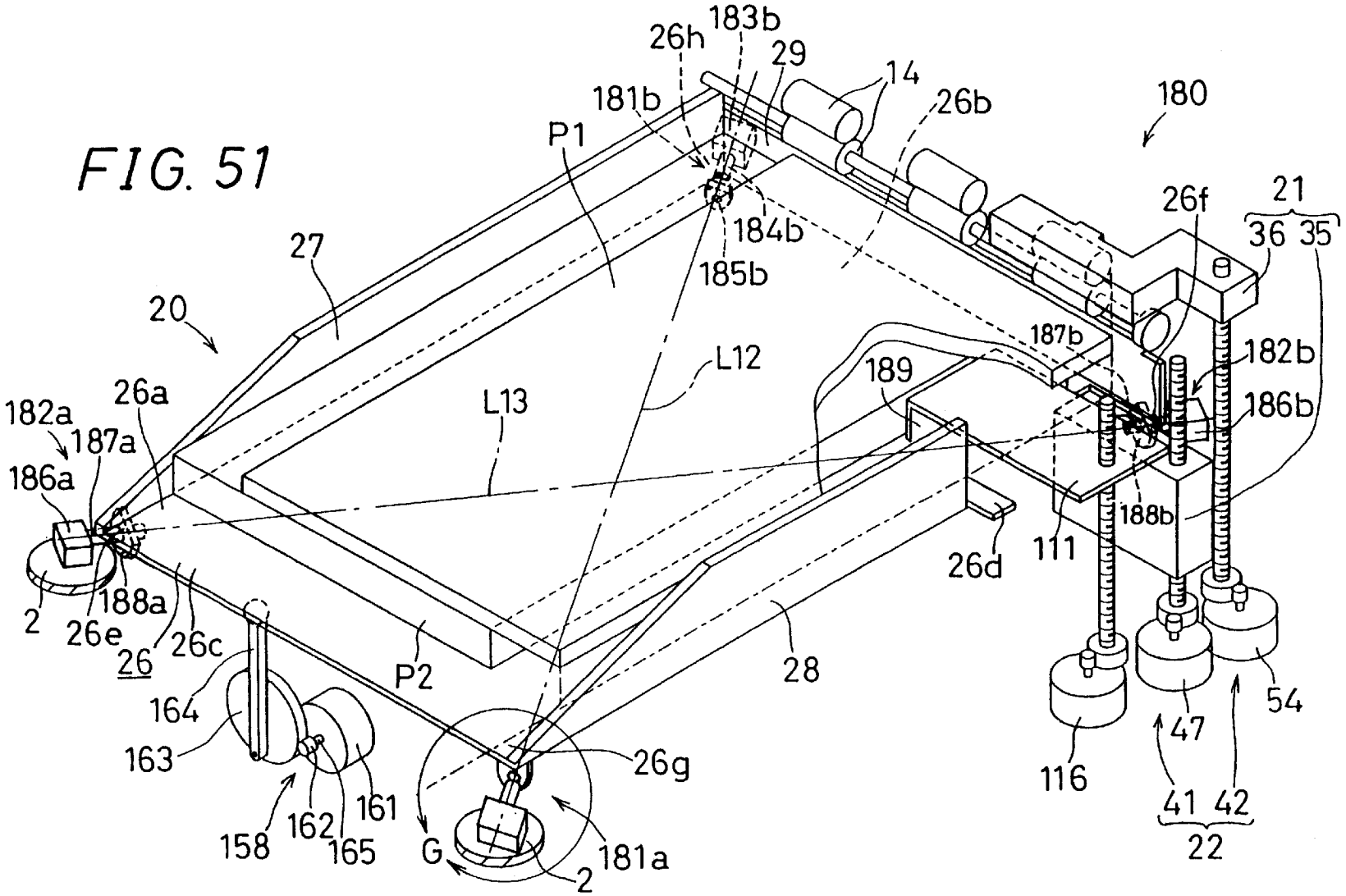
FIG. 51 is a simplified perspective view showing the construction of a stapling apparatus 180 as further another embodiment of the invention.
Figure 52:
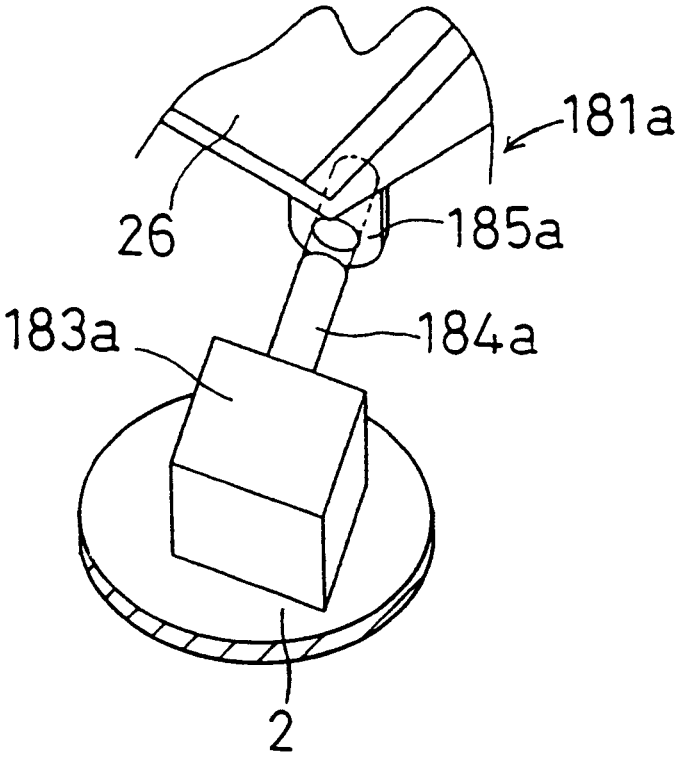
FIG. 52 is a perspective view enlargedly showing a section G in FIG. 51.

FIG. 51 is a simplified perspective view showing the construction of a stapling apparatus 180 as further another embodiment of the invention. FIG. 52 is a perspective view enlargedly showing a section G in FIG. 51. In the embodiment, the same reference numerals are designated to components corresponding to those in the foregoing embodiments and their description is omitted here. The construction of the stapling apparatus 180 of the invention is similar to that of each of the stapling apparatuses 155 and 170 shown in FIGS. 44 to 50 and attention should be paid to a point that the sheet tray 20 is inclined in the direction that the plurality of sheets P1 are moved toward the second side plate 28 as a sheet contacting member.

The sheet tray 20 is supported by a pair of third supporting means 181*a* and 181*b* inclinably around a third inclination axial line L12 parallel to the diagonal axial line connecting the third corner 26*g* of the bottom plate 26 and the fourth corner 26*h* at the end 26*b* upstream of the sheet ejecting direction of the bottom plate 26 and at the one end 26*a* in the width direction. The sheet tray 20 is also supported by a pair of fourth supporting means 182*a* and 182*b* inclinably around a fourth inclination axial line L13 parallel to a diagonal axial line connecting the first corner 26*e* and the second corner 26*f* of the bottom plate 26.

The third supporting means 181*a* comprises: a fifth electromagnetic solenoid 183*a* provided on the third inclination axial line L12 under the third corner 26*g* of the bottom plate 26 and fixed to the laser beam printer 2; and a fifth bracket 185*a* which is provided projectingly on the third inclination axial line L12 under the third corner 26*g* of the bottom plate 26 and detachably, axially supports a fifth plunger 184*a* of the fifth electromagnetic solenoid 183*a*. The other third supporting means 181*b* comprises: a sixth electromagnetic solenoid 183*b* provided on the third inclination axial line L12 under the fourth corner 26*h* of the bottom plate 26 and fixed to the laser beam printer 2; and a sixth bracket 185*b* provided projectingly on the third inclination axial line L12 under the fourth corner 26*h* of the bottom plate 26 and detachably, axially supports a sixth plunger 184*b* of the sixth electromagnetic solenoid 183*b*.

The fourth supporting member 182*a* comprises: a seventh electromagnetic solenoid 186*a* provided on the fourth inclination axial line L13 under the first corner 26*e* of the bottom plate 26 and fixed to the laser beam printer 2; and a seventh bracket 188*a* which is provided projectingly on the fourth inclination axial line L13 under the first corner 26*e* of the bottom plate 26 and detachably, axially supports a seventh plunger 187*a* of the seventh electromagnetic solenoid 186*a*. The other fourth supporting means 182*b* comprises: an eighth electromagnetic solenoid 186*b* provided on the fourth inclination axial line L13 under the second corner 26*f* of the bottom plate 26 and fixed to the laser beam printer 2; and an eighth bracket 188*b* provided projectingly on the fourth inclination axial line L13 under the second corner 26*f* of the bottom plate 26 and detachably, axially supports an eighth plunger 187*b* of the eighth electromagnetic solenoid 186*b*. The fifth and sixth electromagnetic solenoids 183*a* and 183*b* are arranged so that the center axial lines of the fifth and sixth plungers 184*a* and 184*b* are coaxial with the third inclination axial line L12. The seventh and eighth electromagnetic solenoids 186*a* and 186*b* are arranged so that the center axial lines of the seventh and eighth plungers 187*a* and 187*b* are coaxial with the fourth inclination axial line L13.

In the inclination driving means 158, under the bottom plate 26, the other end 164*b* in the longitudinal direction of the coupling rod 164 is coupled to the center part between the both ends 26*a* and 26*b* in the width direction at the end 26*c* downstream in the sheet ejecting direction of the bottom plate 26 via a receiving part (not shown).

When the electromagnetic solenoids 183*a*, 183*b*, 186*a*, and 186*b* are driven, the plungers 184*a*, 184*b*, 187*a*, and 187*b* come off from the brackets 185*a*, 185*b*, 188*a*, and 188*b*, respectively. When the driving of the electromagnetic solenoids 183*a*, 183*b*, 186*a*, and 186*b* is driven, the plungers 184*a*, 184*b*, 187*a*, and 187*b* are axially supported by the brackets 185*a*, 185*b*, 188*a*, and 188*b*, respectively.

The auxiliary tray 111 is provided with a bent part 189 downwardly bent from a side end part of the sheet tray 20. When the sheets P1 are placed on the sheet tray 20, in the sheet tray 20, the plungers 184*a*, 184*b*, 187*a*, and 187*b* are axially supported by the brackets 185*a*, 185*b*, 188*a*, and 188*b*, respectively.

The side face 163*a* of the sixth toothed wheel 163 is provided with a first marker indicating that the coupled part is disposed in the uppermost position just above the reference position and a second marker indicating that the coupled part is disposed in its reference position.

The third supporting means 181*a* and 181*b* and the inclination driving means 158 construct third inclining means. The fourth supporting means 182*a* and 182*b* and the inclination driving means 158 construct fourth inclining means.

Figure 53:
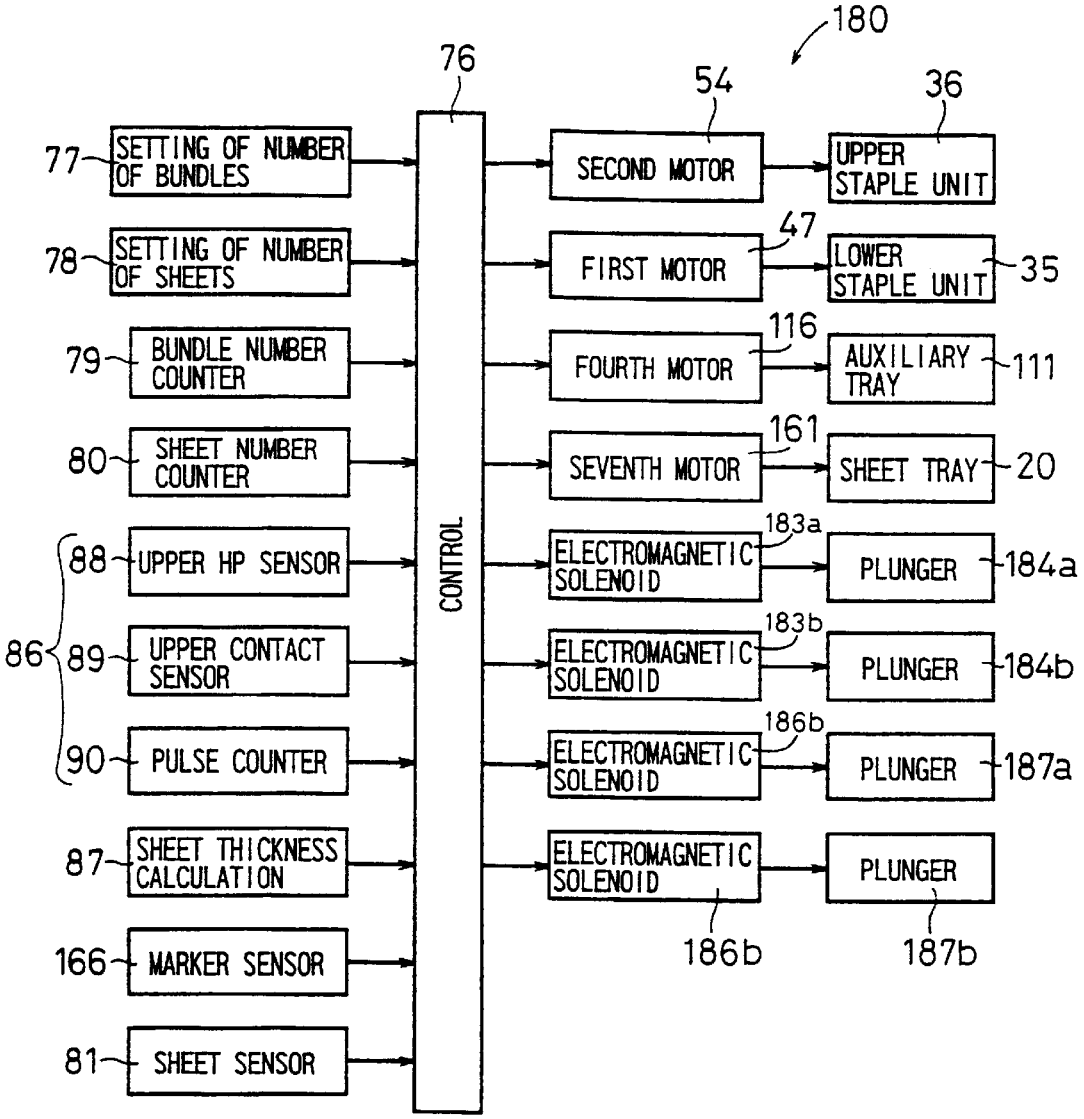
FIG. 53 is a simplified block diagram showing the electric configuration of the stapling apparatus 180.

FIG. 53 is a simplified block diagram showing the electric configuration of the stapling apparatus 180. The electric configuration of the stapling apparatus 180 of the invention is similar to that of the stapling apparatus 170 shown in FIG. 49 and attention should be paid to a point that the third and fourth inclining means are controlled by inclination controlling means constructed by including the marker sensor 166 and the control circuit 76. To the control circuit 76, output signals similar to those of the electric components of the stapling apparatus 170 shown in FIG. 49 are supplied. Output signals from the control circuit 76 are similar to those in the case of the stapling apparatus 170 shown in FIG. 49. In place of the first, second, third, and fourth electromagnetic solenoids 173*a*, 173*b*, 176*a*, and 176*b*, the driving of the fifth, sixth, seventh, and eighth electromagnetic solenoids 183*a*, 183*b*, 186*a*, and 186*b* is controlled.

Figure 54:
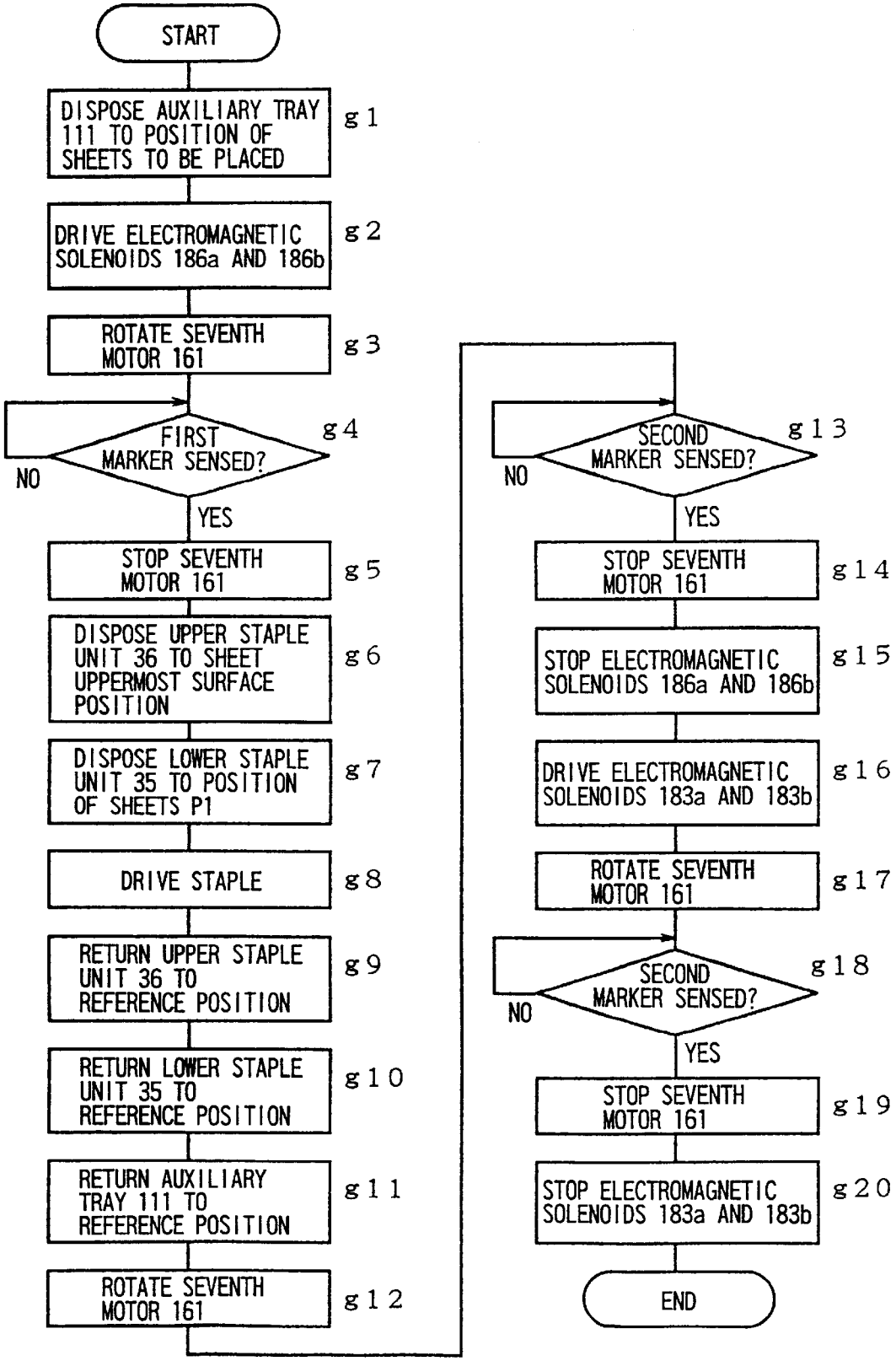
FIG. 54 is a flowchart for explaining the operation of the stapling apparatus 180.

FIG. 54 is a flowchart for explaining the operation of the stapling apparatus 180. At step g1, before the plurality of sheets P1 are stacked on the sheet tray 20, the auxiliary tray 111 is disposed at a same level as that of the uppermost sheet of the previous stack of sheets placed on the sheet tray 20. More specifically, for the first sheet bundle, the fourth motor 116 is not driven and the auxiliary tray 111 is remained in its reference position. For the second and subsequent sheet bundles, the auxiliary tray 111 is disposed in the position obtained by adding the thickness t1 of the stack of sheets P1 calculated by the stack of sheets thickness calculating means 87 to the movement amount B of the lower staple unit 35 at the time of the immediately preceding formation of the sheet bundle P2. When the plurality of sheets P1 are stacked on the sheet tray 20, the routine advances from step g1 to step g2 where the seventh and eighth electromagnetic solenoids 186*a* and 186*b* are driven. Consequently, the seventh and eighth plungers 187*a* and 187*b* come off from the seventh and eighth brackets 188*a* and 188*b*, respectively. The sheet tray 20 is therefore supported inclinably around the third inclination axial line L12 by the third supporting means 181*a* and 181*b*.

The routine advances from step g2 to steps g3 to g5 where the seventh motor 161 is rotated until the marker sensor 166 senses the first marker. By the operation, the coupled part is disposed in the uppermost position. When the coupled part is placed on the uppermost position, the sheet tray 20 is inclined so that the first corner 26*e* of the bottom plate 26 of the sheet tray 20 is arranged higher than the reference position of the sheet tray 20. The stack of sheets P1 are consequently moved in the direction toward the second side plate 28 and the end plate 29 as sheet contacting members and the side face on the stapler 21 side and the end face which faces the end plate 29 come into contact with the second side plate 28 and the end plate 29, respectively. The sheets P1 are aligned by the second side plate 28 and the end plate 29 before being bound.

The routine advances from step g5 to step g6 where the upper staple unit 36 is disposed in the position of the uppermost sheet-surface by performing an operation similar to that of step f4 in FIG. 50. The routine shifts from step g6 to step g7 where the lower staple unit 35 is disposed in the position where the stack of sheets P1 are to be bound, namely, the position obtained by adding the calculated thickness t1 of the stack of sheets P1 to the uppermost sheet-surface position by executing an operation similar to that of step f4 in FIG. 50. The routine advances from step g7 to step g8 where the staple is driven through the stack of sheets P1, the stack of sheets P1 are bound, and the sheet bundle P2 is formed by carrying out an operation similar to that of step f5 in FIG. 50. Since the sheet tray 20 is inclined around the third inclination axial line L12 at this moment, the staple can be driven in a state where the plurality of sheets P1 are aligned, so that the sheet bundle P2 in which sheets are aligned can be formed.

The routine advances from step g8 to steps g9 to g11 where the upper staple unit 36, the lower staple unit 35, and the auxiliary tray 111 are returned to their reference positions by performing operations similar to those of steps f6 to f8 shown in FIG. 50. The routine shifts from step g11 to steps g12 to g14 where the seventh motor 161 is rotated until the marker sensor 166 senses the second marker. By the operations, the coupled part is disposed in the reference position. When the coupled part is arranged in the reference position, the sheet tray 20 is disposed in the reference position. The routine advances from step g14 to step g15 where the driving of the seventh and eighth electromagnetic solenoids 186*a* and 186*b* is stopped. By the operation, the seventh and eighth plungers 187*a* and 187*b* are axially supported by the seventh and eighth brackets 188*a* and 188*b,* respectively.

The routine advances from step g15 to step g16 where the fifth and sixth electromagnetic solenoids 183*a* and 183*b* are driven. By the operation, the fifth and sixth plungers 184*a* and 184*b* come off from the fifth and sixth brackets 185*a* and 185*b,* respectively. The sheet tray 20 is therefore supported by the fourth supporting means 182*a* and 182*b* inclinably around the fourth inclination axial line L13. The routine advances from step g16 to steps g17 to g19 where the seventh motor 161 is rotated until the second marker is sensed by the marker sensor 166. One rotation of the sixth toothed wheel 163 is consequently made and the coupled part is moved from the reference position to the uppermost position, and again to the reference position. In the sheet tray 20, therefore, the third corner 26*g* of the bottom plate 26 is lifted higher than the reference position of the sheet tray 20. More specifically, the sheet tray 20 is inclined around the fourth inclination axial line L13 and returned. The sheet bundle P2 is accordingly moved in the direction toward the first side plate 27 and the end plate 29 and is moved away from the stapler 21. The side face on the side opposite to the stapler 21 side and the end face which faces the end plate 29 of the sheets P2 moved away from the stapler 21 come into contact with the first side plate 27 and the end plate 29, respectively. The routine advances from step g19 to step g20 where the driving of the fifth and sixth electromagnetic solenoids 183*a* and 183*b* is stopped. By the operation, the fifth and sixth plungers 184*a* and 184*b* are axially supported by the fifth and sixth brackets 185*a* and 185*b*. The sheet tray 20 is therefore supported by the third supporting means 181*a* and 181*b* and the fourth supporting means 182*a* and 182*b*. The operation is then finished.

Formation of a plurality of sheet bundles P2 is realized by repeating the operations of steps g1 to g20 for each sheet bundle. For the second and subsequent sheet bundles, since the auxiliary tray 111 has the bent part 189, when the sheet tray 20 is inclined around the third inclination axial line L12 at steps g3 to g5, the side face on the stapler 21 side of the sheet bundle P2 pushed away from the stapler 21 comes into contact with the bent part 189, so that the sheet bundle P2 pushed away from the stapler 21 can be prevented from being moved in the direction approaching the stapler 21.

The sheets P1 for the second and subsequent sheet bundles are placed near to the stapler 21 side so as to be deviated from the sheet bundle P2 moved away from the stapler 21.

Before the sheets P1 are placed on the sheet tray 20, the auxiliary tray 111 is moved to the position where the sheets P1 are to be positioned when being placed on the sheet tray 20. When the sheets P1 are placed on the sheet tray 20, the sheet tray 20 is inclined in the direction that the stack of sheets P1 are moved toward the second side plate 28 and the end plate 29. Consequently, the sheets P1 can be aligned by being brought into contact with the second side plate 28 and the end plate 29 in a state where the lowering of the sheets P1*a* protruded from the sheet tray 20 is prevented.

Although the sheet tray 20 is inclined only once in order to move the sheet bundle P2 away from the stapler 21 in the embodiment of the invention shown in FIGS. 44 to 54, as further another embodiment of the invention, the operation of inclining the sheet tray 20 can be executed a plurality of times to form one sheet bundle P2. By the arrangement, a peripheral part of the sheet bundle P2 partly comes into contact with the sheet tray 20 more easily and the sheet bundle P2 can be accordingly aligned more easily.

Figure 55:
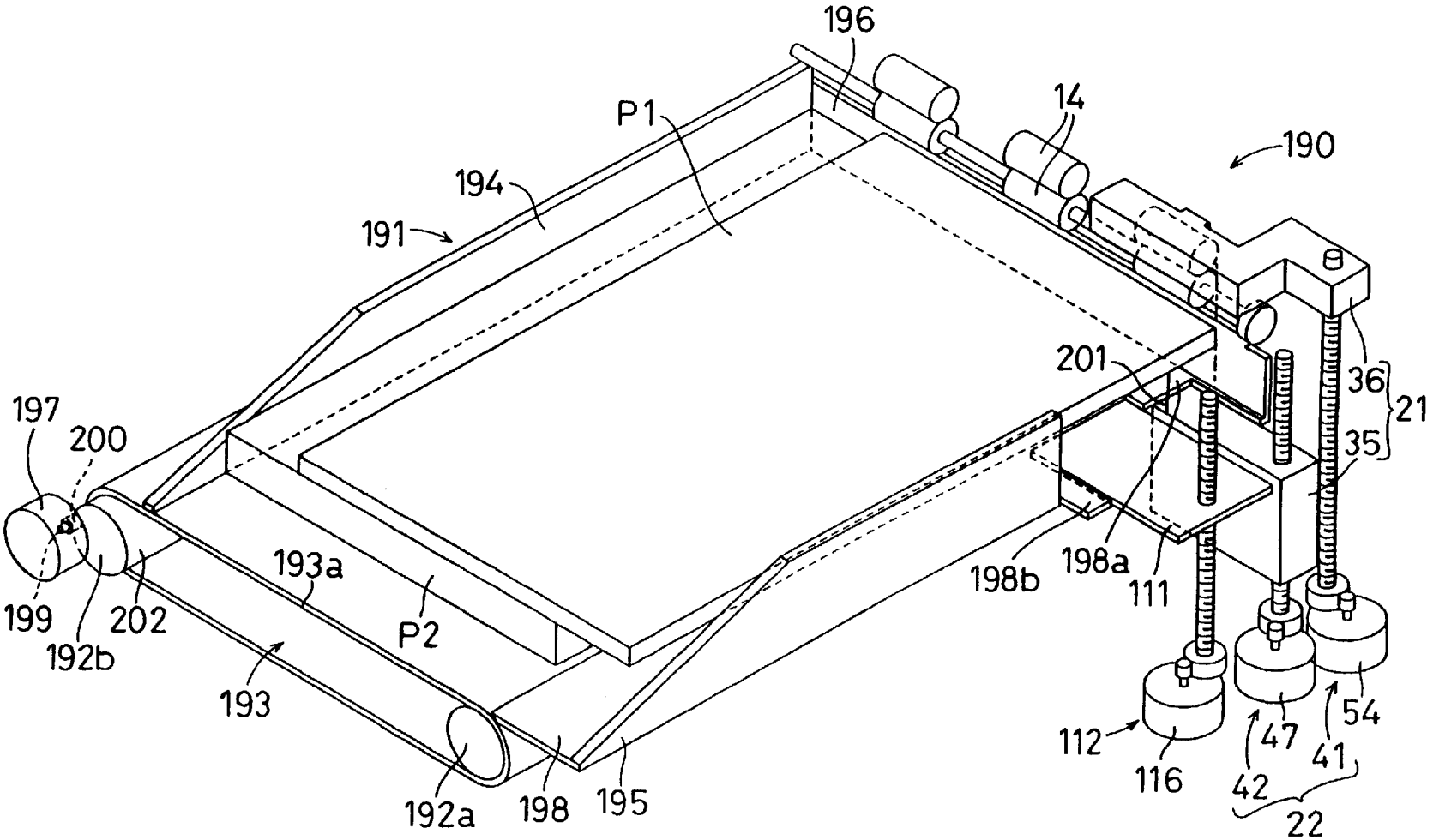
FIG. 55 is a simplified perspective view showing the construction of a stapling apparatus 190 as further another embodiment of the invention.

FIG. 55 is a simplified perspective view showing the construction of a stapling apparatus 190 as further another embodiment of the invention. In the embodiment, the same reference numerals are designated to components corresponding to those in the foregoing embodiments and their description is omitted here. The construction of the stapling apparatus 190 of the invention is similar to that of the stapling apparatus 130 shown in FIGS. 38 to 40 and attention has to be paid to a point that the sheet bundle P2 is moved away from the stapler 21 by driving the bottom plate of a sheet tray 191. The sheet tray 191 comprises a pair of rollers 192*a* and 192*b,* an endless belt 193, a first side plate 194, a second side plate 195, an end plate 196, an eighth motor 197, and a fixed bottom plate 198. The pair of rollers 192*a* and 192*b* extend in the sheet ejecting direction and are disposed at an interval in the width direction perpendicular to the sheet ejecting direction. The endless band 193 extends along the whole length in the longitudinal direction of the roller 192*a* and is wound around the rollers 192*a* and 192*b*.

The first side plate 194 is integrally formed with an upper stretched part 193*a* of the endless band 193 serving as the bottom plate and extends both upward and along the whole length in the longitudinal direction of the upper stretched part 193*a*. The fixed bottom plate 198 is formed in a generally strip shape and arranged near one roller 192*a* and in the same position in the sheet stacking direction as the upper stretched part 193*a*. The fixed bottom plate 198 is formed so as to extend across the whole length in the longitudinal direction of the upper stretched part 193*a*. At an end 198*a* upstream in the sheet ejecting direction of the fixed bottom plate 198, the notch 101 through which the lower staple unit 35 of the stapler 21 and the auxiliary tray 111 can pass is formed.

The second side plate 195 is fixed with respect to the first side plate 194 at the end opposite to the roller 192*b* side of the fixed bottom plate 198 so as to face the first side plate 194. The second side plate 195 extends toward the downstream of the notch 201 in the sheet ejecting direction. The end plate 196 is integrally formed with the end 198*a* upstream in the sheet ejecting direction of the fixed bottom plate 198. The end plate 196 extends upward between the axial lines on the end 198*b* in the width direction of the fixed bottom plate 198 and the upper stretched part 193*a* which are in parallel to the rotation axis of the other roller 192*b*. In the eighth motor 197, a seventh pinion 200 is provided at the tip of the rotary shaft 199. The end downstream of the sheet ejecting direction of the other roller 192*b* is protruded from the endless belt 193. A toothed wheel which meshes with the seventh pinion 200 is threaded in the protrusion 202. The pair of rollers 192*a* and 192*b* and the eighth motor 197 construct bottom plate driving means.

In the notch 201, the stapler 21 and the auxiliary tray 111 are disposed in this order from the upstream to the downstream of the sheet ejecting direction.

The interval between the rotation axial lines of the rollers 192*a* and 192*b* is set to be larger than or almost equal to the length in the width direction of the stack of sheets P1.

The eighth motor 197 rotates the other roller 192*b* via the rotary shaft 199 and the seventh pinion 200. By the operation, the endless belt 193 is driven and the upper stretched part 193*a* is reciprocated so that the first side plate 194 moves toward/apart from the second side plate 195. When the eighth motor 197 is normally rotated, the first side plate 194 is moved in the direction toward the second side plate 195. When the eighth motor 197 is rotated reversely, the first side plate 194 is moved in the direction apart from the second side plate 195.

The lower staple unit 35 is disposed in the reference position so that its top face is flush with the placement face of the fixed bottom plate 198 of the sheet tray 191. The upper staple unit 36 is disposed in the reference position similar to that in the foregoing embodiments of the invention shown in FIGS. 1 to 54. The auxiliary tray 111 is disposed in the same position in the sheet stacking direction as the fixed bottom plate 198, that is, in the reference position where the placement face of the auxiliary tray 111 is flush with the placement face of the fixed bottom plate 198. The first side plate 194 is disposed in the reference position which is set so that the surface facing the second side plate 195 is apart from the face opposite to the first side plate 194 of the second side plate 195 as a reference by a distance which is almost equal to a sum of the length in the width direction of the sheet P1 and the movement stroke of the first side plate 194. In the embodiment of the invention, the sheet P1 is ejected from the laser beam printer 2 so that its side face on the stapler 21 side travels along the surface facing the first side plate 194 of the second side plate 195. That is, the sheet P1 ejected from the laser beam printer 2 is placed on the sheet tray 191 so as to face the notch 201 in the fixed bottom plate 198.

Figure 56:
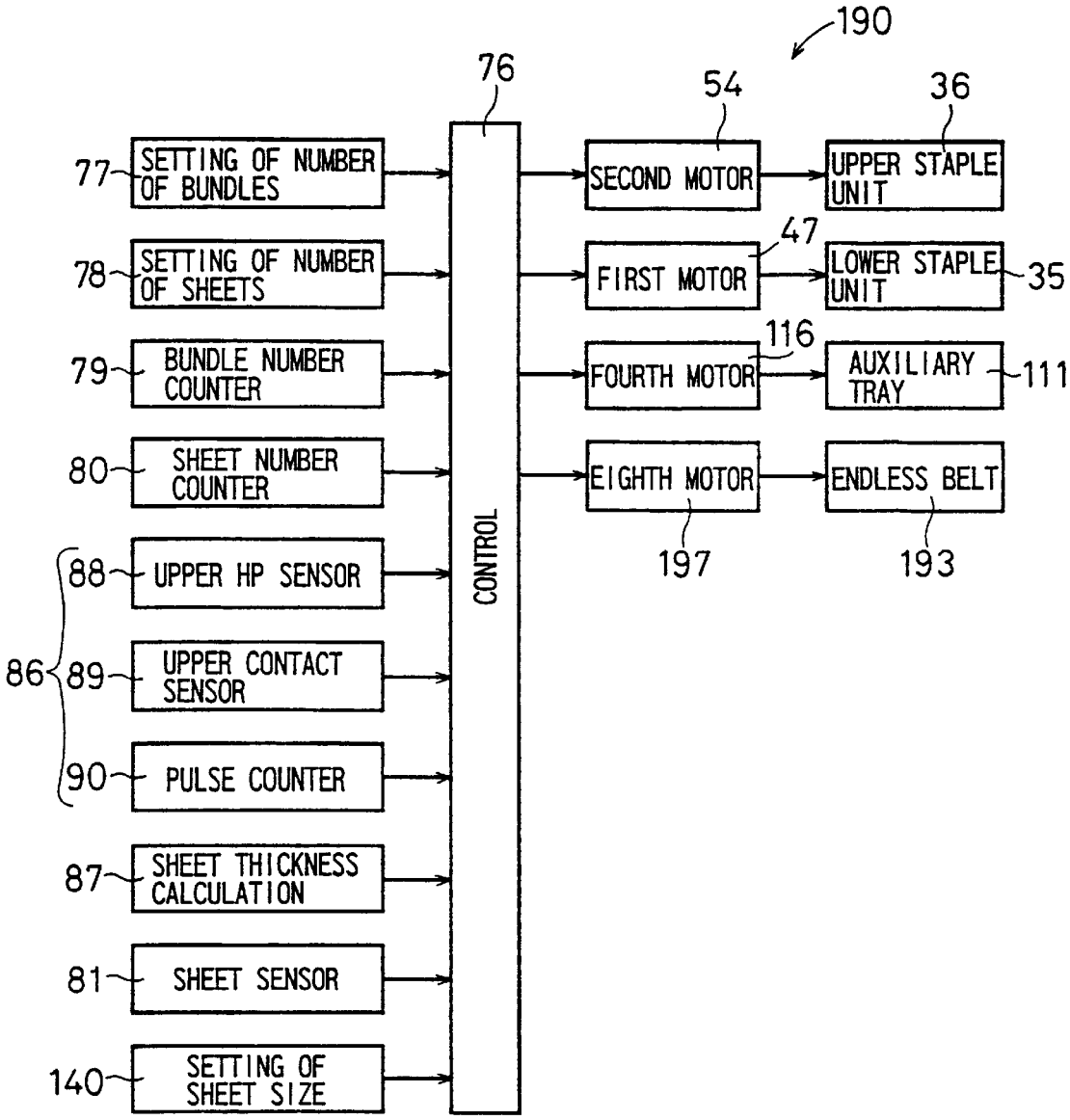
FIG. 56 is a simplified block diagram showing the electric configuration of the stapling apparatus 190.

FIG. 56 is a simplified block diagram showing the electric configuration of the stapling apparatus 190. The electric configuration of the stapling apparatus 190 of the invention is similar to that of the stapling apparatus 130 shown in FIG. 39 and attention should be paid to a point that the operation of the eighth motor 197 is controlled by movement controlling means including the sheet size setting unit 140 and the control circuit 76. Output signals from the electric components of the stapling apparatus 130 shown in FIG. 39 except for the marker sensor 91 are supplied to the control circuit 76. Control signals outputted from the control circuit 76 control the driving of the first, second, fourth, and eighth motors 47, 54, 116, and 197, instruct the lower staple unit 35 to perform the staple driving operation, and drive the sheet bundle number counter 79, the sheet number counter 80, and the pulse counter 90.

Figure 57:
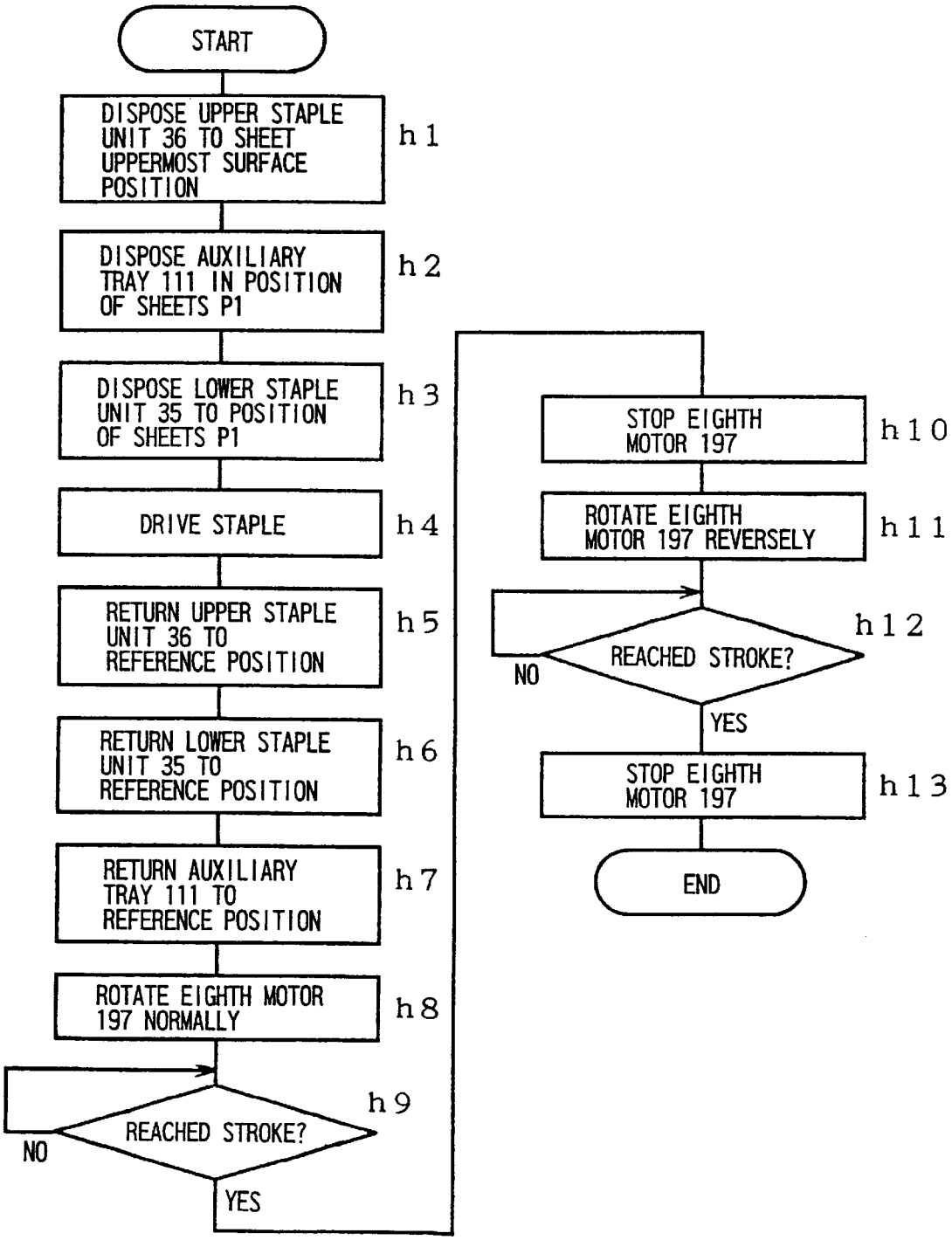
FIG. 57 is a flowchart for explaining the operation of the stapling apparatus 190.

FIG. 57 is a flowchart for explaining the operation of the stapling apparatus 190. When the plural sheets PI are stacked on the sheet tray 191, at step h1, by performing operations similar to those of steps b1 to b6 in FIG. 40, the thickness t1 of the sheets P1 is calculated by the stack of sheets thickness calculating means 87 and the upper staple unit 36 is disposed in the position of the uppermost sheet-surface. The routine advances from step h1 to step h2 where the auxiliary tray 111 is disposed in the position of the stack of sheets P1, that is, the position obtained by adding the thickness t1 of the stack of sheets P1 to the uppermost sheet-surface position by performing operations similar to those at steps b7 and b20 in FIG. 40. The routine advances from step h2 to step h3 where the lower staple unit 35 is disposed to the position of the stack of sheets P1, that is, the position obtained by adding the calculated thickness t1 of the stack of sheets P1 to the uppermost sheet-surface position by executing an operation similar to that of step b8 in FIG. 40. The routine advances from step h3 to step h4 where the staple is driven through the stack of sheets P1 to be bound, thereby forming the sheet bundle P2 by performing an operation similar to that of step b9 in FIG. 40. The routine advances from step h4 to steps h5 to h7 where the upper staple unit 36, the lower staple unit 35, and the auxiliary tray 111 are returned to their reference positions by performing operations similar to those of steps b10 to bl3 in FIG. 40. The routine shifts from step h7 to steps h8 to h10 where the eighth motor 197 is normally rotated so as to move the first side plate 194 disposed in the reference position in the direction toward the second side plate 195 until the movement amount reaches the stroke. By the operation, the first side plate 194 is moved together with the upper stretched part 193*a* in the direction toward the second side plate 195. The first side plate 194 is disposed in the position that the distance between the first and second side plates 194 and 195 is almost equal to the length in the width direction of the sheet bundle P2. Therefore, the side face opposite to the stapler 21 side of the sheet bundle P2 comes into contact with the first side plate 194 and the side face on the stapler 21 side comes into contact with the second side plate 195.

The routine advances from step h10 to steps h11 to h13 where the eighth motor 197 is reversely rotated so as to move the first side plate 194 in the direction away from the second side plate 195 until the movement amount reaches the stroke. By the operation, the first side plate 194 is moved together with the upper stretched part 193*a* in the direction away from the second side plate 195, and the first side plate 194 is disposed in the original position, that is, the reference position. The sheet bundle P2 is moved away from the stapler 21 by the movement of the upper stretched part 193*a* in the state where the side face opposite to the stapler 21 side is in contact with the first side plate 194. The sheet bundle P2 moved away from the stapler 21 is placed only on the upper stretched part 193*a* as shown in FIG. 55. Then, the operation of the stapling apparatus 190 is finished.

Formation of plural sheet bundles P2 can be realized by repeating the operations of steps h1 to h13 for each sheet bundle. In this case, the stack of sheets P1 for the second and subsequent sheet bundles are placed near to the stapler 21 side so as to deviated from the sheet bundle P2 moved away from the stapler 21.

Since the first side plate 194 is moved together with the upper stretched part 193*a* in the directions toward/away from the second side plate 195 by the pair of rollers 192*a* and 192*b*, the eighth motor 197, and the movement controlling means, when the first side plate 194 is moved toward the second side plate 195, the sheet bundle P2 is sandwiched by the first and second side plates 194 and 195 and can be aligned in a state where the plural sheet bundles P2 are stacked. When the first side plate 194 is moved in the direction away from the second side plate 195, the sheet bundle P2 can be moved away from the stapler 21. Simultaneously, the construction of the operation of aligning and moving the sheet bundle P2 can be simplified. Further, since the stack of sheets P1 for the second and subsequent sheet bundles are placed to near the stapler 21 side so as to be deviated from the sheet bundle P2 moved away from the stapler 21, the stapler 21 can move in the sheet stacking direction without interfering with the formed sheet bundle P2, the stack of sheets P1 can be securely bound, and the plurality of sheet bundles P2 can be formed.

Although the driving side unit is used for the lower staple unit 35 and the bending side unit is employed for the upper staple unit 36 in the foregoing embodiments shown in FIGS. 1 to 57, the invention is not limited to the arrangement. Alternatively, the bending side unit may be used for the lower staple unit and the driving side unit may be used for the upper staple unit. With the arrangement as well, effects similar to those of the above-mentioned embodiments can be obtained.

In the embodiment of the invention shown in FIGS. 12 to 23, the detection of the position of the uppermost sheet-surface and/or the position of the undermost sheet-surface and movement of the upper staple unit 36 to the position of the uppermost sheet-surface and/or movement of the lower staple unit 35 to the position of the undermost sheet-surface are performed in parallel. According to further another embodiment of the invention, however, the position of the uppermost sheet-surface and/or the position of the undermost sheet-surface are/is sensed by uppermost sheet-surface sensing means and/or undermost sheet-surface sensing means provided separately from the stapler 21 and, after that, the movement of the upper staple unit 36 to the position of the uppermost sheet-surface and/or the movement of the lower staple unit 35 to the position of the undermost sheet-surface can be executed. With the arrangement as well, the stapler 21 can be disposed to a position optimum for binding the stack of sheets P1.

Although the operations of the stapler 21 similar to those described with reference to FIGS. 12 to 15 are performed in the foregoing embodiments of the invention shown in FIGS. 24 to 57, instead, the operations explained with reference to FIGS. 16 to 19 and FIGS. 20 to 23 may be carried out. Especially, when the operation of the auxiliary tray 111 is executed prior to that of the lower staple unit 35 in either the case where the operation of the lower staple unit 35 is performed prior to the operation of the upper staple unit 36 or the case where the operations of the upper and lower staple units 36 and 35 are simultaneously executed, for the second and subsequent sheet bundles, the auxiliary tray 111 is disposed in the undermost sheet-surface position by one of the following methods: the calculated thickness t1 of the stack of sheets P1 is added to the movement amount B measured for the immediately preceding sheet bundle; the auxiliary tray 111 is remained in the position without being returned to its reference position after the staple is driven and the auxiliary tray 111 is lifted only by an amount of the calculated thickness t1 of the stack of sheets P1 for the next sheet bundle; and the thickness t1 of each sheet bundle which has been formed until then is added up.

Although the auxiliary tray 111 operates before the operation of the lower staple unit 35 in the foregoing embodiments of the invention shown in FIGS. 24 to 30 and FIGS. 32 to 57, the invention is not limited to the arrangement. The auxiliary tray 111 can be also simultaneously operated with the operation of the lower staple unit 35. By this arrangement, the processing speed of forming the sheet bundle P2 can be increased.

Although the number of sheets P1 is set in the sheet number setting unit 78 in the foregoing embodiments of the invention shown in FIGS. 1 to 57, instead, the number of sheets can be also counted by means for counting the number of sheets in the sheet transport path of the laser beam printer 2.

In the embodiments of the invention shown in FIGS. 12 to 57, the movement amount A of the upper staple unit 36 and/or the movement amount B of the lower staple unit 35 are/is measured by counting the number of input pulses supplied to the first motor 47 and/or the second motor 54 by the pulse counter 90 and/or the pulse counter 99. In place of the above manner, the driving time of the first motor 47 and/or the second motor 54 may be measured by timers. Specifically, by calculating the product of the frequency of the input pulses and the driving time of the first motor 47 and/or the second motor 54, the number of pulses supplied to the first motor 47 and/or the second motor 54 during the driving time can be determined. In such a manner, the movement amount A of the upper staple unit 36 and/or the movement amount B of the lower staple unit 35 can be measured.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding the plurality of sheets stacked on the sheet tray;

moving means for moving the stapler in a sheet stacking direction; and movement controlling means for controlling the moving means to move the stapler in the sheet stacking direction to a position where the plurality of sheets stacked on the sheet tray are to be bound, the movement controlling means moving the stapler in a manner which takes into account variations in height of sheet bundles previously formed and placed on the sheet tray upon which the plurality of sheets are stacked.

2. The stapling apparatus of claim 1, further comprising:

pushing means arranged in a peripheral part of the sheet tray, for pushing against a side face of the formed sheet bundle so as to move the sheet bundle away from the stapler.

3. The stapling apparatus of claim 1, wherein the stapler has staple changing means for housing staples of different kinds and changing a staple according the thickness of a plurality of sheets.

4. The stapling apparatus of claim 1, wherein the sheet tray comprises:

a sheet bundle contacting member which is disposed in a peripheral part of the sheet tray so as to face the stapler and with which a peripheral part of the sheet bundle can partly come into contact;

inclining means for inclining the sheet tray; and inclination controlling means for controlling an inclining operation of the inclining means so as to incline the sheet tray in the direction such that the sheet bundle approaches the sheet bundle contacting member after formation of the sheet bundle.

5. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding the plurality of sheets stacked on the sheet tray;

moving means for moving the stapler in a sheet stacking direction; and movement controlling means for controlling the moving means so that the stapler is disposed in a position in the sheet stacking direction where the plurality of sheets stacked on the sheet tray are to be bound, wherein the sheet tray comprises:

a sheet bundle contacting member which is disposed in a peripheral part of the sheet tray so as to face the stapler and with which a peripheral part of the sheet bundle can partly come into contact;

inclining means for inclining the sheet tray; and inclination controlling means for controlling an inclining operation of the inclining means so as to incline the sheet tray in the direction such that the sheet bundle approaches the sheet bundle contacting member after formation of the sheet bundle;

wherein the sheet tray including a sheet contacting member which is disposed in a peripheral part of the sheet tray and on the side where the stapler is disposed and with which a peripheral part of a stack of sheets to be bound can partly come into contact, comprises:

an auxiliary tray disposed in a peripheral part of the sheet tray, on which sheets and a sheet bundle protruded from the sheet tray are placed; and auxiliary tray moving means for moving the auxiliary tray in the sheet stacking direction, wherein the sheet tray and the auxiliary tray are arranged in a same position in the sheet stacking direction by the movement controlling means and the inclination controlling means, before stacking sheets on the sheet tray the auxiliary tray is moved to a same level in the sheet stacking direction as that of the uppermost sheet of the previous stack of sheets placed on the sheet tray, and when the sheets are placed on the sheet tray, operations of the auxiliary tray moving means and the inclining means are controlled so as to incline the sheet tray in a direction that the sheets approach the sheet contacting member.

6. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding the plurality of sheets stacked on the sheet tray;

moving means for moving the stapler in a sheet stacking direction; and movement controlling means for controlling the moving means so that the stapler is disposed in a position in the sheet stacking direction where the plurality of sheets stacked on the sheet tray are to be bound, wherein the sheet tray including a side plate which is disposed in a peripheral part of the sheet tray so as to face the stapler and with which a side face opposite to the stapler side of the sheet bundle can come into contact, and an end plate which is disposed in a peripheral part adjacent to the side plate of the sheet tray and with which an end face of the sheet bundle can come into contact, comprises:

first inclining means for inclining the sheet tray in one direction that the sheet bundle is moved toward the side plate;

second inclining means for inclining the sheet tray in the other direction that the sheet bundle is moved toward the end plate; and inclination controlling means for controlling inclining operations of the first and second inclining means so that the operation of inclining the sheet tray in one direction and the operation of inclining the sheet tray in the other direction are alternately executed.

7. The stapling apparatus of claim 6, wherein the sheet tray including a sheet contacting member which is disposed in a peripheral part of the sheet tray on the side where the stapler is disposed and with which a peripheral part of a stack of sheets to be bound can come into contact, comprises:

an auxiliary tray which is disposed in a peripheral part of the sheet tray and on which sheets and a sheet bundle protruded from the sheet tray are placed; and auxiliary tray moving means for moving the auxiliary tray in the sheet stacking direction, and wherein the sheet tray and the auxiliary tray are arranged in a same position in the sheet stacking direction by the movement controlling means and the inclination controlling means, before stacking a plurality of sheets on the sheet tray the auxiliary tray is moved to a same level in the sheet stacking direction as that of the uppermost sheet of the previous stack of sheets placed on the sheet tray, and when the plurality of sheets are stacked on the sheet tray, operations of the auxiliary tray moving means and the inclining means are controlled so as to incline the sheet tray in a direction where the sheet approaches the sheet contacting member.

8. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding the plurality of sheets stacked on the sheet tray;

moving means for moving the stapler in a sheet stacking direction; and movement controlling means for controlling the moving means so that the stapler is disposed in a position in the sheet stacking direction where the plurality of sheets stacked on the sheet tray are to be bound, wherein the sheet tray comprises:

a bottom plate on which sheets are sequentially stacked and formed sheet bundles are placed;

a first side plate which is integrally formed with the bottom plate and can come into contact with a side face of the formed sheet bundle;

a second side plate which faces the first side plate and is provided fixedly with respect to the first side plate; and bottom plate driving means for reciprocating the bottom plate so that the first side plate is moved toward or apart from the second side plate, and wherein when the sheet bundle is formed, the movement controlling means controls an operation of the bottom plate driving means so that the first side plate is moved together with the bottom plate toward the second side plate so as to dispose the first side plate in a position where an interval between the first and second side plates is almost equal to the length in the width direction of the sheet, and the first side plate is moved together with the bottom plate in the direction away from the second side plate so that the first side plate is disposed in the original position.

9. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for stapling a plurality of sheets stacked on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in a sheet stacking direction and a direction opposite to the sheet stacking direction;

bending side unit moving means for moving the bending side unit of the stapler both in the sheet stacking direction and in the direction opposite to the sheet stacking direction;

uppermost sheet-surface sensing means for sensing a position of an uppermost sheet-surface of the stack of sheets placed on the sheet tray by using a predetermined position in an upper part of the stapling apparatus as a reference;

stack of sheets thickness calculating means for calculating thickness of the plurality of sheets; and movement controlling means for controlling the driving side unit moving means and the bending side unit moving means so that either the driving side unit or the bending side unit is disposed in a sensed position of the uppermost sheet-surface of the stack of sheets and the other of the driving side and bending side units is disposed in a position obtained by adding the calculated thickness of the stack of sheets to the position of the uppermost sheet-surface of the stack of sheets.

10. The stapling apparatus of claim 9, wherein the sheet-surface sensing means comprises:

upper reference position sensing means for sensing that either the driving side unit or the bending side unit which is on the side opposite to the sheet tray of a plurality of sheets is disposed in the predetermined position in the upper part of the stapling apparatus;

uppermost sheet-surface contact sensing means which is provided on the side facing the sheet tray of the one of the units, for sensing that the one of the units comes into contact with the uppermost sheet-surface of the stack of sheets placed on the sheet tray; and measuring means for measuring a movement amount of the one of the units from the predetermined position to the uppermost sheet-surface position, and wherein the movement controlling means controls the driving side and bending side unit moving means so as to move the one of the units until the uppermost sheet-surface contact sensing means senses that the one of the units comes into contact with the uppermost sheet-surface of the stack of sheets.

11. The stapling apparatus of claim 9, the stapling apparatus further comprising:

an auxiliary tray disposed in a peripheral part of the sheet tray and on which sheets and a sheet bundle protruded from the sheet tray are placed; and auxiliary tray moving means for moving the auxiliary tray in the sheet stacking direction, wherein the movement controlling means controls the operations of the driving side unit moving means, the bending side unit moving unit, and the auxiliary tray moving means so that the sheet tray and the auxiliary tray are disposed in the same position in the sheet stacking direction, and when a plurality of sheets are placed on the sheet tray, the auxiliary tray is moved to a position in the sheet stacking direction, where the sheets placed on the sheet tray are to be bound, and one of the driving side and bending side units which is on the sheet tray side of the sheets is moved.

12. A stapling apparatus for stapling a stack of sheets to form sheet bundles, comprising:

a sheet tray on which sheets are sequentially stacked and formed sheet bundles are placed;

a stapler disposed in a peripheral part of the sheet tray, for stapling a stack of sheets placed on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in the sheet stacking direction and the direction opposite to the sheet stacking direction;

bending side unit moving means for moving the bending side unit of the stapler both in the sheet stacking direction and the direction opposite to the sheet stacking direction;

undermost sheet-surface sensing means for sensing the position of the undermost sheet-surface of the stack of sheets placed on the sheet tray by using a predetermined position in the lower part of the stapling apparatus as a reference;

stack of sheets thickness calculating means for calculating thickness of a stack of sheets; and movement controlling means for controlling the driving side unit moving means and the bending side unit moving means so that either the driving side unit or the bending side unit is disposed in the sensed position of the undermost sheet-surface and the other one of the driving side and bending side units is disposed in a position obtained by adding the calculated thickness of the sheets to the position of the undermost sheet-surface.

13. The stapling apparatus of claim 12, wherein the undermost sheet-surface sensing means comprises:

lower reference position sensing means for sensing that one of the driving side and bending side units, which is on the side of the sheet tray of plurality of sheets is disposed in a predetermined position in the lower part of the stapling apparatus;

undermost sheet-surface contact sensing means which is provided on the side facing the sheet tray of the one of the units, for sensing that the one of the units comes into contact with the undermost sheet-surface of the stack of sheets placed on the sheet tray; and measuring means for measuring a movement amount of the one of the units from the predetermined position to the undermost sheet-surface position, and wherein the movement controlling means controls the operations of the driving side and bending side unit moving means so as to move the one of the units until the undermost sheet-surface contact sensing means senses that the one of the units comes into contact with the undermost sheet-surface of the stack of sheets.

14. The stapling apparatus of claim 12, the stapling apparatus further comprising:

an auxiliary tray disposed in a peripheral part of the sheet tray and on which sheets and a sheet bundle protruded from the sheet tray are placed; and auxiliary tray moving means for moving the auxiliary tray in the sheet stacking direction, wherein the movement controlling means controls the operations of the driving side unit moving means, the bending side unit moving unit, and the auxiliary tray moving means so that the sheet tray and the auxiliary tray are disposed in the same position in the sheet stacking direction, and when a plurality of sheets are placed on the sheet tray, the auxiliary tray is moved to a position in the sheet stacking direction, where the sheets placed on the sheet tray are to be bound, and one of the driving side and bending side units which is on the sheet tray side of the sheets is moved.

15. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for binding a plurality of sheets placed on the sheet tray, having a driving side unit for driving a staple through the sheets and a bending side unit which is provided separately from the driving unit and bends tips of the driven staple, projected from the sheets;

driving side unit moving means for moving the driving side unit of the stapler both in the sheet stacking direction and a direction opposite to the sheet stacking direction;

bending side unit moving means for moving the bending side unit of the stapler both in the sheet stacking direction and the direction opposite to the sheet stacking direction;

uppermost sheet-surface sensing means for sensing a position of an uppermost sheet-surface of a stack of sheets placed on the sheet tray by using a predetermined position in the stapling apparatus as a reference;

undermost sheet-surface sensing means for sensing a position of the undermost sheet-surface of the stack of sheets placed on the sheet tray by using a predetermined position in the stapling apparatus as a reference; and movement controlling means for controlling the driving side unit moving means and the bending side unit moving means so that either the driving side unit or the bending side unit is disposed in the sensed position of the uppermost sheet-surface of the stack of sheets and the other one of the driving side and bending side units is disposed in the sensed position of the undermost sheet-surface of the stack of sheets.

16. The stapling apparatus of claim 15, wherein the sheet-surface sensing means comprises:

upper reference position sensing means for sensing that either the driving side unit or the bending side unit which is on the side opposite to the sheet tray of a plurality of sheets is disposed in the predetermined position in the upper part of the stapling apparatus;

uppermost sheet-surface contact sensing means which is provided on the side facing the sheet tray of the one of the units, for sensing that the one of the units comes into contact with the uppermost sheet-surface of the stack of sheets placed on the sheet tray; and measuring means for measuring a movement amount of the one of the units from the predetermined position to the uppermost sheet-surface position, and wherein the movement controlling means controls the driving side and bending side unit moving means so as to move the one of the units until the uppermost sheet-surface contact sensing means senses that the one of the units comes into contact with the uppermost sheet-surface of the stack of sheets.

17. The stapling apparatus of claim 15, wherein the undermost sheet-surface sensing means comprises:

lower reference position sensing means for sensing that one of the driving side and bending side units, which is on the side of the sheet tray of plurality of sheets is disposed in a predetermined position in the lower part of the stapling apparatus;

undermost sheet-surface contact sensing means which is provided on the side facing the sheet tray of the one of the units, for sensing that the one of the units comes into contact with the undermost sheet-surface of the stack of sheets placed on the sheet tray; and measuring means for measuring a movement amount of the one of the units from the predetermined position to the undermost sheet-surface position, and wherein the movement controlling means controls the operations of the driving side and bending side unit moving means so as to move the one of the units until the undermost sheet-surface contact sensing means senses that the one of the units comes into contact with the undermost sheet-surface of the stack of sheets.

18. The stapling apparatus of claim 15, the stapling apparatus further comprising:

an auxiliary tray disposed in a peripheral part of the sheet tray and on which sheets and a sheet bundle protruded from the sheet tray are placed; and auxiliary tray moving means for moving the auxiliary tray in the sheet stacking direction, wherein the movement controlling means controls the operations of the driving side unit moving means, the bending side unit moving unit, and the auxiliary tray moving means so that the sheet tray and the auxiliary tray are disposed in the same position in the sheet stacking direction, and when a plurality of sheets are placed on the sheet tray, the auxiliary tray is moved to a position in the sheet stacking direction, where the sheets placed on the sheet tray are to be bound, and one of the driving side and bending side units which is on the sheet tray side of the sheets is moved.

19. A stapling apparatus for stapling a plurality of sheets to form sheet bundles, comprising:

a sheet tray on which sheets are sequentially stacked and formed sheet bundles are placed;

a stapler disposed in a peripheral part of the sheet tray, for stapling a plurality of sheets stacked on the sheet tray, having a driving side unit for driving a staple through the sheets and a bending side unit which is provided separately from the driving side unit and bends tips of the driven staple projected from the sheets;

driving side unit moving means for moving the driving side unit of the stapler both in the sheet stacking direction and a direction opposite to the sheet stacking direction;

bending side unit moving means for moving the bending side unit of the stapler both in the sheet stacking direction and the direction opposite to the sheet stacking direction; and movement controlling means for controlling the driving side unit moving means and the bending side unit moving means so that when a plurality of sheets are placed on the sheet tray, one of the driving side and bending side units which is on the sheet tray side is moved to a position in the sheet stacking direction, where the sheets placed on the sheet tray are to be bound, wherein either the driving side unit or the bending side unit of the stapler, which is on the sheet tray side of the sheets has a supporting face extending almost across the area of the sheets protruded from the sheet tray.

* * * * *